US011919697B2

(12) United States Patent
Ito et al.

(10) Patent No.: US 11,919,697 B2
(45) Date of Patent: Mar. 5, 2024

(54) AIR CUSHIONING MATERIAL

(71) Applicant: Konica Minolta, Inc., Tokyo (JP)

(72) Inventors: Tomoaki Ito, Hino (JP); Yuichi Ando, Higashimurayama (JP); Masato Shimokawara, Inagi (JP); Hiroaki Takada, Mitaka (JP); Tsuyoshi Tamaru, Toyokawa (JP); Masato Shinomura, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 78 days.

(21) Appl. No.: 17/224,107

(22) Filed: Apr. 6, 2021

(65) Prior Publication Data

US 2021/0323747 A1 Oct. 21, 2021

(30) Foreign Application Priority Data

Apr. 21, 2020 (JP) ..... 2020-075502

(51) Int. Cl.
*B65D 81/05* (2006.01)
*B65D 81/03* (2006.01)

(52) U.S. Cl.
CPC ..... *B65D 81/052* (2013.01); *B65D 81/03* (2013.01); *B65D 81/055* (2013.01)

(58) Field of Classification Search
CPC .... B65D 81/052; B65D 81/03; B65D 81/055; B65D 81/05
USPC ..... 206/522, 521
See application file for complete search history.

(56) References Cited

U.S. PATENT DOCUMENTS 5,351,829 A * 10/1994 Batsford ..... B65D 81/052 383/3
5,862,914 A * 1/1999 Farison ..... B65D 81/052 206/522
6,398,029 B1 * 6/2002 Farison ..... B65D 81/052 206/592
2016/0340103 A1 11/2016 Yoshifusa et al.

FOREIGN PATENT DOCUMENTS

JP H06-092372 A 4/1994
JP 2018-131258 A 8/2018
JP 2019-094104 A 6/2019

OTHER PUBLICATIONS

Office Action dated Dec. 5, 2023, for the corresponding Japanese Application No. 2020-075502, with English translation.

* cited by examiner

*Primary Examiner* — Steven A. Reynolds
(74) *Attorney, Agent, or Firm* — LUCAS & MERCANTI, LLP

(57) ABSTRACT

An air cushioning material includes: a first module including a first air cell containing air, a second air cell containing air, and a first belt-like part connecting the first air cell and the second air cell to each other; a second module including a third air cell containing air, a fourth air cell containing air, and a second belt-like part connecting the third air cell and the fourth air cell to each other; a coupling part that couples a part of the second air cell and a part of the fourth air cell in a second direction, where a direction from the second air cell toward the first air cell and a direction from the fourth air cell toward the third air cell are defined as a first direction, and a direction intersecting the first direction is defined as the second direction.

13 Claims, 50 Drawing Sheets

AIR CUSHIONING MATERIAL

The entire disclosure of Japanese patent Application No. 2020-075502, filed on Apr. 21, 2020, is incorporated herein by reference in its entirety.

BACKGROUND

Technological Field

The present invention relates to an air cushioning material and more particularly relates to an air cushioning material to be inserted into a gap between an article and a packing box, for protecting the article when the article as a packing target is stored in the packing box.

Description of the Related Art

In transporting articles such as printers, copiers, and personal computers (PCs), emphasis is placed on how to protect the articles from vibrations and shocks during transportation. In response to such request for protection of an article, a foamed resin cushioning material has been mainly used to fill a gap between a packing box and the article However, from the viewpoint of reducing an environmental load, using an air cushioning material is considered to be desirable.

Japanese Patent Application Laid-Open No. 2018-131258 discloses a conventional air cushioning material including two air cells and an intermediate belt-like part provided between the two air cells. An air flow passage through which the two air cells communicate is formed inside the intermediate belt-like part.

However, in the conventional air cushioning material, even if the two air cell parts are attached to the article with a tape or the like, they are in contact with only two surfaces of the article. For this reason, in the conventional air cushioning material, if the tape holding one of the air cell parts is peeled off due to vibration during transportation, the air cell part is displaced from the article. In this case, with the conventional air cushioning material, the tape holding the other air cell part is also easily peeled off, and as a result, the air cushioning material itself may come off from the article during transportation.

SUMMARY

The present invention has been made in view of the above circumstances, and an object of the present invention is to provide an air cushioning material that does not easily shift or fall after packaging.

To achieve the abovementioned object, according to an aspect of the present invention, an air cushioning material reflecting one aspect of the present invention comprises: a first module including a first air cell containing air, a second air cell containing air, and a first belt-like part connecting the first air cell and the second air cell to each other; a second module including a third air cell containing air, a fourth air cell containing air, and a second belt-like part connecting the third air cell and the fourth air cell to each other; a coupling part that couples a part of the second air cell and a part of the fourth air cell in a second direction, where a direction from the second air cell toward the first air cell and a direction from the fourth air cell toward the third air cell are defined as a first direction, and a direction intersecting the first direction is defined as the second direction, wherein a length of the first belt-like part in the first direction is equal to or longer than a length of the third air cell in the second direction, and a length of the second belt-like part in the first direction is equal to or longer than a length of the first air cell in the second direction.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
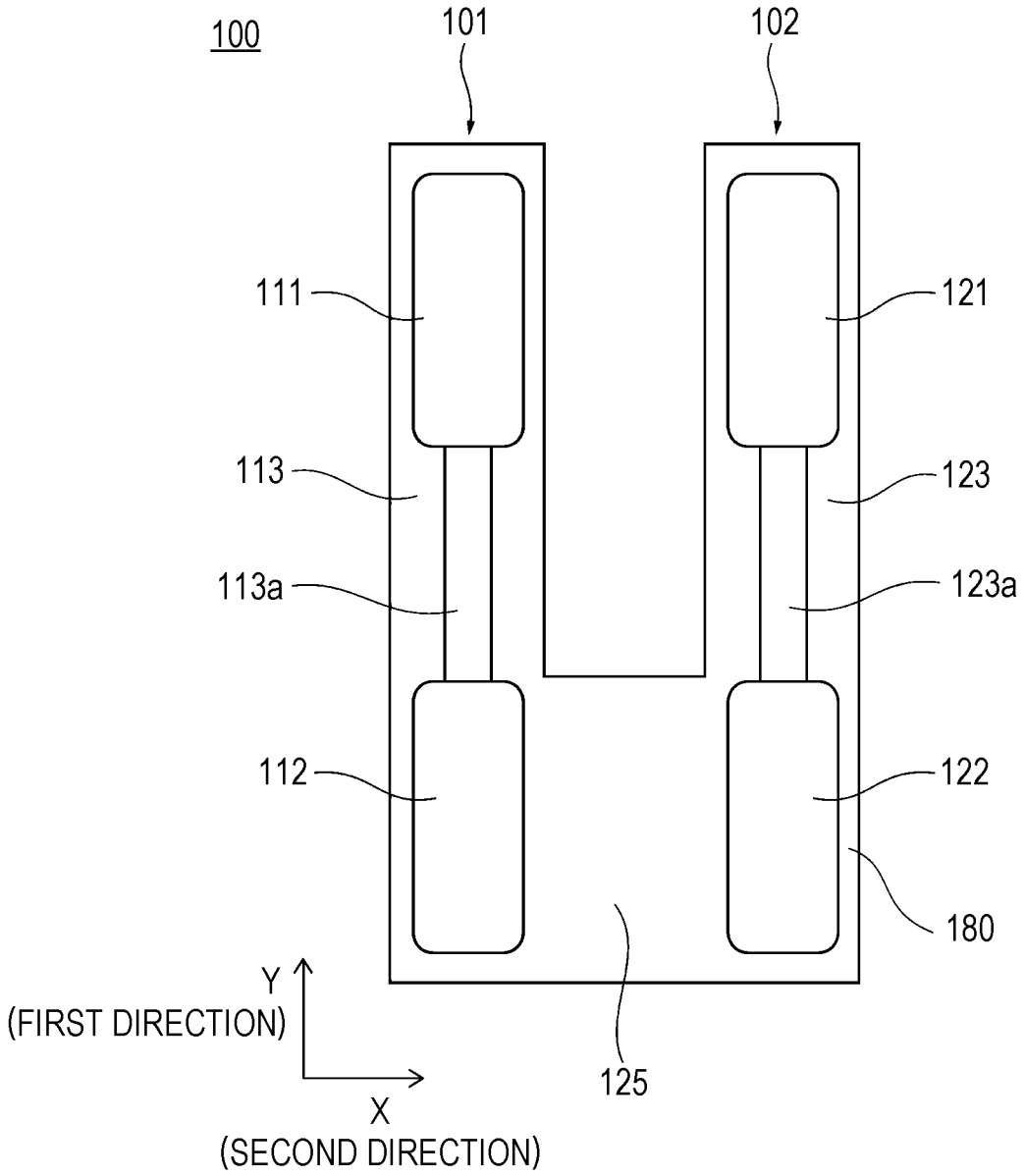
FIG. 1 is a plan view illustrating a configuration of an air cushioning material of a first embodiment.

Hereinafter, one or more embodiments of the present invention will be described with reference to the drawings. However, the scope of the invention is not limited to the disclosed embodiments. In the description of the drawings, the same elements are denoted by the same reference numerals, and redundant description will be omitted. Furthermore, some reference numerals for members having the same shape will be omitted. Furthermore, the dimensional ratios in the drawings are exaggerated for convenience of description, and may differ from the actual ratios.

First Embodiment

Figure 2:
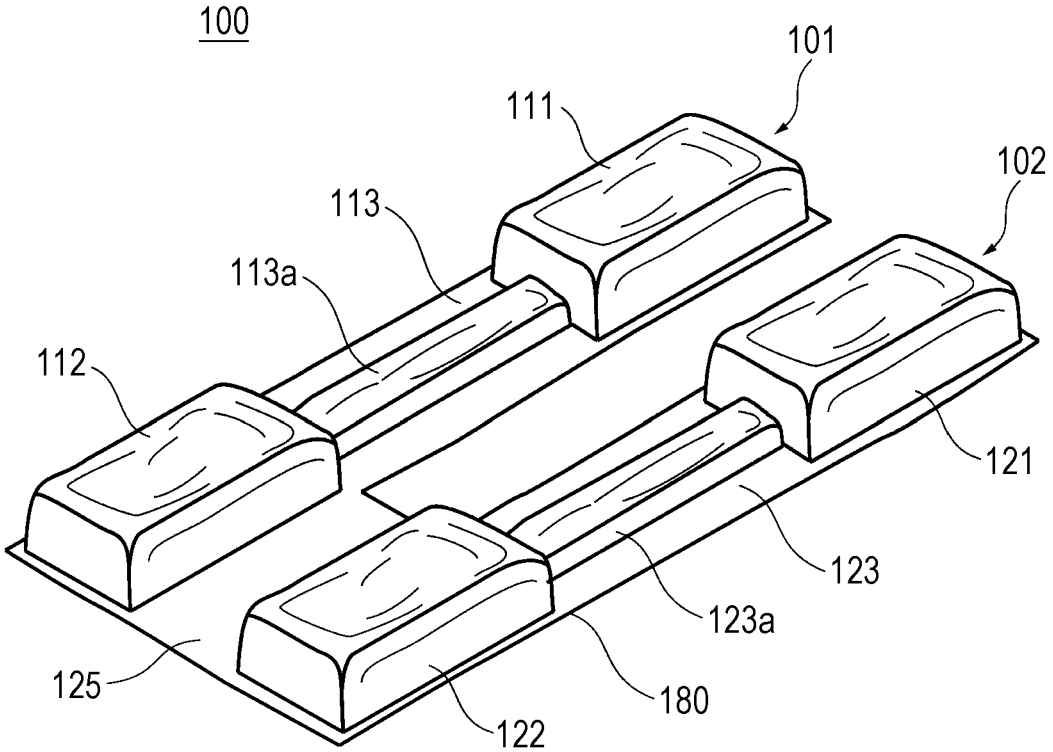
FIG. 2 is a perspective view illustrating a configuration of the air cushioning material of the first embodiment.

FIG. 1 is a plan view illustrating a configuration of an air cushioning material of a first embodiment. FIG. 2 is a perspective view illustrating a configuration of the air cushioning material of the first embodiment.

As illustrated in FIGS. 1 and 2, an air cushioning material 100 of the first embodiment includes a first module 101 and a second module 102.

In the first module 101, a first air cell 111 and a second air cell 112 each containing air are connected to each other by a first belt-like part 113. The first belt-like part 113 includes an air passage 113*a*. With the air passage 113*a*, the air circulates between the first air cell 111 and the second air cell 112. The air passage 113*a* may not be provided. However, it is preferable that the air passage 113*a* is provided. With the air passage 113*a*, the air in one of the first air cell 111 and the second air cell 112 being pressed can move to the other one, so that the air cell can be prevented from rupturing.

In the second module 102, a third air cell 121 and a fourth air cell 122 each containing air are connected to each other by a second belt-like part 123. The second belt-like part 123 includes an air passage 123*a*. With the air passage 123*a*, the air circulates between the third air cell 121 and the fourth air cell 122. The air passage 123*a* may not be provided but is preferably provided, as in the first module 101.

The air cushioning material 100 includes a coupling part 125 coupling a part of the second air cell 112 of the first module 101 and a part of the fourth air cell 122 of the second module 102.

The first module 101 and the second module 102 of the air cushioning material 100 have the same shape.

The first to the fourth air cells 111, 112, 121, and 122, and the air passages 113*a*, 123*a* are all formed on a base film 180. The base film 180 is a margin part after the air cells and the like are formed by overlaying film materials. The base film 180 (margin part) may not be provided.

In the present embodiment, a direction from the second air cell 112 to the first air cell 111 and a direction from the fourth air cell 122 to the third air cell 121 are defined as a first direction (Y), and a direction intersecting the first direction is defined as a second direction (X). In the present embodiment, the first direction and the second direction are orthogonal to each other. Furthermore, the direction in which the first air cell 111 and the second air cell 112 are connected to each other is parallel to the direction in which the third air cell 121 and the fourth air cell 122 are connected to each other. The definitions of these directions are the same in other embodiments described below.

Still, orthogonal and parallel include product errors in manufacturing processes. The air cushioning material 100 is made of a flexible material. The dimensional accuracy of the air cushioning material 100 is not required to be strict because the product is characterized to be used as a packing material. Thus, orthogonal and parallel may be of any accuracy enabling the air cushioning material 100 to be used.

An example of the material used for the air cushioning material 100 includes synthetic resin such as polyethylene, polypropylene, or polyvinyl chloride. Preferably, low density polyethylene is used.

Figure 3A:
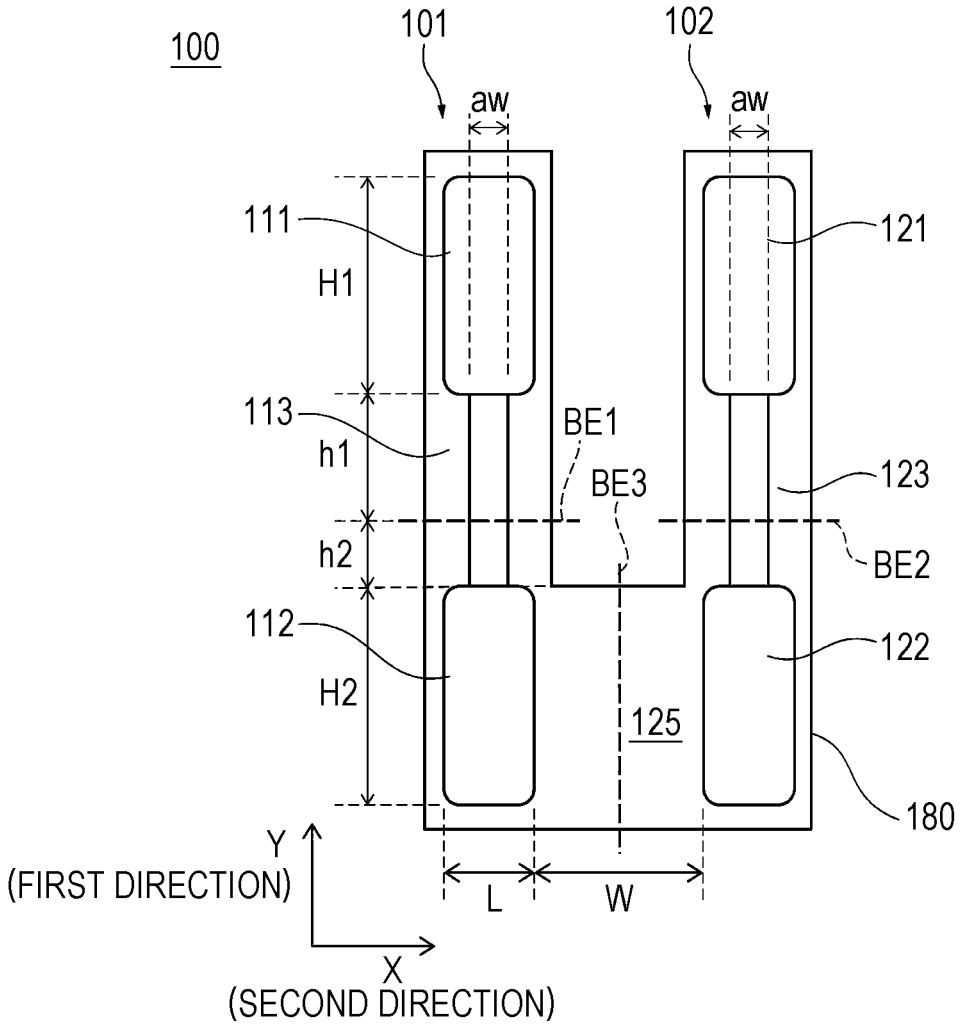
FIG. 3A is a plan view illustrating a detailed configuration of the air cushioning material of the first embodiment.
Figure 3B:
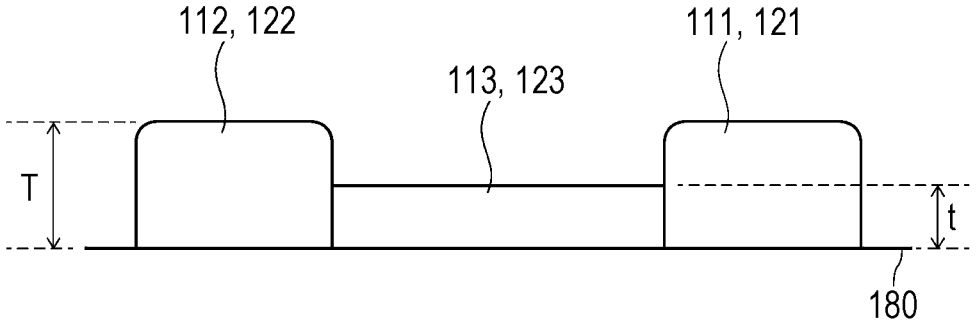
FIG. 3B is a side view illustrating a detailed configuration of the air cushioning material of the first embodiment.

FIG. 3A is a plan view illustrating a detailed configuration of the air cushioning material 100 of the first embodiment, and FIG. 3B is a side view illustrating a detailed configuration of the air cushioning material 100 of the first embodiment.

The first module 101 can be rotated by at least 90° around the X-axis about a bending position BE1 indicated by a broken line. Similarly, the second module 102 can rotate at least 90° around the X-axis about a bending position BE2 indicated by a dashed line. Further, the air cushioning material 100 can by rotated by at least 90° about the Y-axis around a bending position BE3 of the coupling part 125.

In the present first embodiment, the length of each part of the air cushioning material 100 is defined as follows.

H1: A length of the first air cell 111 in the first direction and the length of the third air cell 121 in the first direction. H1 is of any length.

h1: A length from the bending position BE1 to the end of the first air cell 111 on the bending position side, and the length from the bending position BE2 to the end of the third air cell 121 on the bending position side. h1 will be described later.

h2: A length from the bending position BE1 to the end of the second air cell 112 on the bending position side, and the length from the bending position BE2 to the end of the fourth air cell 122 on the bending position side. h2 is of any length.

H2: A length of the second air cell 112 in the first direction and the length of the fourth air cell 122 in the first direction. H2 is of any length.

aw: A length of the air passage 113*a* in the second direction and the length of the air passage 123*a* in the second direction. aw will be described later.

L: A length of the first air cell 111 and the second air cell 112 in the second direction (also referred to as the length of the air cell in the second direction). L is of any length.

W: A length of the coupling part 125 in the second direction (from the end of the second air cell 112 to the end of the fourth air cell 122). W is of any length (W≥0 (the same applies hereinafter)).

T: The maximum thickness of the lower one of the first air cell 111 and the second air cell 112. T is of any thickness.

t: A thickness of the first belt-like part (first air passage 113*a* part). t is of any thickness. The thickness is the thickness in a state where no load is applied to any of the first air cell 111 and the second air cell 112. The same applies to each part on the side of the second module 102.

The parts of the air cushioning material 100 defined as described above are assumed to satisfy the conditions h1≥L+W/2, aw≤L, and t≤T/2.

The air cushioning material 100 with the parts having the lengths (the thicknesses, and so forth) described above can be maintained in a state of facing three sides of an article 10 as described later.

Figure 4:
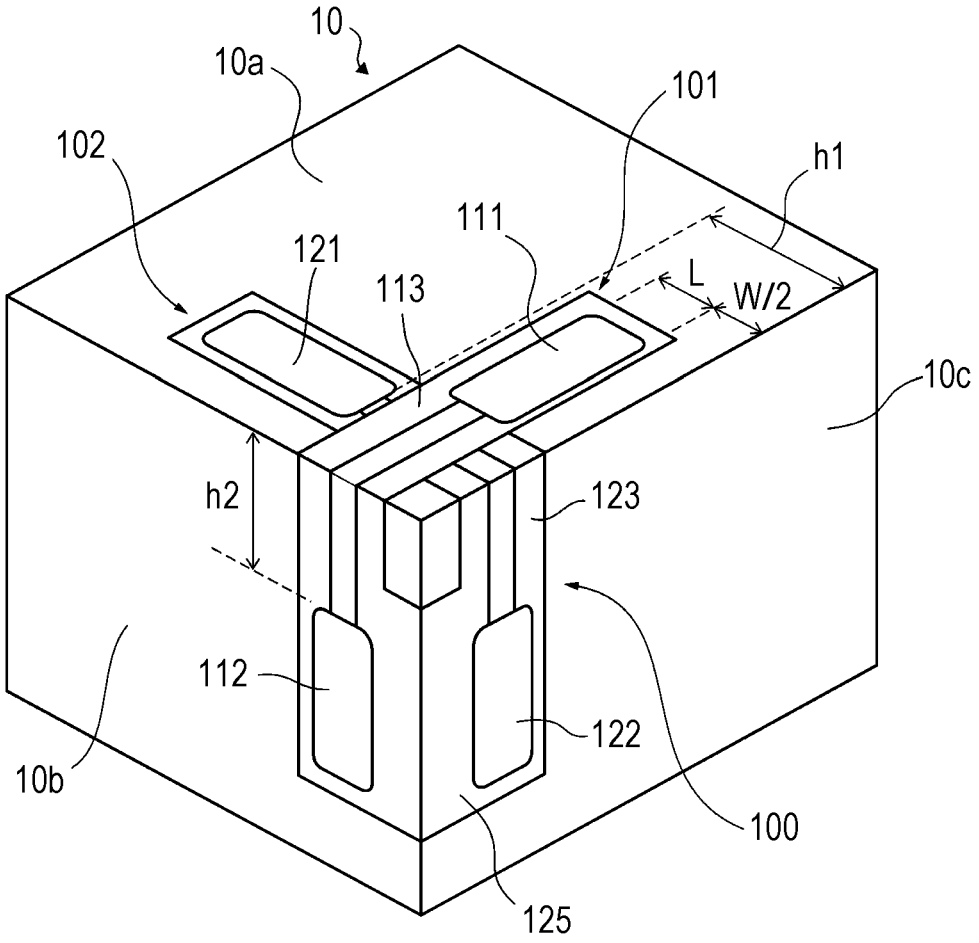
FIG. 4 is a perspective view illustrating an example of an attachment mode of the air cushioning material of the first embodiment to an article.

FIG. 4 is a perspective view illustrating an example of an attachment mode of the air cushioning material 100 of the first embodiment to the article 10. As illustrated in FIG. 4, the coupling part 125 of the air cushioning material 100 is bent so that the second air cell 112 and the fourth air cell 122 come into contact with two surfaces 10*b* and 10*c* of the article 10. The second belt-like part 123 of the second module 102 is bent so that the third air cell 121 and a part of the second belt-like part 123 come into contact with a surface 10*a* of the article 10. The first belt-like part 113 of the first module 101 is bent so that the first air cell 111 and a part of the first belt-like part 113 come into contact with the surface 10*a* of the article 10 to cover a part of the second belt-like part 123.

In this state, h1 satisfies h1≥L+W/2, and is the length from a corner part of contact between the surface 10*c* and the surface 10*a*. The minimum value of h1 is h1=L which holds when W=0. h2 satisfies h2≥0 and is a length from a corner part of contact between the surface 10*b* and the surface 10*a*.

The article 10 illustrated in FIG. 4 is a rectangular parallelepiped member. Thus, the first belt-like part 113, the second belt-like part 123, and the coupling part 125 are bent 90° at the bending positions BE1 to BE3.

Figure 5:
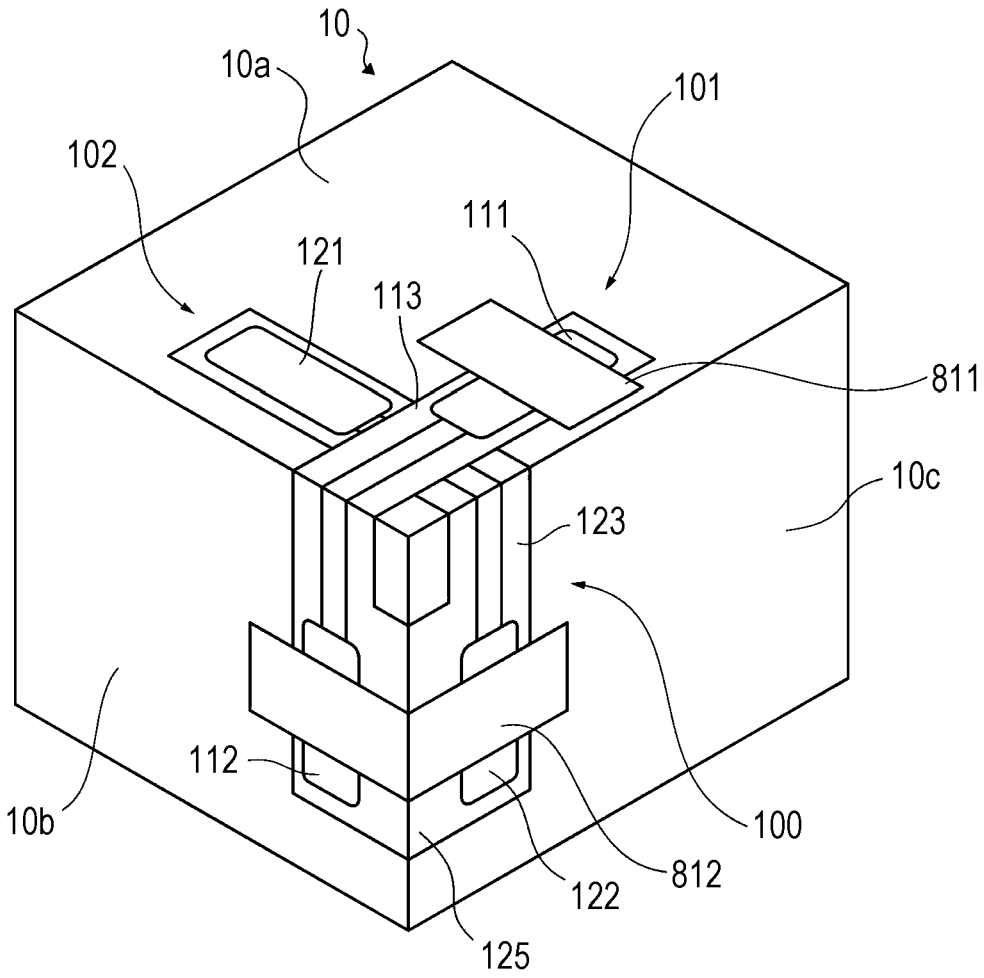
FIG. 5 is a perspective view illustrating a state in which the air cushioning material of the first embodiment is taped.

An attachment mode of the air cushioning material 100 to the article 10 will be described. FIG. 5 is a perspective view illustrating a state in which the air cushioning material 100 of the first embodiment is taped.

As illustrated in FIG. 5, the air cushioning material 100 is attached using tapes 811 and 812 while being arranged to be in contact with the three sides 10*a* to 10*c* of the article 10. A part of the first air cell 111 is attached using the tape 811, and parts of the second air cell 112 and the fourth air cell 122 is attached using the tape 812. With this attachment mode, the air cushioning material 100 is taped to the article 10 at two points.

Figure 6A:
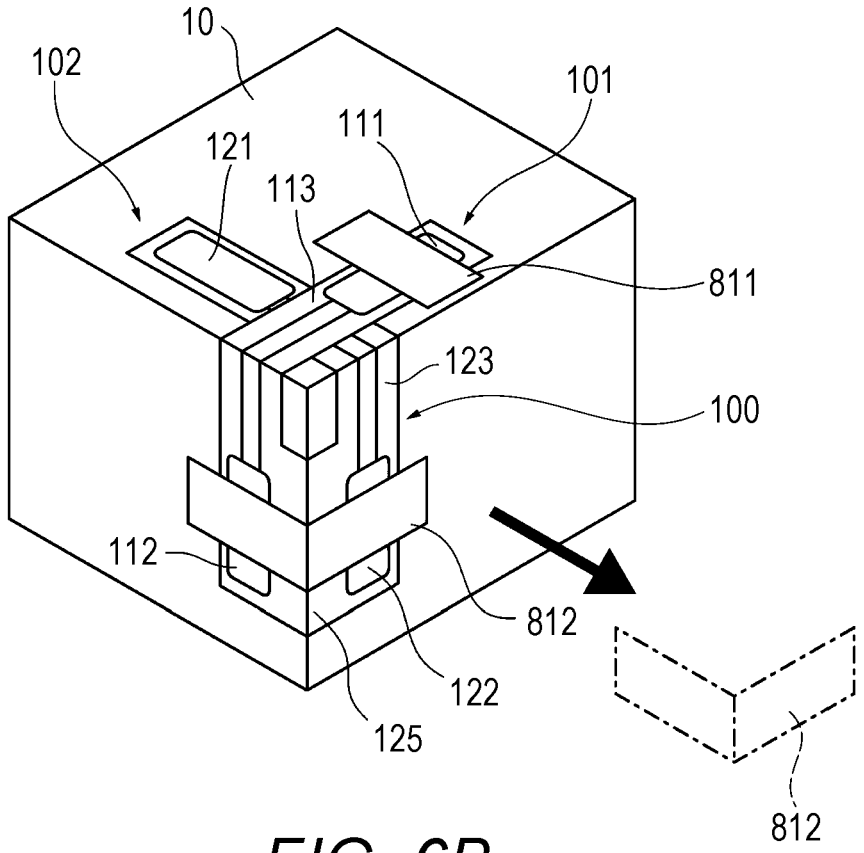
FIGS. 6A and 6B are perspective views illustrating a state in which the air cushioning material of the first embodiment is taped to the article.
Figure 6B:
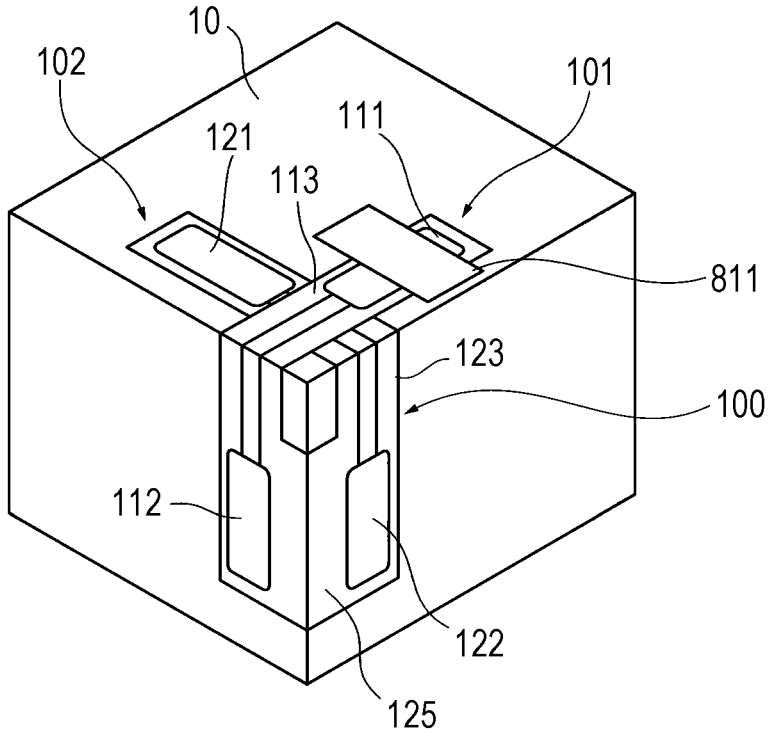

FIGS. 6A and 6B are perspective views illustrating a state in which the air cushioning material 100 of the first embodiment is taped to the article 10.

The attachment mode of the air cushioning material 100 to the article 10 is the same as that in FIG. 5. As illustrated in FIG. 6A, the tape 812 of the air cushioning material 100 might be peeled off due to vibrations or shock during transportation.

As illustrated in FIG. 6B, even when the tape 812 is peeled off, the air cushioning material 100 is kept in contact with the three surfaces. Thus, the air cushioning material 100 does not fall off from the article 10 even if the vibrations continue during transportation.

Figure 7:
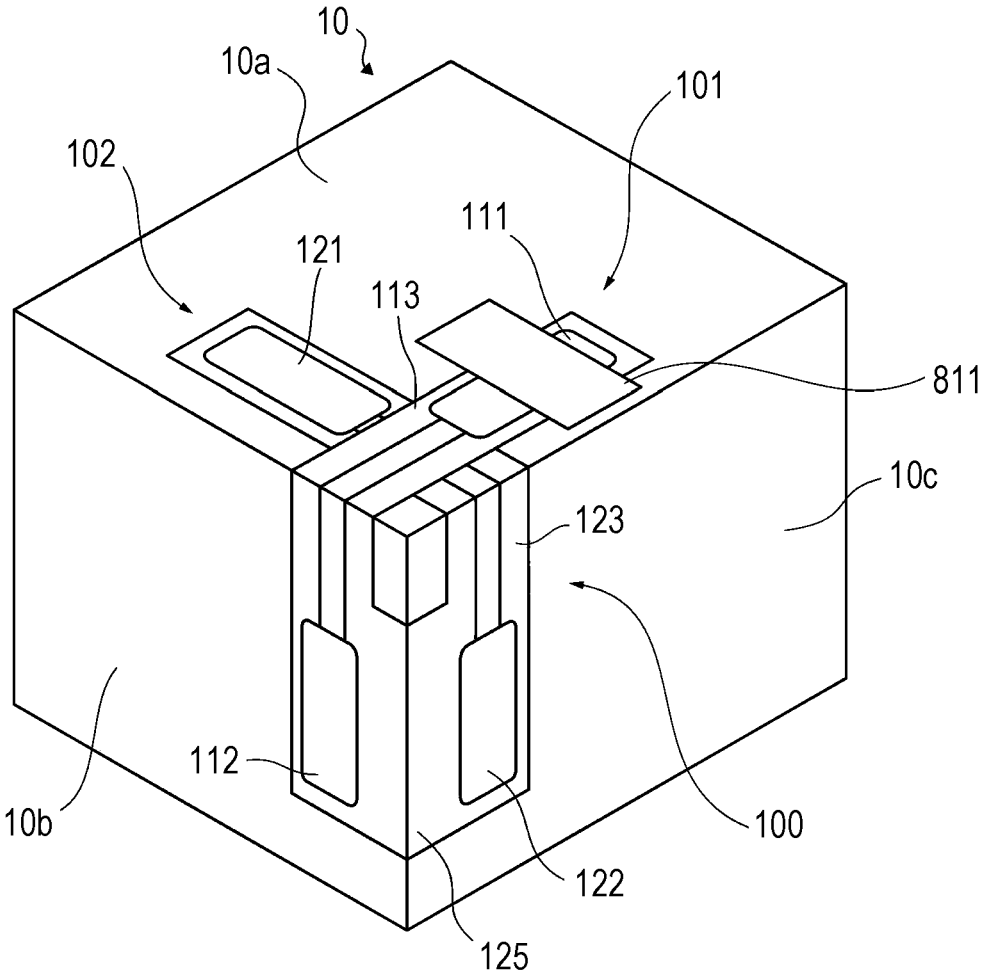
FIG. 7 is a perspective view illustrating another example of an attachment mode the air cushioning material of the first embodiment.

An example of another mode of attachment of the air cushioning material 100 will be described. FIG. 7 is a perspective view illustrating another example of an attachment mode the air cushioning material 100 of the first embodiment.

As described with reference to FIGS. 6A and 6B, the air cushioning material 100 of the present first embodiment does not fall from the article 10 as long as the part of the first air cell 111 is attached. Therefore, as another example of the attachment mode, as illustrated in FIG. 7, only the part of the first air cell 111 may be attached with the tape 811 in the first place. Thus, with the other attachment mode of the air cushioning material 100 of the present first embodiment, only one part is taped. Thus, with the example of the other attachment mode, a packing work load can further be reduced.

The air cushioning material 100 of the present first embodiment may even be used without being taped at all, as in the state illustrated in FIG. 4. The air cushioning material 100 of the present first embodiment is usually arranged in a gap between a packing box such as a corrugated cardboard box and the article 10 placed therein. The air cushioning material 100 of the present first embodiment is sandwiched between the packing box and the article 10, while being arranged to be in contact with the three surfaces of the article 10. Therefore, the air cushioning material 100 of the present first embodiment would not be displaced or fall off due to vibration even if it is not taped.

With the attachment mode described above, the first belt-like part 113, the second belt-like part 123, and the coupling part 125 are bent at substantially center positions. However, the bending position of the air cushioning material 100 of the present first embodiment does not necessarily have to be at the center position.

Figure 8:
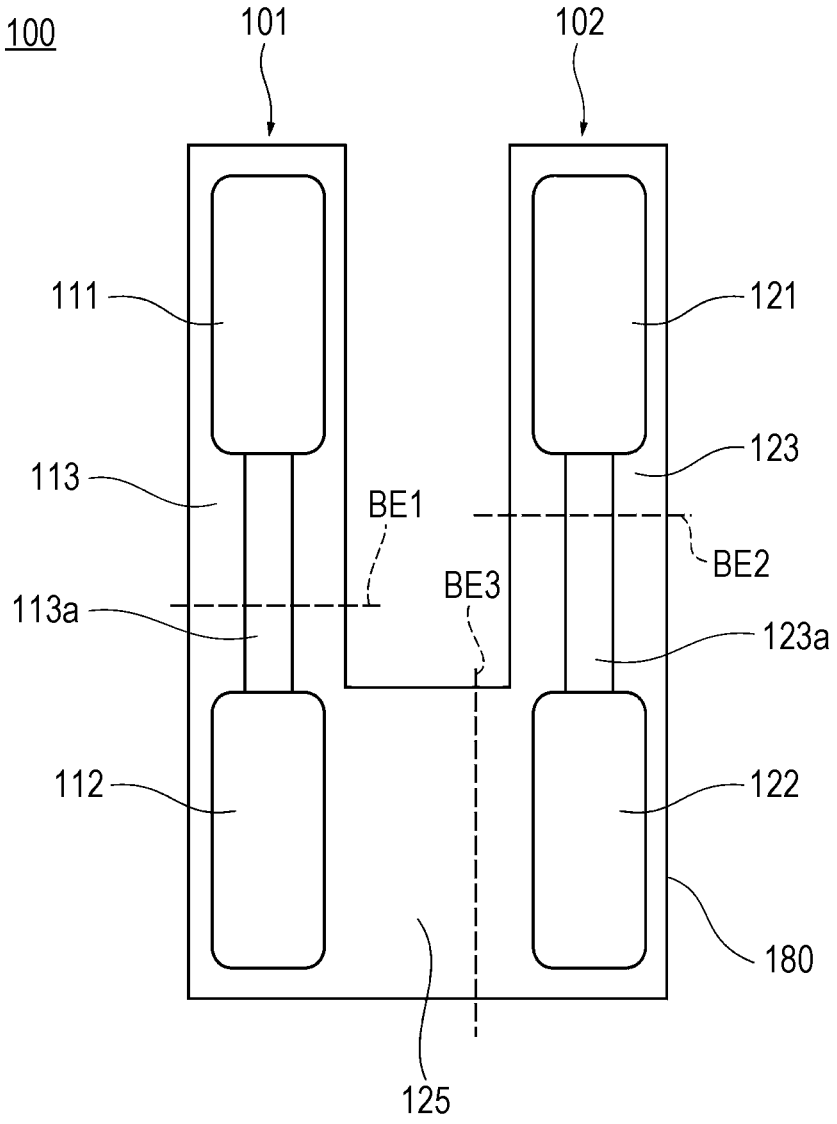
FIG. 8 is a plan view illustrating another example of a bending position of the first embodiment.

FIG. 8 is a plan view illustrating another example of the bending position of the first embodiment.

As illustrated in FIG. 8, the bending position BE1 of the first belt-like part 113 is close to the coupling part 125. The bending position BE2 of the second belt-like part 123 is close to the third air cell 121. The bending position BE3 of the coupling part 125 is close to the second module 102. Thus, the bending position of the air cushioning material 100 is not limited, and may be at any position.

Comparative Example

Figure 9:
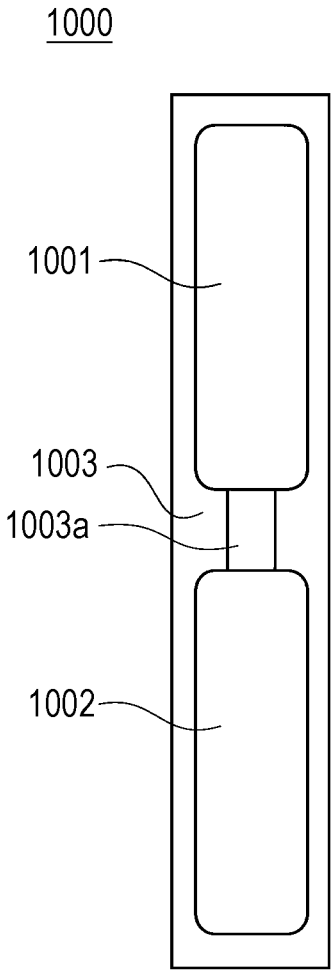
FIG. 9 is a plan view illustrating a configuration of an air cushioning material of Comparative Example.

Here, in order to understand the present embodiment, an air cushioning material including two air cells only would be described as Comparative Example. FIG. 9 is a plan view showing a configuration of an air cushioning material of Comparative Example.

As illustrated in FIG. 9, in an air cushioning material 1000 of Comparative Example, a first air cell 1001 and a second air cell 1002 each containing air are connected to each other by a belt-like part 1003. The belt-like part 1003 is provided with an air passage 1003*a*. With the air passage 1003*a*, the air circulates between the first air cell 1001 and the second air cell 1002.

Figure 10A:
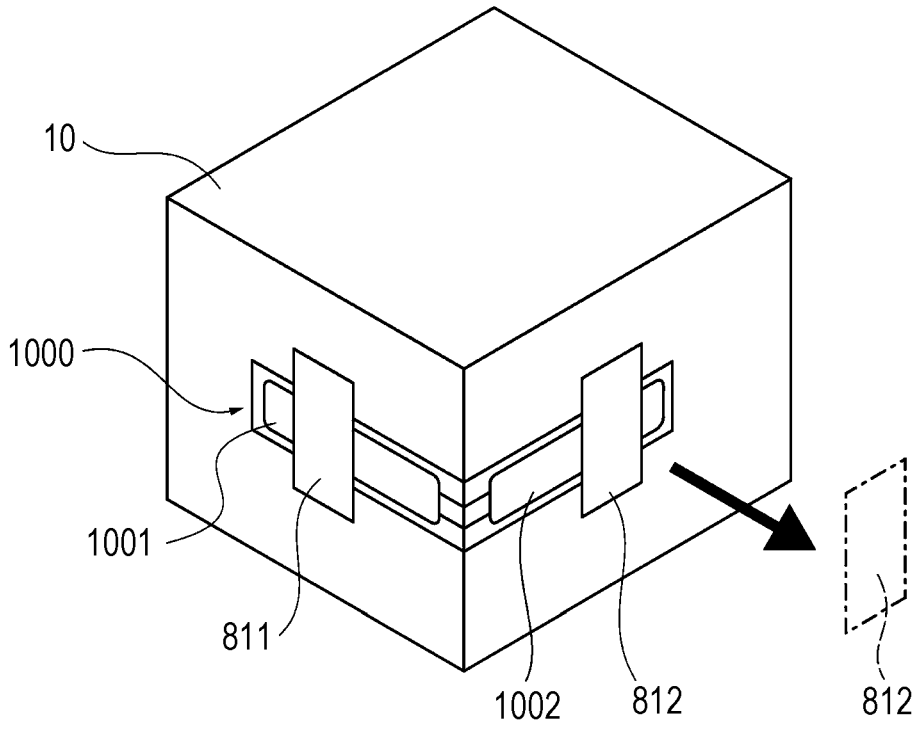
FIGS. 10A and 10B are perspective views illustrating a state in which the air cushioning material of Comparative Example is taped to the article.
Figure 10B:
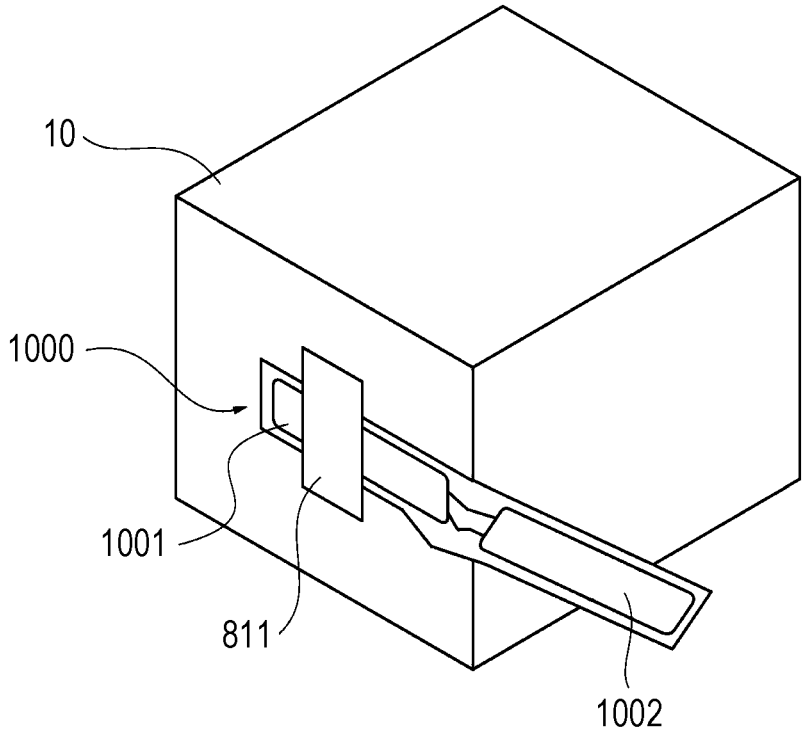

FIGS. 10A and 10B are perspective views illustrating a state in which the air cushioning material of Comparative Example is taped to an article.

The air cushioning material 1000 is attached to the article 10 using the tapes 811 and 812. A part of the first air cell 1001 and a part of the second air cell 1002 are attached to the article 10 respectively using the tape 811 and the tape 812. Therefore, the air cushioning material 1000 is in contact with only the two surfaces of the article 10.

As illustrated in FIG. 10A, the tape 812 of the air cushioning material 1000 might be peeled off due to vibrations or shock during transportation.

As illustrated in FIG. 10B, when the tape 812 is peeled off, the air cushioning material 1000 is attached to the article 10 using only the tape 811 attaching the side of the first air cell 1001.

The second air cell 1002 side of the air cushioning material 1000 in such a state is displaced from the article 10. If this state continues, the second air cell 1002 side flaps due to vibration during transportation. As a result, the first air cell 1001 side may also be peeled off. As a result, the air cushioning material 1000 as a whole falls off from the article 10.

Figure 11:
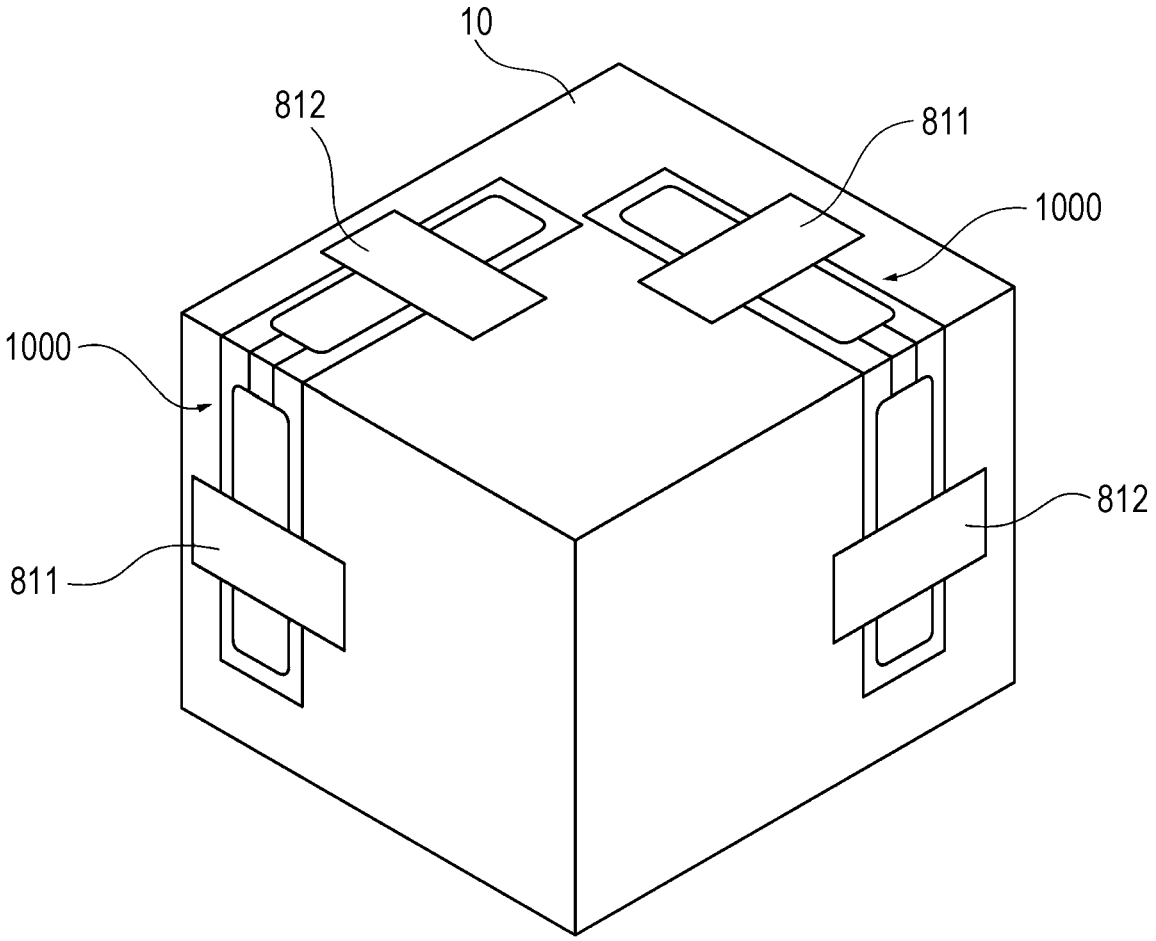
FIG. 11 is a perspective view illustrating a state in which two air cushioning materials of Comparative Example are taped to the article.

FIG. 11 is a perspective view illustrating a state in which two air cushioning materials of Comparative Example are taped to the article 10.

When the two air cushioning materials 1000 are used as in FIG. 11, the two air cushioning materials 1000 each need to be taped by the tapes 811 and 812. Thus, when the two air cushioning materials 1000 are used, taping needs to be performed at a total of four points.

Figure 12:
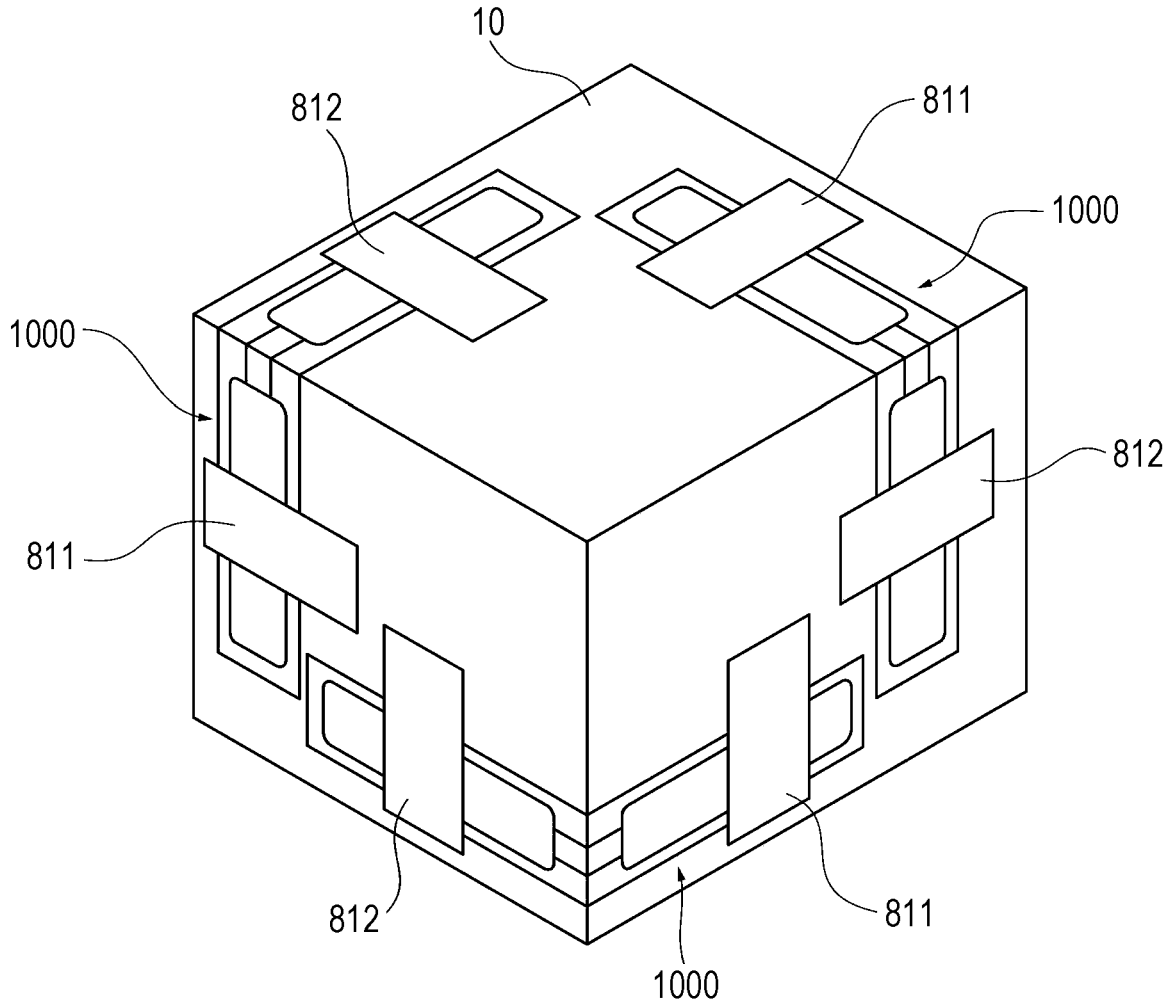
FIG. 12 is a perspective view illustrating a state in which three air cushioning materials of Comparative Example are taped to the article.

FIG. 12 is a perspective view illustrating a state in which three air cushioning materials of Comparative Example are taped to the article 10.

When the three air cushioning materials 1000 are used as in FIG. 12, the three air cushioning materials 1000 each need to be taped by the tapes 811 and 812. Thus, when the three air cushioning materials 1000 are used, taping needs to be performed at a total of six points.

As illustrated in FIGS. 11 and 12, a plurality of air cushioning materials 1000 are used to be in contact with two or more surfaces of the article 10. However, a work load for taping a plurality of points is not ignorable.

Although not elaborated in the figure, the air cushioning material 1000 including two air cells needs to be used with corrugated paper assembled to be in a shape covering three surfaces defining a corner part of the article 10 for example. However, to use such corrugated paper, pre-operations are required including: assembling the corrugated paper into a form of covering three surfaces defining the corner part of the article 10; and attaching the air cushioning material 1000 to the corrugated paper. Thus, many operations are required for using such corrugated paper. Furthermore, when using such corrugated paper, the air cushioning material 1000 and the corrugated paper needs to be separated from each other at the time of disposal, because a plastic material and a paper material need to be separated from each other for the sake of environmental protection or the like. Thus, the use of corrugated paper might involve additional work load for disposal.

The air cushioning material 100 of the present first embodiment provides the following effects.

The air cushioning material 100 of the present first embodiment can be a single piece to be in contact with the three surfaces of the article 10. This is a huge difference from the air cushioning material 1000 of Comparative Example that can only be in contact with the two surfaces of the article 10. Therefore, even when one tape is peeled, the air cushioning material 100 of the present first embodiment is not displaced or fall off, as long as a part of the surface 10*a* is attached. Even when all the tapes are peeled off, the air cushioning material 100 would be caught and held, because the first module 101 and the second module 102 overlap the upper surface 10*a* of the article 10. Therefore, the air cushioning material 100 of the present first embodiment can be maintained in position, even if all the tapes are peeled off.

As described above, the air cushioning material 100 of the present first embodiment can protect the three surfaces defining the corner part of the article 10 by a simple operation without using corrugated paper or the like, with any of the various attachment modes described above. The air cushioning material 100 of the present first embodiment uses no corrugated paper or the like, and thus can simply be disposed as a plastic material.

Further embodiments of the present invention will be described below.

Second Embodiment

Figure 13:
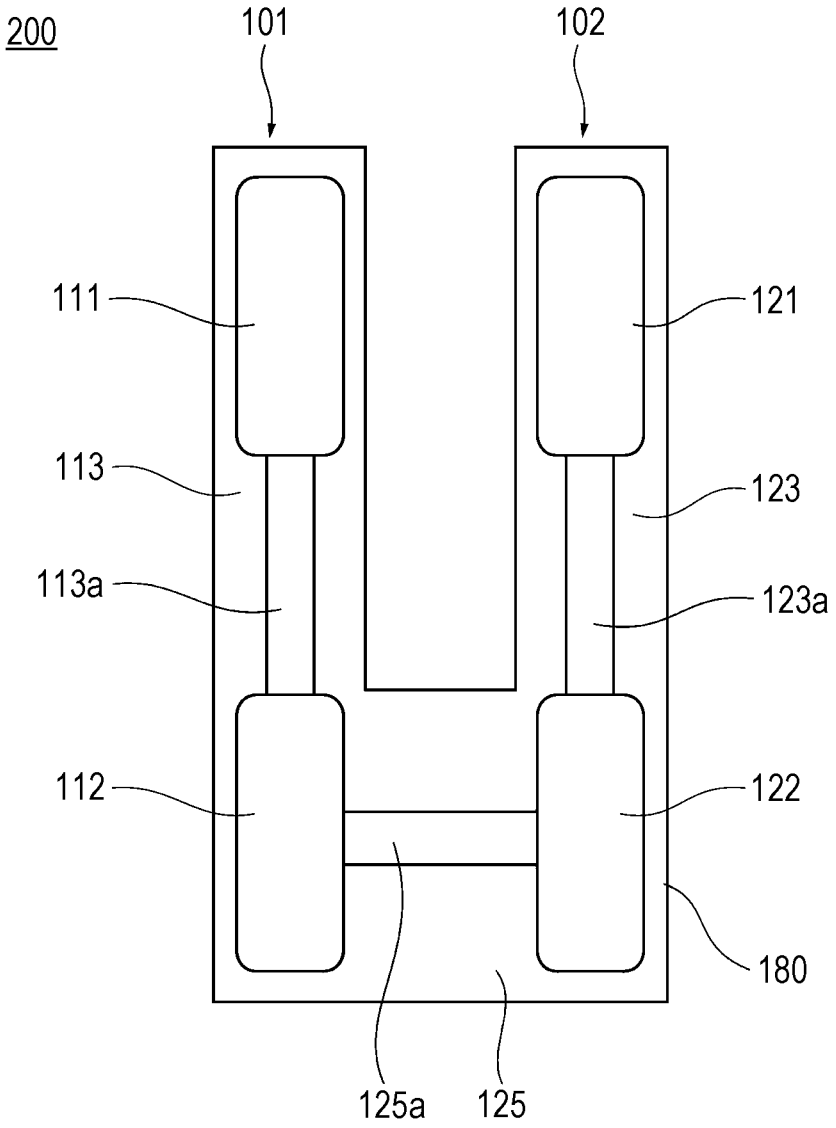
FIG. 13 is a plan view illustrating a configuration of an air cushioning material of a second embodiment.
Figure 14:
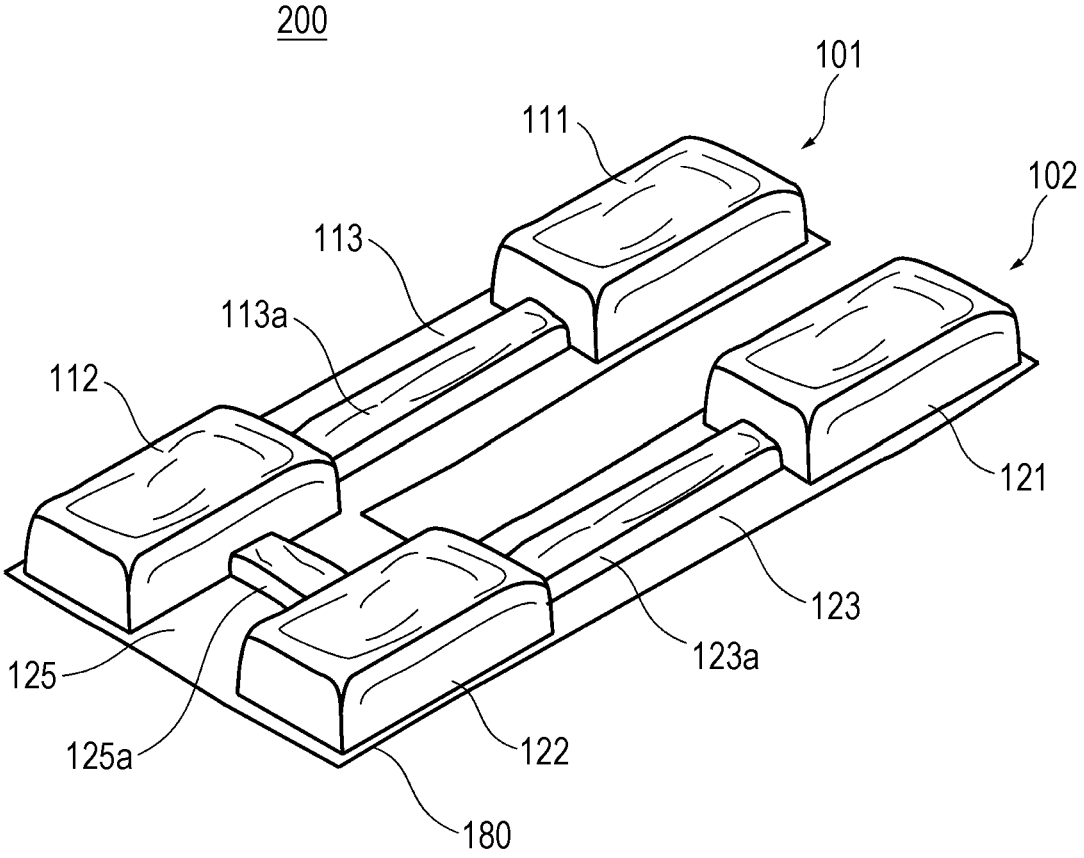
FIG. 14 is a perspective view illustrating a configuration of the air cushioning material of the second embodiment.

FIG. 13 is a plan view illustrating a configuration of an air cushioning material 200 of a second embodiment. FIG. 14 is a perspective view illustrating a configuration of the air cushioning material 200 of the second embodiment.

As illustrated in FIGS. 13 and 14, the air cushioning material 200 of the second embodiment includes an air passage 125*a* provided to the coupling part 125 coupling a part of the second air cell 112 of the first module 101 and a part of the fourth air cell 122 of the second module 102. Other configurations are the same as those in the first embodiment. The length of each part is the same as that in the first embodiment. The attachment mode of the air cushioning material 200 to the article 10 is the same as that in the first embodiment. Therefore, descriptions for these will be omitted.

The air cushioning material 200 of the present second embodiment provides the following effects.

In the air cushioning material 200 of the present second embodiment, air is circulated between the first module 101 and the second module 102 through the air passage 125*a*. Therefore, in the air cushioning material 200 of the present second embodiment, when a load is applied to any of the first to fourth air cells 111, 112, 121, and 122, the air in that air cell is released to another air cell, whereby the air cell can be prevented from rupturing.

The air cushioning material 200 of the present second embodiment provides the same effect as that provided by the first embodiment.

Third Embodiment

Figure 15:
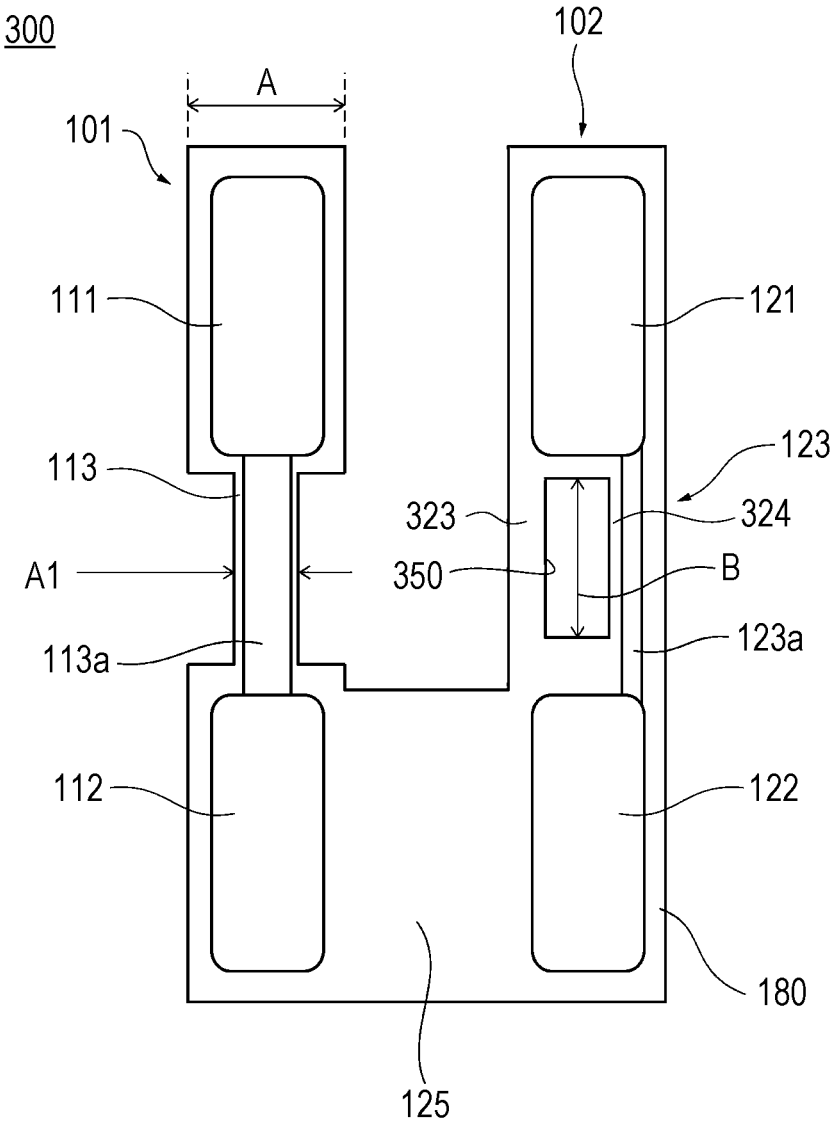
FIG. 15 is a plan view illustrating a configuration of an air cushioning material of a third embodiment.

FIG. 15 is a plan view illustrating a configuration of an air cushioning material 300 of a third embodiment.

As illustrated in FIG. 15, a length A1 of the first belt-like part 113 of the air cushioning material 300 of the third embodiment in the second direction is shorter than a length A of the first air cell 111 in the second direction. The second belt-like part 123 has a plurality of belt parts 323 and 324 in the direction connecting the third air cell 121 and the fourth air cell 122. Therefore, the second belt-like part 123 has a space 350 between the belt parts 323 and 324. A length B of the space 350 in the first direction is preferably equal to or greater than the length A of the first air cell 111 in the second direction (B≥A). Thus, in the air cushioning material 300 of the third embodiment, the first air cell 111 can pass through the space 350 formed between the plurality of belt parts 323 and 324.

Other configurations are the same as those in the first or the second embodiment. The length of each part is the same as that in the first embodiment.

Figure 16:
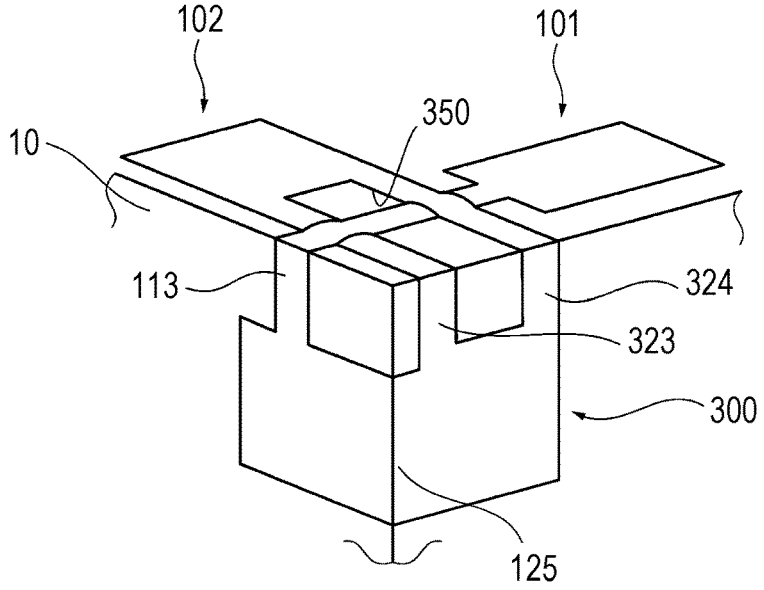
FIG. 16 is a perspective view illustrating an example of an attachment mode of the air cushioning material of the third embodiment to the article.

FIG. 16 is a perspective view illustrating an example of an attachment mode of the air cushioning material 300 of the third embodiment to the article 10.

As illustrated in FIG. 16, in the air cushioning material 300 of the third embodiment, the first air cell 111 can pass through the space 350 formed between the plurality of belt parts 323 and 324 to be held.

The air cushioning material 300 of the present third embodiment provides the following effects.

The air cushioning material 300 of the present third embodiment has the first belt-like part 113 and the belt parts 323 and 324 in a woven form. Thus, when the air cushioning material 300 of the present third embodiment is arranged on the article 10, the first module 101 over the second module 102 would not be easily lifted. Thus, the air cushioning material 300 of the present third embodiment can be maintained in a shape of being in contact with the three surfaces defining the corner part of the article 10, without being taped.

The air cushioning material 300 of the present third embodiment provides the same effect as that provided by the first embodiment.

The space 350 may have any size as long as the first air cell 111 can pass therethrough. In the present third embodiment, the shape satisfying B≥A is described to be preferable. However, the air cushioning material 300 is flexible. In view of this, the size of the space 350 may be any size as long as the first air cell 111 can pass therethrough, that is even when B≥A does not hold (that is, even if B<A holds).

Fourth Embodiment

Figure 17:
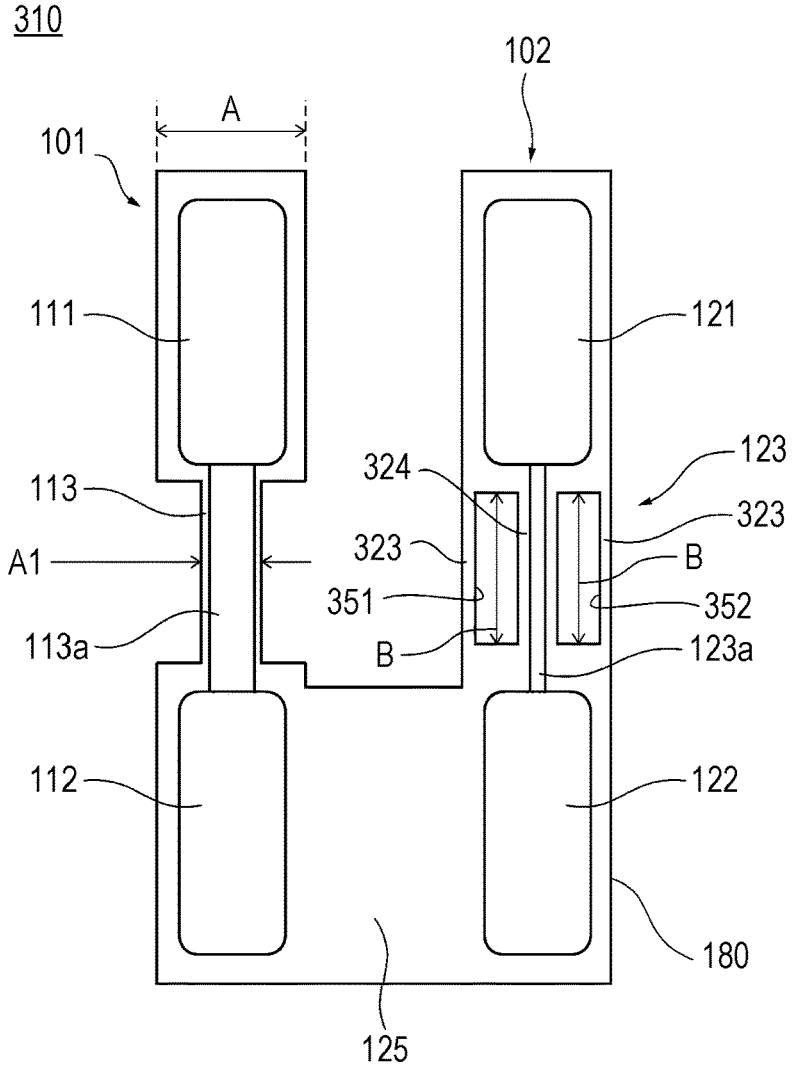
FIG. 17 is a plan view illustrating a configuration of an air cushioning material of a fourth embodiment.

FIG. 17 is a plan view illustrating a configuration of an air cushioning material 310 of a fourth embodiment.

As illustrated in FIG. 17, a length A1 of the first belt-like part 113 of the air cushioning material 310 of the fourth embodiment in the second direction is shorter than a length A of the first air cell 111 in the second direction. The second belt-like part 123 has the plurality of belt parts 323, 324, and 325 in the direction connecting the third air cell 121 and the fourth air cell 122. Therefore, the second belt-like part 123 has two spaces 351 and 352 among the belt parts 323, 324, and 325. The length B of the spaces 351 and 352 in the first direction is preferably equal to or greater than the length A of the first air cell 111 in the second direction (B≥A). Thus, in the air cushioning material 310 of the third embodiment, the first air cell 111 can pass through the spaces 351 and 352 formed between the plurality of belt parts 323, 324, and 325.

Other configurations are the same as those in the first or the second embodiment. The length of each part is the same as that in the first embodiment.

Figure 18:
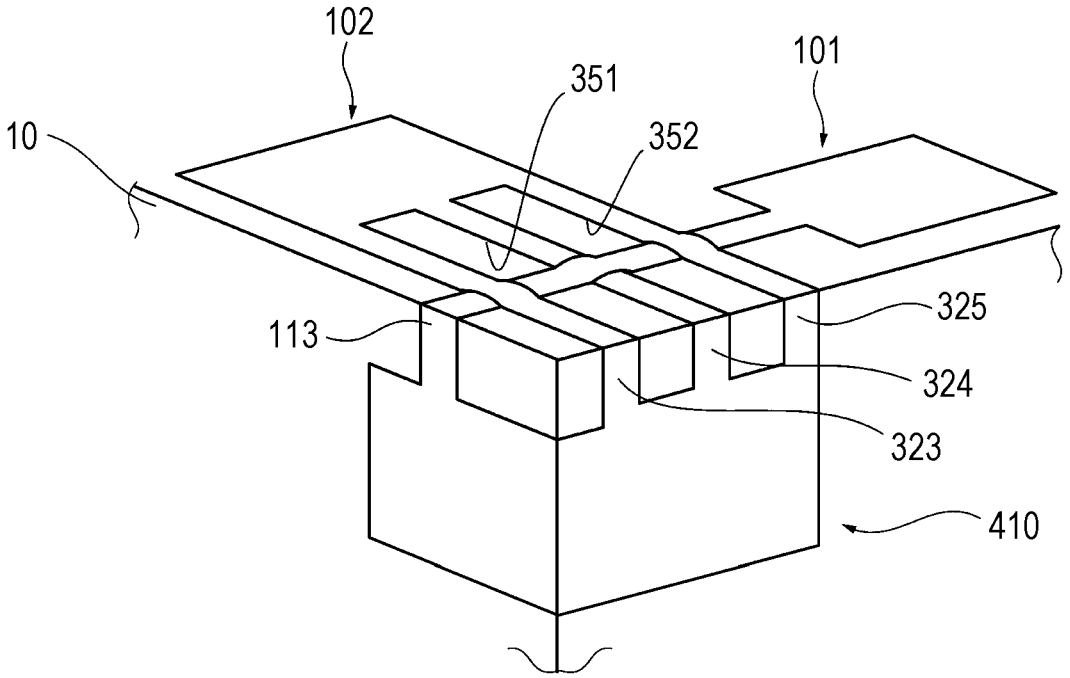
FIG. 18 is a perspective view illustrating an example of an attachment mode of the air cushioning material of the fourth embodiment to the article.

FIG. 18 is a perspective view illustrating an example of an attachment mode of the air cushioning material 310 of the fourth embodiment to the article 10.

As illustrated in FIG. 18, in the air cushioning material 310 of the fourth embodiment, the first air cell 111 can pass through the spaces 351 and 352 formed between the plurality of belt parts 323, 324, and 325 to be held.

The air cushioning material 310 of the present fourth embodiment provides the following effects.

The air cushioning material 310 of the present fourth embodiment has the first belt-like part 113 and the belt parts 323, 324, and 325 in a woven form. Thus, when the air cushioning material 310 of the present fourth embodiment is arranged on the article 10, the first module 101 over the second module 102 would not be easily lifted. In particular, the air cushioning material 310 of the present fourth embodiment has one more belt part 323 than the third embodiment described above, whereby the first module 101 and the second module 102 are firmly held. Thus, the air cushioning material 310 of the present fourth embodiment can be more reliably maintained in a shape of being in contact with the three surfaces defining the corner part of the article 10 than in the third embodiment, without being taped.

In addition, the air cushioning material 310 of the present fourth embodiment provides the same effect as that of the first embodiment.

Fifth Embodiment

Figure 19:
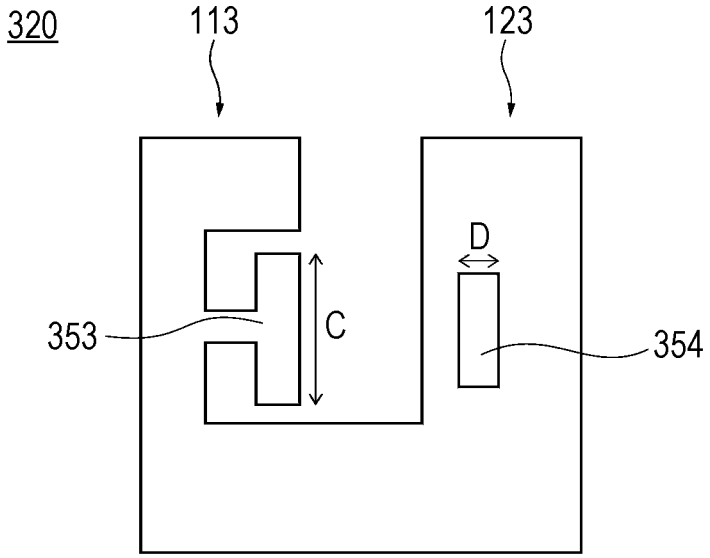
FIG. 19 is a plan view illustrating a configuration of a first belt-like part and a second belt-like part in an air cushioning material of a fifth embodiment.

FIG. 19 is a plan view illustrating a configuration of the first belt-like part 113 and the second belt-like part 123 in an air cushioning material 320 of a fifth embodiment.

As illustrated in FIG. 19, the first belt-like part 113 of the air cushioning material 320 of the fifth embodiment includes a claw part 353 that is protruding in a direction toward the second belt-like part 123 and extending in the first direction in a recess formed in the second direction. The claw second belt-like part 123 of the air cushioning material 320 of the present fifth embodiment includes a claw reception part 354 having an opening for receiving the claw part 353. An extending length C of the claw part 353 in the first direction is longer than a length D of the opening of the claw reception part 354 in the first direction (C>D). The claw reception part 354 has a certain width in a direction orthogonal to the length D, but may have a slit shape with almost no width in the direction orthogonal to the length D.

The claw part 353 provided to the first belt-like part 113 can be passed through the opening of the claw reception part 354 provided to the second belt-like part 123 to be held.

Other configurations are the same as those in the first or the second embodiment. The length of each part is the same as that in the first embodiment. The attachment mode of the air cushioning material 320 to the article 10 of the present fifth embodiment is the same as that in the fourth embodiment.

The air cushioning material 320 of the present fifth embodiment provides the following effects.

The air cushioning material 320 of the present fifth embodiment can have the first module 101 and the second module 102 held on the article 10 while being in an overlapped state due to the claw part 353 and the claw reception part 354.

Thus, when the air cushioning material 320 of the present fifth embodiment is arranged on the article 10, the first module 101 over the second module 102 would not be easily lifted. In particular, the air cushioning material 320 of the present fifth embodiment does not require the air cell to be passed between the belt parts 323 as in the third or fourth embodiment described above, whereby the first module 101 and the second module 102 can be held while being in the overlapped state.

In addition, the air cushioning material 320 of the present fifth embodiment provides the same effect as that of the first embodiment.

Sixth Embodiment

Figure 20:
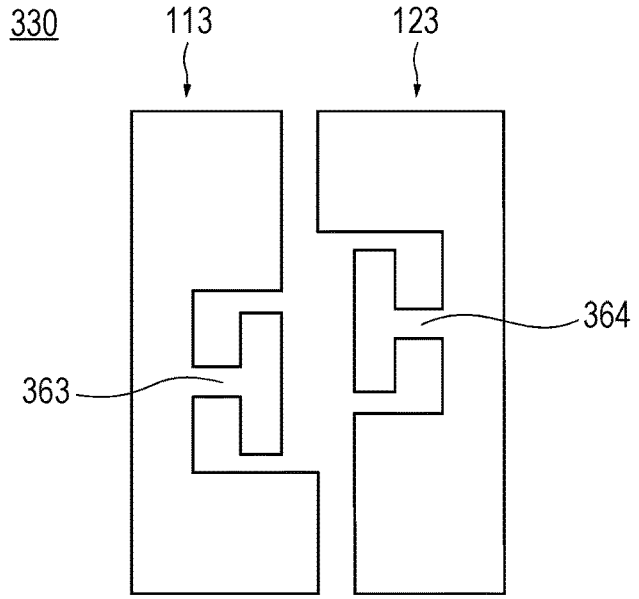
FIG. 20 is a plan view illustrating a configuration of a first belt-like part and a second belt-like part in an air cushioning material of a sixth embodiment.

FIG. 20 is a plan view illustrating a configuration of the first belt-like part 113 and the second belt-like part 123 in an air cushioning material 330 of a sixth embodiment.

As illustrated in FIG. 20, the first belt-like part 113 of the air cushioning material 330 of the sixth embodiment includes a claw part 363 that is protruding in a direction toward the second belt-like part 123 and extending in the first direction in a recess formed in the second direction. The second belt-like part 123 of the air cushioning material 320 includes a claw part 364 that is protruding in a direction toward the first belt-like part 113 and extending in the first direction in a recess formed in the second direction. As illustrated in FIG. 20, the claw parts 363 and 364 are provided so as to be offset in the first direction.

The claw part 363 provided to the first belt-like part 113 engages with the claw part 364 provided to the second belt-like part 123.

Other configurations are the same as those in the first or the second embodiment. The length of each part is the same as that in the first embodiment. The attachment mode of the air cushioning material 330 to the article 10 of the present sixth embodiment is the same as that in the fourth or the fifth embodiment.

The air cushioning material 330 of the present sixth embodiment provides the following effects.

The air cushioning material 330 of the present sixth embodiment can have the first module 101 and the second module 102 held on the article 10 while being in an overlapped state with the claw part 363 and the claw part 364 engaged with each other.

Thus, when the air cushioning material 330 of the present sixth embodiment is arranged on the article 10, the first module 101 over the second module 102 would not be easily lifted. In particular, the air cushioning material 330 of the present sixth embodiment does not require the air cell to be passed between the belt parts 323 as in the third or fourth embodiment described above, whereby the first module 101 and the second module 102 can be more easily held while being in the overlapped state.

In addition, the air cushioning material 330 of the present sixth embodiment provides the same effect as that of the first embodiment.

Seventh Embodiment

Figure 21:
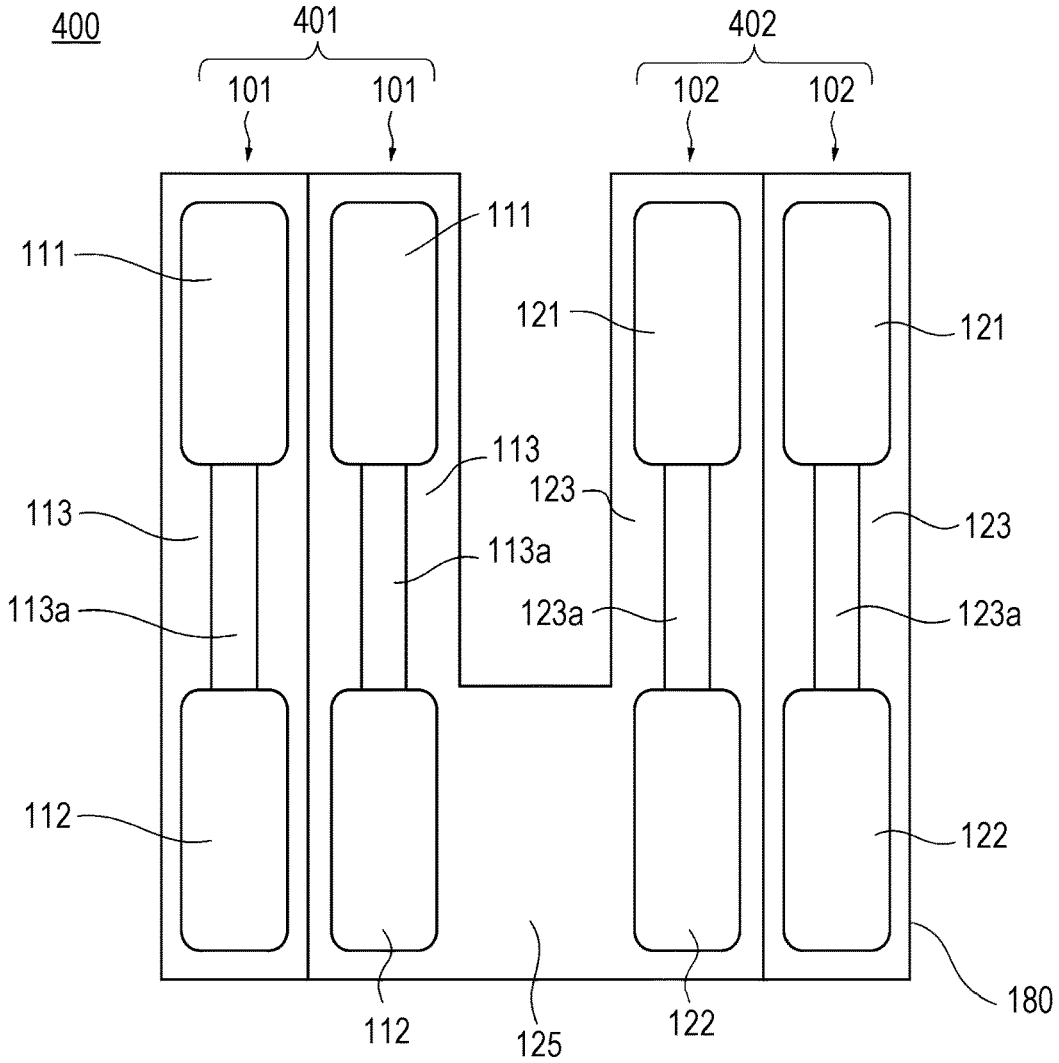
FIG. 21 is a plan view illustrating a configuration of an air cushioning material of a seventh embodiment.

FIG. 21 is a plan view illustrating a configuration of an air cushioning material 400 of a seventh embodiment.

As illustrated in FIG. 21, the air cushioning material 400 of the seventh embodiment includes a first module group 401 and a second module group 402.

The first module group 401 has two first modules 101. The second module group 402 has two second modules 102.

The first module group 401 and the second module group 402 have parts of the second air cell 112 and the fourth air cell 122, on sides adjacent to each other, coupled to each other by the coupling part 125.

The first module 101 and the second module 102 have the same shape. Thus, the air cushioning material 400 of the seventh embodiment has a total of four modules arranged in the second direction.

Other configurations are the same as those in the first or the second embodiment. The length of each part is the same as that in the first embodiment.

Figure 22:
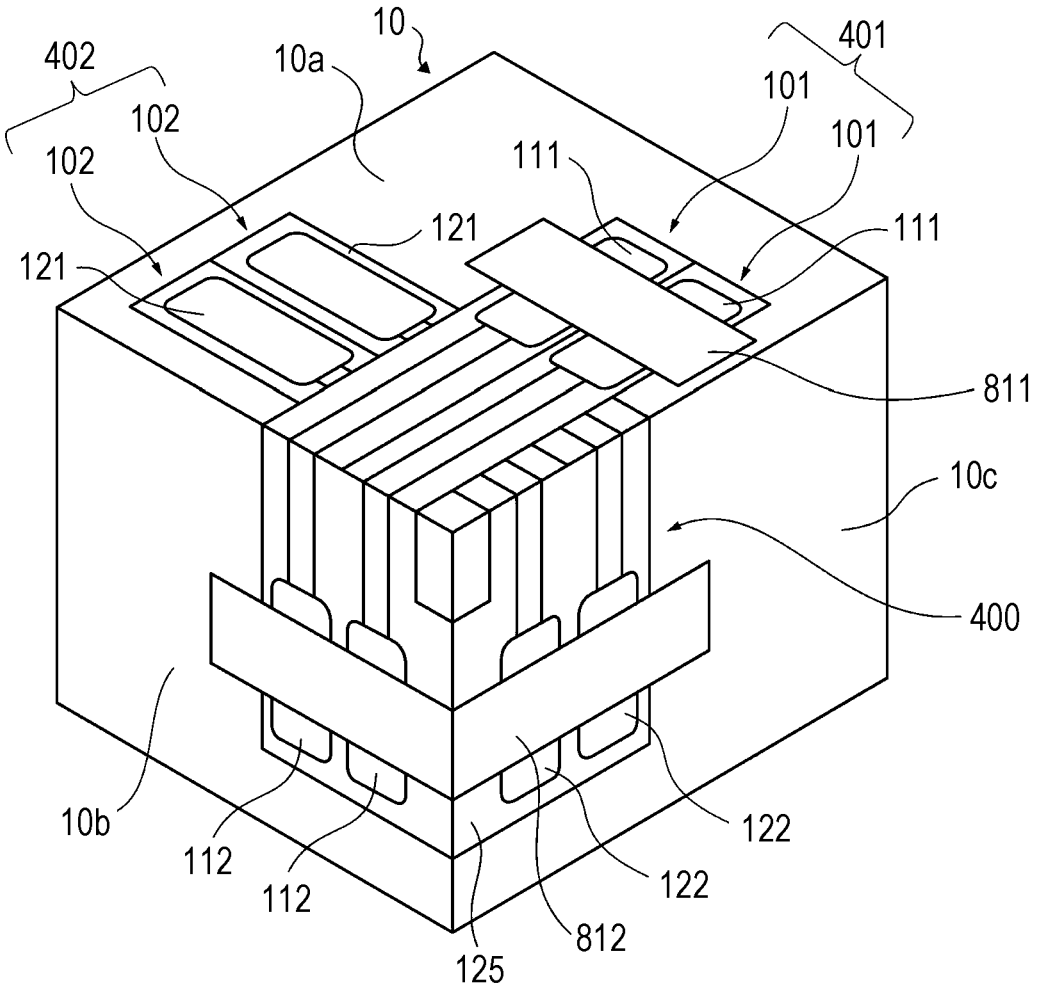
FIG. 22 is a perspective view illustrating an example of an attachment mode of the air cushioning material of the seventh embodiment to the article.

FIG. 22 is a perspective view illustrating an example of an attachment mode of the air cushioning material 400 of the seventh embodiment to the article 10. As illustrated in FIG. 22, the coupling part 125 of the air cushioning material 400 of the seventh embodiment is bent so that the two second air cells 112 and the two fourth air cells 122 come into contact with two surfaces 10*b* and 10*c* of the article 10. The second belt-like part 123 of the second module group 402 is bent so that the two third air cells 121 and a part of the second belt-like part 123 come into contact with a surface 10*a* of the article 10. The first belt-like part 113 of the first module group 401 is bent so that the two first air cells 111 and a part of the first belt-like part 113 come into contact with the surface 10*a* of the article 10 to cover a part of the second belt-like part 123.

Parts of the two first air cells 111 are attached by the tape 811. Furthermore, parts of the two second air cells 112 and the two fourth air cells 122 are attached by the tape 812, together with the coupling part 125.

The air cushioning material 400 of the present seventh embodiment provides the following effects.

The air cushioning material 400 of the present seventh embodiment has the first module group 401 and the second module group 402 respectively including two first modules 101 and two second modules 102.

Thus, the air cushioning material 400 of the present seventh embodiment can be arranged on the article 10 to cover a range wider that that in the first to the sixth embodiments.

In addition, the air cushioning material 400 of the present seventh embodiment provides the same effect as that of the first embodiment.

The attachment mode of the air cushioning material 400 of the present seventh embodiment may have one part taped, or may be used without being taped as described in the first embodiment.

Eighth Embodiment

Figure 23:
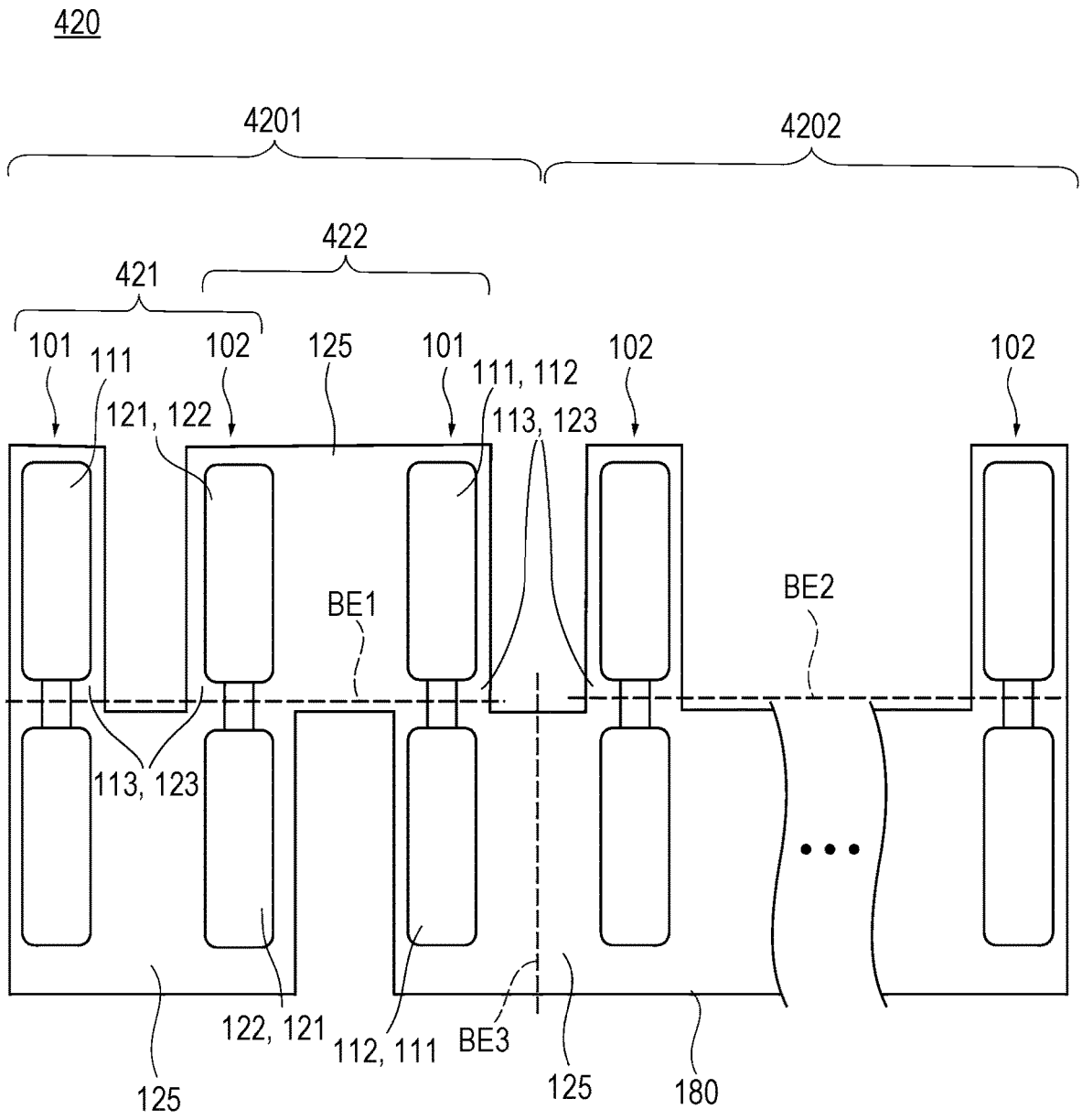
FIG. 23 is a plan view illustrating a configuration of an air cushioning material of an eighth embodiment.

FIG. 23 is a plan view illustrating a configuration of an air cushioning material 420 of an eighth embodiment.

As illustrated in FIG. 23, in the air cushioning material 420 of the eighth embodiment, the first modules 101 and the second modules 102 are alternately arranged in the second direction and are connected to each other by the coupling parts 125. The coupling parts 125 are alternately arranged with respect to the first modules 101 and the second modules 102 arranged in the second direction. Specifically, in a first set 421 defined as one set of the first module 101 and the second module 102, the coupling part 125 couples the second air cell 112 and the fourth air cell 122 to each other. In a second set 422 defined as another set of the second module 102 and the first module 101, the coupling part 125 couples the third air cell 121 and the first air cell 111 to each other. In other words, in the second set 422, the air cells on the coupling parts 125 side may be regarded as the fourth air cell 122 and the second air cell 112.

In the present eighth embodiment, for example, as illustrated in FIG. 23, the bending position BE3 is set in any one of the coupling part 125. Then, in the present eighth embodiment, the following conditions are satisfied assuming that one and the other sides of the coupling part 125 in which the bending position BE3 is set are a first module group 4201 and a second module group 4202.

The length of the coupling part 125 in the first module group 4201 is equal to or longer than the length of the second module group 4202 in the second direction. The length of the coupling part 125 in the second module group is equal to or longer than the length of the first module group 4201 in the second direction.

An attachment mode of the air cushioning material 420 to the article includes arranging parts to be at least one second air cell 112 and at least one fourth air cell 122 to be in contact with the two surfaces of the article, with any one coupling part 125 comprising the bending position BE3. The first module group 4201 and the second module group 4202 are bent to overlap with the other surface of the article, with the part serving as the first belt-like part 113 comprising the bending position BE1 and the part serving as the second belt-like part 123 comprising the bending position BE2. With this configuration, the air cushioning material 420 can be attached to cover three surfaces defining the corner part.

Any of the bending positions BE1, BE2, and BE3 illustrated in FIG. 23 is an example, and may be at other positions.

Other configurations are the same as those in the first or the second embodiment. The length of each part is the same as that in the first embodiment. Therefore, descriptions for these will be omitted.

The air cushioning material 420 of the present eighth embodiment provides the following effects.

In the air cushioning material 420 of the present eighth embodiment, the plurality of first and second modules 101 and 102 are coupled to each other by the coupling part 125, and are alternately arranged.

The air cushioning material 420 of the present eighth embodiment can be attached to the article 10 of various shapes, and cover a wide range of the article 10.

In addition, the air cushioning material 420 of the present eighth embodiment provides the same effect as that of the first embodiment.

Ninth Embodiment

Figure 24:
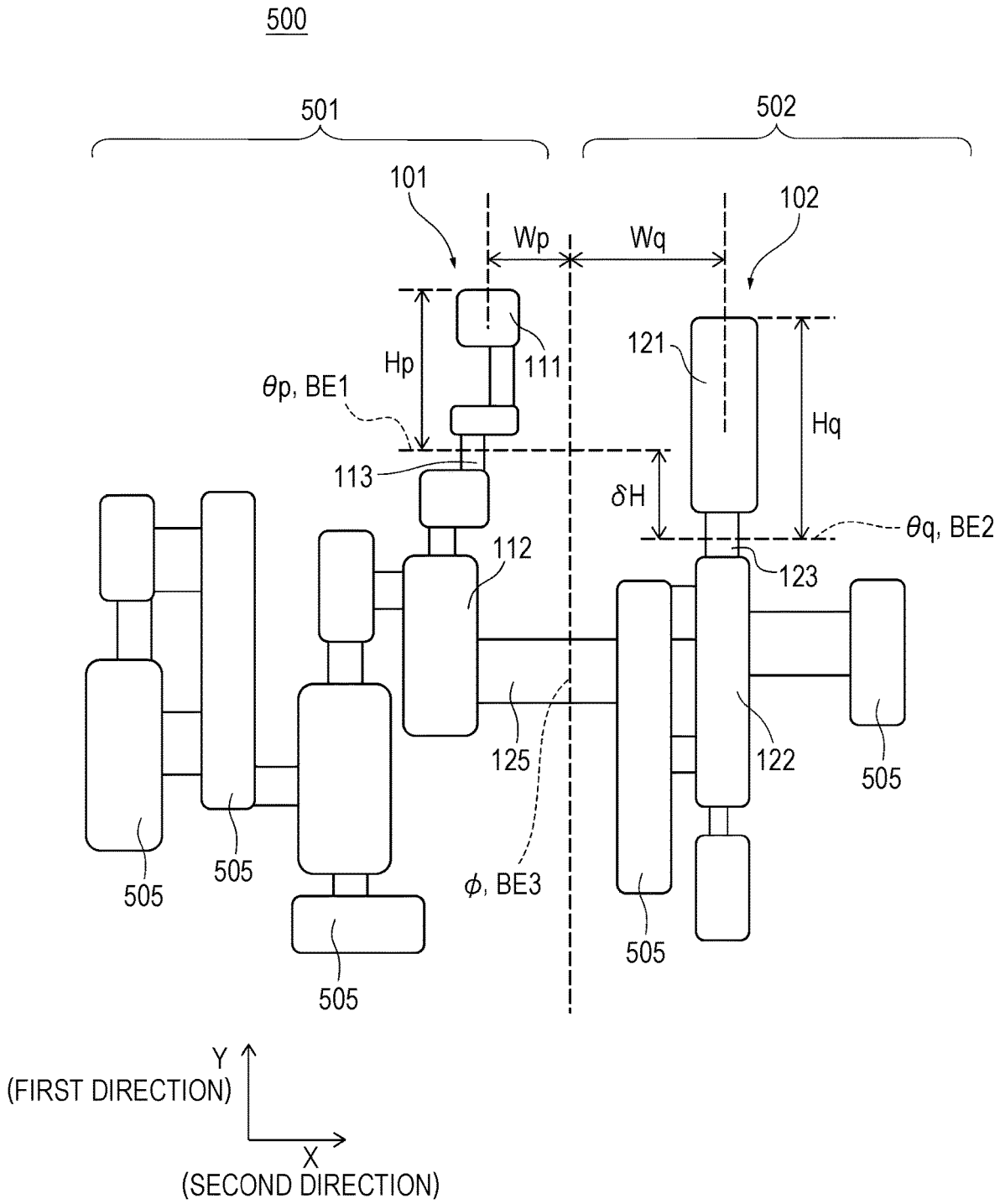
FIG. 24 is a plan view illustrating a configuration of an air cushioning material of a ninth embodiment.

FIG. 24 is a plan view illustrating a configuration of an air cushioning material 500 of a ninth embodiment.

As illustrated in FIG. 24, the air cushioning material 500 of the ninth embodiment includes a first module group 501 and a second module group 502.

The first module group 501 has at least one first module 101. The second module group 502 has at least one second module 102.

The first module 101 has at least one first air cell 111 and at least one second air cell 112. The second module 102 has at least one third air cell 121 and at least one fourth air cell 122.

The first module group 501 and the second module group 502 have parts of the second air cell 112 and the fourth air cell 122, on sides adjacent to each other, coupled to each other by the coupling part 125. An air cell 505 may be provided between a part of the second air cell 112 and the coupling part 125 and between the coupling part 125 and a part of the fourth air cell 122. Further, the first module group 501 and the second module group 502 may have a plurality of air cells 505. The plurality of air cells are connected or coupled to each other by a belt-like part or the coupling part 125.

In the present ninth embodiment, the first belt-like part 113 is between the first air cell 111 and the second air cell 112, the second belt-like part 123 is between the third air cell 121 and the fourth air cell 122, the coupling part 125 is between a part of the second air cell 112 and a part of the fourth air cell 122. The first belt-like part 113, the second belt-like part 123, and the coupling part 125 are parts other than the air cell that are bent along the corner part of the article 10, when the air cushioning material 500 is arranged on the article 10. Thus, the first belt-like part 113, the second belt-like part 123, and the coupling part 125 may be at positions different from those illustrated in FIG. 24.

In the present ninth embodiment, the following relational formula is satisfied, so that the air cushioning material 500 with the plurality of air cells connected and coupled to each other as described can be arranged to be in contact with the three surfaces of the article 10 so as not easily fall off.

$\varphi$: The maximum bendable angle of the coupling part 125.

$\theta p$: The maximum bendable angle of the first belt-like part 113.

$\theta q$: The maximum bendable angle of the second belt-like part 123.

Hp: A length from an arbitrary position of the first belt-like part 113 to a distal end of the first module group 501 in the first direction. The arbitrary position of the first belt-like part 113 is the bending position BE1 arbitrarily set on the first belt-like part 113.

Hq: A length from an arbitrary position of the second belt-like part 123 to a distal end of the second module group 502 in the first direction. The arbitrary position of the second belt-like part 123 is the bending position BE2 arbitrarily set on the second belt-like part 123.

$\delta H$: A length from the arbitrary position on the first belt-like part 113 to the arbitrary position of second belt-like part 123 in the first direction. The arbitrary position of the first belt-like part 113 is the bending position BE1 arbitrarily set on the first belt-like part 113. The arbitrary position of the second belt-like part 123 is the bending position BE2 arbitrarily set on the second belt-like part 123.

Wp: A length from an arbitrary position of the coupling part 125 to the center of the first air cell 111 in the second direction. The arbitrary position of the coupling part 125 is the bending position BE3 arbitrarily set on the coupling part 125.

Wq: A length from the arbitrary position of the coupling part 125 to the center of the third air cell 121 in the second direction.

Here, the following Formulae (1) and (2) are satisfied. The conditions of the formula define the lengths required for the first air cell 111 of the first module 101 and the third air cell 121 of the second module 102 to intersect each other.

[Formula 1]

$$H_p \geq \frac{\sqrt{W_p^2 + W_q^2 + \delta H^2 - 2W_pW_q\cos\varphi}}{\cos\theta_p + \frac{\cos\theta_q}{\sin\theta_q}\cdot\sin\theta_p} \quad (1)$$

$$H_q \geq \frac{\sqrt{W_p^2 + W_q^2 + \delta H^2 - 2W_pW_q\cos\varphi}}{\cos\theta_q + \frac{\cos\theta_p}{\sin\theta_p}\cdot\sin\theta_q} \quad (2)$$

In the present ninth embodiment, when the length of each part of the air cushioning material 500 is set to satisfy the formula, so that the first module 101 in the first module group 501 and the second module 102 in the second module group 502 can overlap when the air cushioning material 500 is arranged to be in contact with the three surfaces of the article 10.

The air cushioning material 500 of the present ninth embodiment provides the following effects.

The air cushioning material 500 of the present ninth embodiment can have the plurality of air cells combined to achieve various arrangements. Thus, the air cushioning material 500 of the present ninth embodiment can have the air cells combined in various manner in accordance with recesses and protrusions of the article 10. With the above formula satisfied, the first module 101 and the second module 102 can overlap as in the first embodiment, so that a risk of displacement or falling off due to vibrations during transportation can be reduced.

In addition, the air cushioning material 500 of the present ninth embodiment provides the same effect as that of the first embodiment.

10th Embodiment

Figure 25:
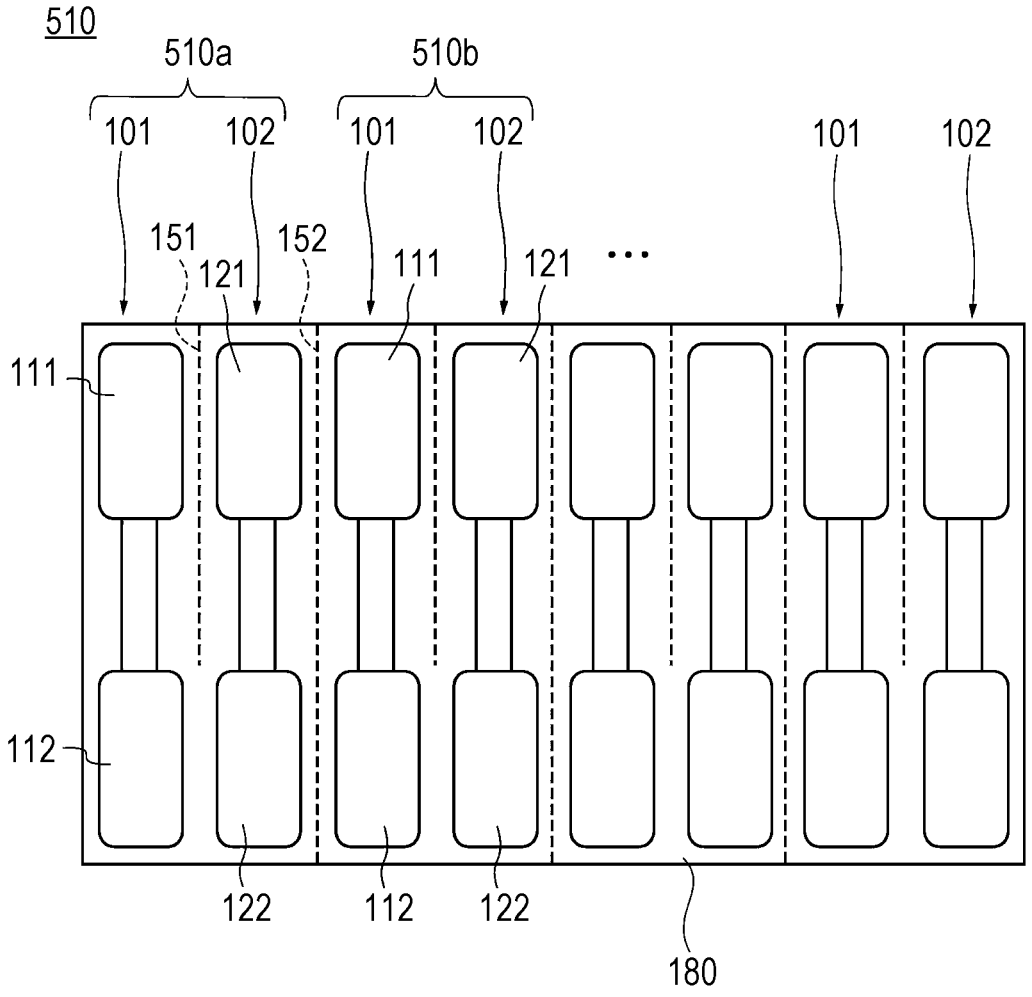
FIG. 25 is a plan view illustrating a configuration of an air cushioning material of a 10th embodiment.

FIG. 25 is a plan view illustrating the configuration of an air cushioning material 510 of a 10th embodiment.

As illustrated in FIG. 25, the air cushioning material 510 of the 10th embodiment includes the first modules 101 and the second modules 102 alternately arranged in series.

The air cushioning material 510 has a first perforated line 151 and a second perforated line 152 in the first direction.

In the present 10th embodiment, a plurality of sets are provided such as a first set 510*a*, a second set 510*b*, a third set 510*c*, and so on, with each set including the first module 101 and the second module 102. The sets are in the same form.

The first perforated line 151 is provided between the first module 101 and the second module 102 of the first set 510*a*, and only between the first air cell 111 and the third air cell 121. Thus, the first perforated line 151 does not reach a part between the second air cell 112 and the fourth air cell 122. The first perforated line 151 is a separable coupling part.

On the other hand, the second perforated line 152 is provided over the entire length of the second module 102 and the first module 101 between the sets such as between the first set 510*a* and the second set 510*b* and between the second set 510*b* and the third set 510*c*.

Therefore, in the air cushioning material 510, the first perforated lines 151 and the second perforated lines 152 are alternately provided in the direction in which the modules are arranged in series.

In the air cushioning material 510, separation between the first air cell 111 and the third air cell 121 along the first perforated line 151 is possible. However, separation between the second air cell 112 and the fourth air cell 122 is not possible due to the lack of perforated line therebetween.

In the air cushioning material 510, at least one of the first module 101 and the second module 102 can be separated from another module, at a part between the second module 102 and the first module 101, along the second perforated line 152.

Other configurations are the same as those in the first or the second embodiment. The length of each part is the same as that in the first embodiment.

Figure 26A:
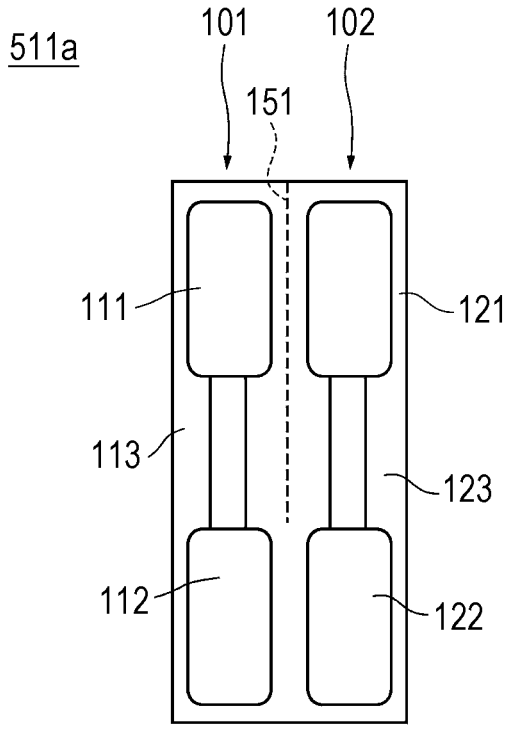
FIGS. 26A and 26B are plan views illustrating how the air cushioning material of the 10th embodiment is used.
Figure 26B:
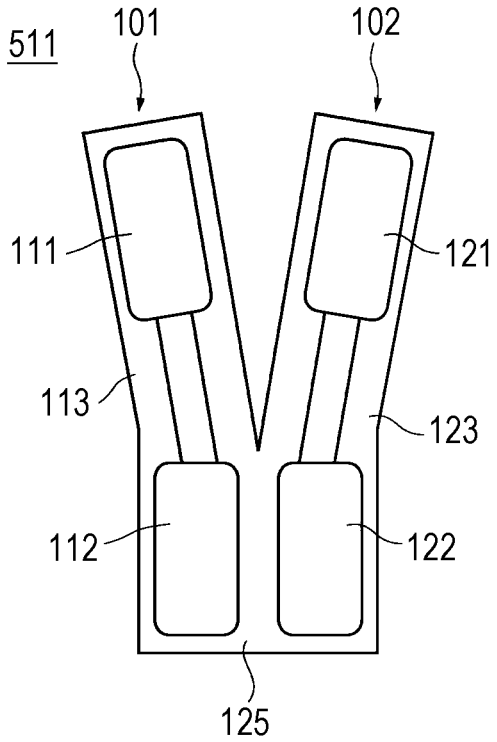

FIGS. 26A and 26B are plan views illustrating how the air cushioning material 510 of the 10th embodiment is used.

As illustrated in FIG. 26A, the air cushioning material 510 of the 10th embodiment is first formed to be an intermediate object 511*a* including one first module 101 and one second module 102 through separation along the second perforated line 152.

Then, as illustrated in FIG. 26B, the intermediate object 511*a* is formed to be an air cushioning material 511 through separation between parts of the first air cell 111 and the third air cell 121 along the first perforated line 151. The parts of the second air cell 112 and the fourth air cell 122 that are not separated from each other serve as the coupling part 125.

Figure 27:
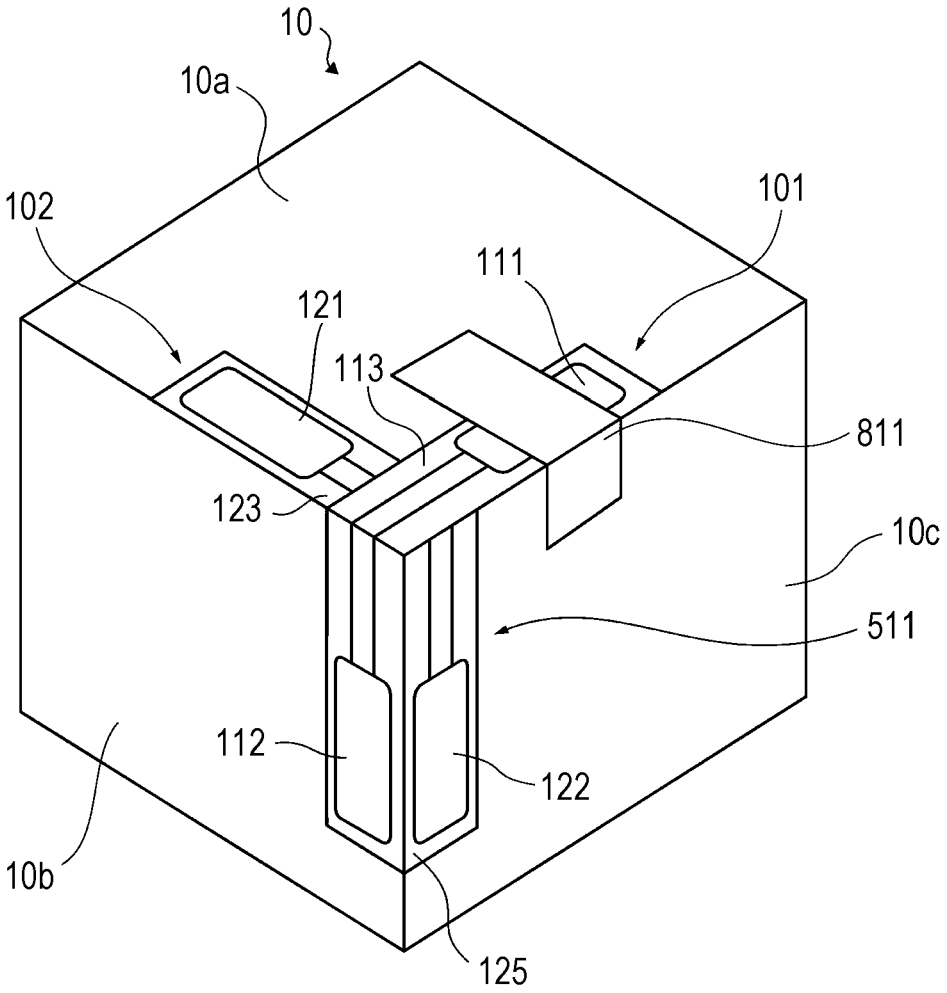
FIG. 27 is a perspective view illustrating an example of an attachment mode of the air cushioning material of the 10th embodiment to the article.

FIG. 27 is a perspective view illustrating an example of an attachment mode of the air cushioning material 510 of the 10th embodiment to the article 10. As illustrated in FIG. 27, the coupling part 125 of the air cushioning material 510 is bent so that the second air cell 112 and the fourth air cell 122 come into contact with two surfaces 10*b* and 10*c* of the article 10. The second belt-like part 123 of the second module 102 is bent so that the third air cell 121 and a part of the second belt-like part 123 come into contact with a surface 10*a* of the article 10. The first belt-like part 113 of the first module 101 is bent so that the first air cell 111 and a part of the first belt-like part 113 come into contact with the surface 10*a* of the article 10 to cover a part of the second belt-like part 123. The part of the first air cell 111 is attached by the tape 811.

The air cushioning material 510 of the present 10th embodiment provides the following effects.

The air cushioning material 510 of the present 10th embodiment includes a plurality of first modules 101 and second modules 102 alternately arranged. The air cushioning material 510 can be used as in and provides the same effect as the first embodiment, simply through separation along the perforated line.

Thus, the air cushioning material 510 of the present 10th embodiment can be simultaneously provided as a plurality of air cushioning materials 510.

In addition, the air cushioning material 510 of the present 10th embodiment provides the same effect as that of the first embodiment.

11th Embodiment

Figure 28:
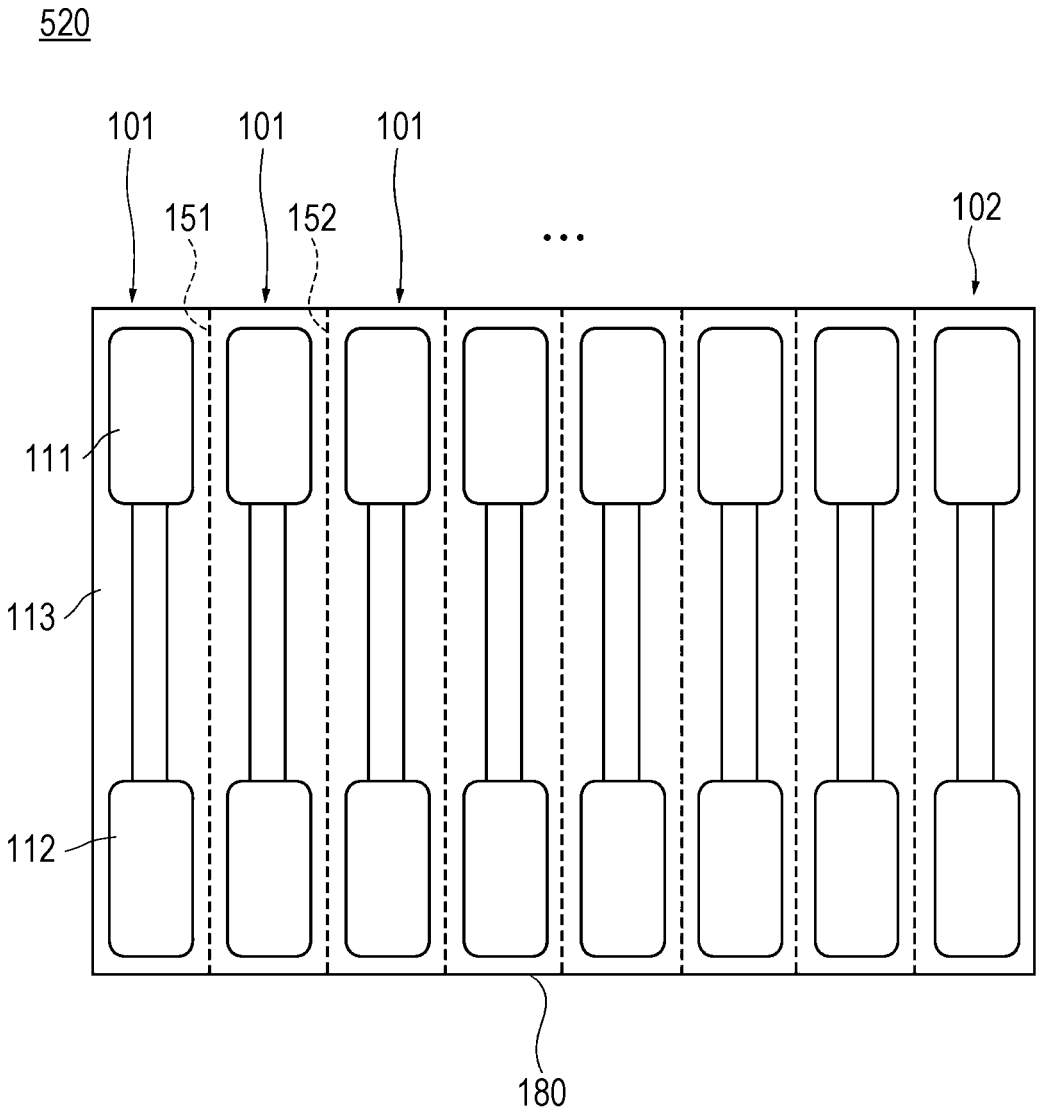
FIG. 28 is a plan view illustrating a configuration of an air cushioning material of an 11th embodiment.

FIG. 28 is a plan view illustrating the configuration of an air cushioning material 520 of an 11th embodiment.

As illustrated in FIG. 28, the air cushioning material 520 of the 11th embodiment has a plurality of first modules 101. The air cushioning material 520 of the 11th embodiment may be a plurality of second modules 102.

The second perforated line 152 is provided between each adjacent ones of the plurality of first modules 101. The second perforated line 152 is provided over the entire length between each adjacent ones of the plurality of first modules 101.

The air cushioning material 520 can be separated into two or more first modules 101 and the remaining first module(s) 101 along the second perforated line 152.

Other configurations are the same as those in the first or the second embodiment. The length of each part is the same as that in the first embodiment.

Figure 29A:
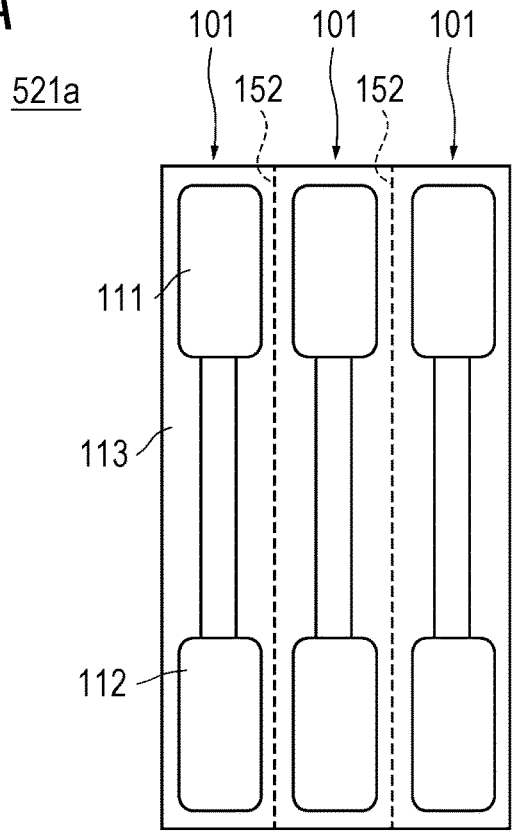
FIGS. 29A and 29B are plan views illustrating how the air cushioning material of the 11th embodiment is used.
Figure 29B:
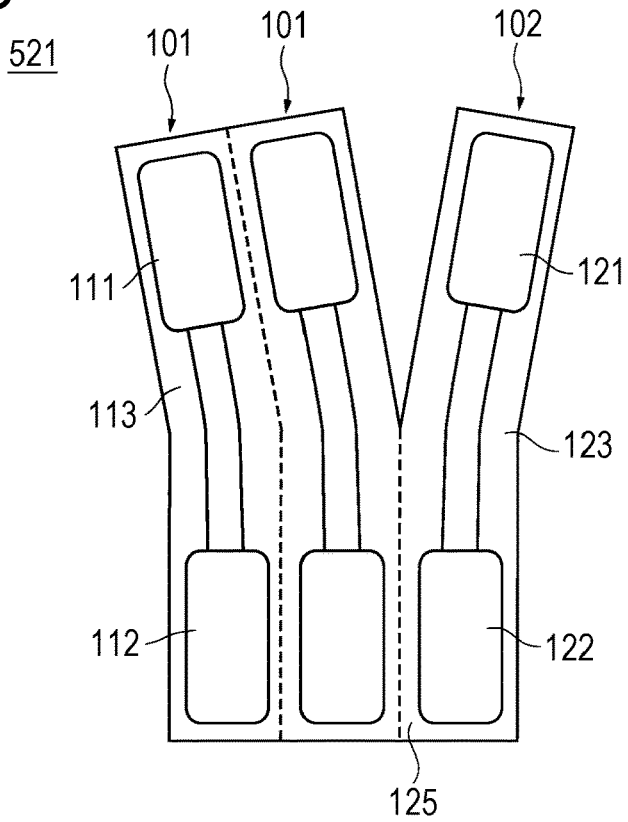

FIGS. 29A and 29B are plan view illustrating how the air cushioning material 520 of the 11th embodiment is used.

As illustrated in FIG. 29A, the air cushioning material 520 of the 11th embodiment is first formed to be an intermediate object 521*a* with three first modules 101 arranged in series through separation along the second perforated line 152.

Then, the intermediate object 521*a* has the first air cell 111 and the adjacent first air cell 111 separated from each other along the second perforated line 152. As a result, as illustrated in FIG. 29B, the intermediate object 521*a* becomes the air cushioning material 521 including two first modules 101 and one second module 102. The second perforated line 152 along which the first air cell 111 and the adjacent first air cell 111 are separated from each other serves as a separable coupling part.

In the air cushioning material 521, the part of the second air cell 112 and the fourth air cell 122 remaining without being separated along the second perforated line 152 serves as the coupling part 125.

Figure 30:
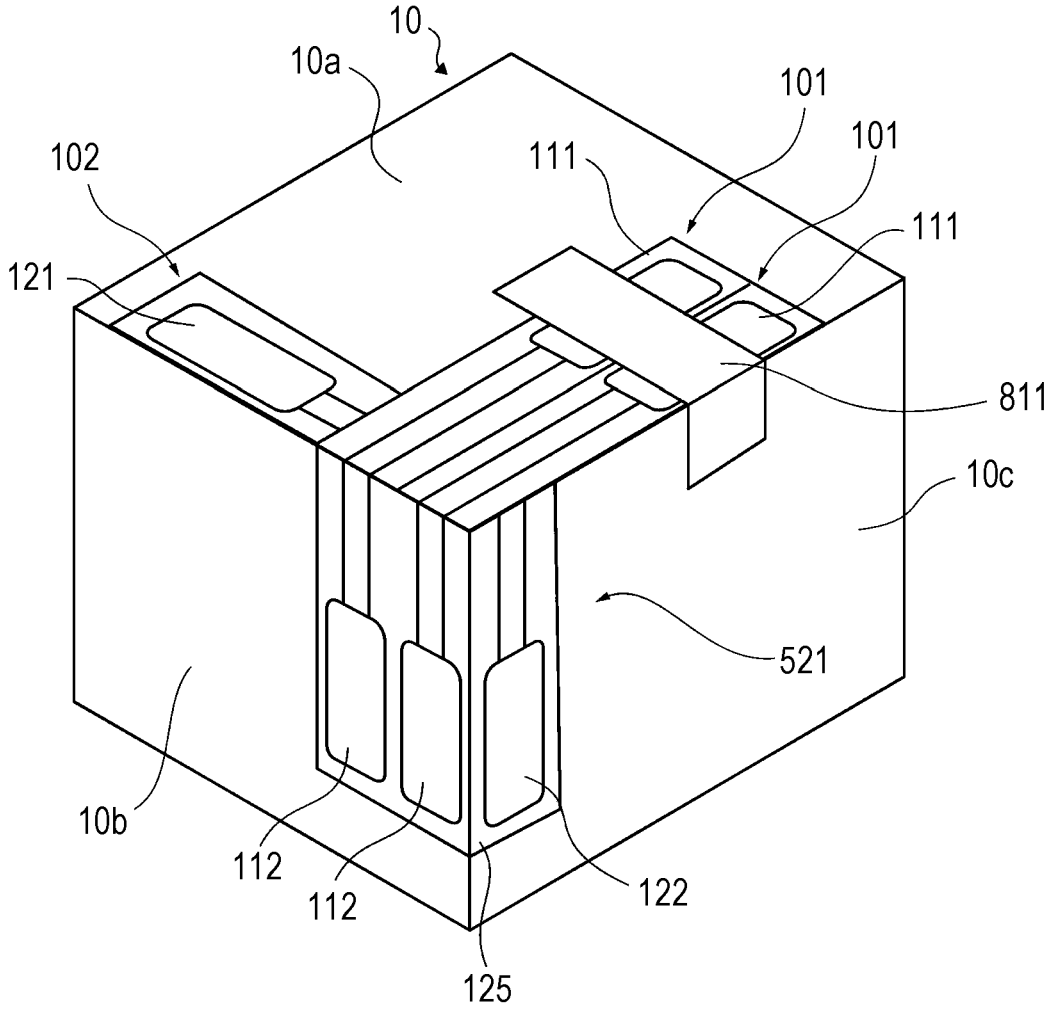
FIG. 30 is a perspective view illustrating an example of an attachment mode of the air cushioning material of the 11th embodiment to the article.

FIG. 30 is a perspective view illustrating an example of an attachment mode of the air cushioning material 520 of the 11th embodiment to the article 10. As illustrated in FIG. 30, the coupling part 125 of the air cushioning material 520 is bent so that the second air cell 112 and the fourth air cell 122 come into contact with two surfaces 10*b* and 10*c* of the article 10. The second belt-like part 123 of the second module 102 is bent so that the third air cell 121 and a part of the second belt-like part 123 come into contact with a surface 10*a* of the article 10. The first belt-like part 113 of the first module 101 is bent so that the first air cell 111 and a part of the first belt-like part 113 come into contact with the surface 10*a* of the article 10 to cover a part of the second belt-like part 123. The part of the first air cell 111 is attached by the tape 811.

The air cushioning material 520 of the present 11th embodiment provides the following effects.

The air cushioning material 520 of the present 11th embodiment is provided in a form in which a plurality of first modules 101 are provided in series. The air cushioning material 520 can be used as the first module 101 and the second module 102 simply through separation along the perforated line in and provides the same effect as the first embodiment.

Thus, the air cushioning material 520 of the present 11th embodiment can be simultaneously provided as a plurality of air cushioning materials 520.

In addition, the air cushioning material 520 of the present 11th embodiment provides the same effect as that of the first embodiment.

The air cushioning material 520 described with reference to the example illustrated in FIGS. 29A and 29B is separated along the second perforated line 152 to be in the intermediate object 521*a* with three first modules 101 arranged in series. Note that the number of first modules 101 after the separations may be any number as long as two or more first modules 101 are arranged in series. The air cushioning material 520 of the present 11th embodiment can have the separated position arbitrarily changed. Thus, the air cushioning material 520 of the present 11th embodiment enables the number of first modules 101 and the second modules 102 to be freely set. Thus, the air cushioning material 520 of the present 11th embodiment may be used with first implementing separation to obtain a larger number of first modules 101 arranged in series, when strength or impact resistance is required for example.

12th Embodiment

Figure 31:
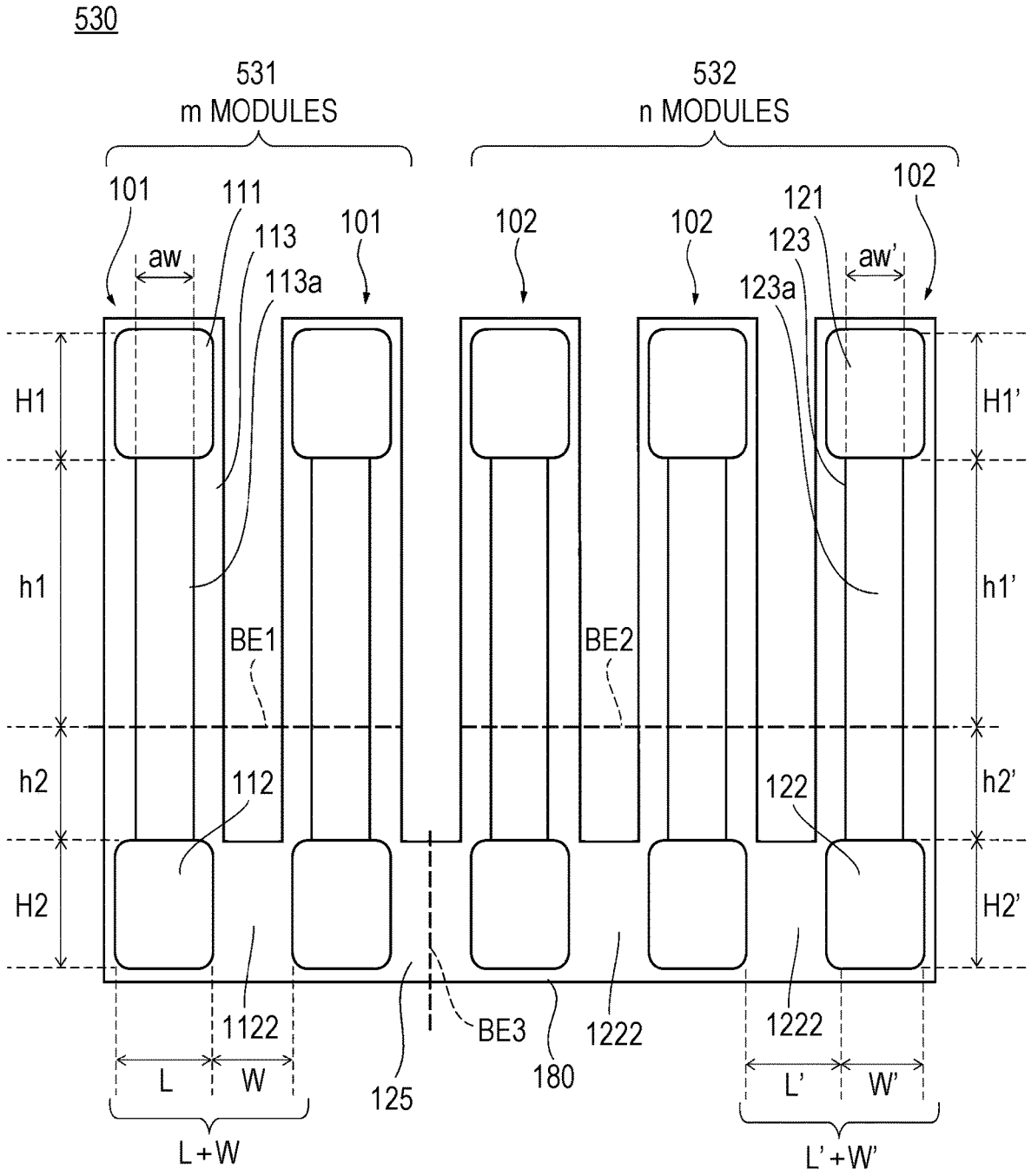
FIG. 31 is a plan view illustrating a configuration of an air cushioning material of a 12th embodiment.

FIG. 31 is a plan view illustrating the configuration of an air cushioning material 530 of a 12th embodiment.

As illustrated in FIG. 31, the air cushioning material 530 of the 12th embodiment includes a first module group 531 and a second module group 532.

The first module group 531 includes m first modules 101 (m is a natural number). In the present 12th embodiment, m=2. Parts of the second air cells 112 of the adjacent first modules 101 are coupled to each other in the second direction by an air cell coupling part 1122.

The second module group 532 includes n second modules 102 (n is a natural number). In the present 12th embodiment, n=3. Parts of the fourth air cells 122 of the adjacent second modules 102 are coupled to each other in the second direction by an air cell coupling part 1222.

The first module 101 positioned at an end on the second module group 532 side in the first module group 531 and the second module 102 positioned at an end on the first module group 531 side in the second module group 532 are coupled to each other in the second direction by the coupling part 125.

In the present 12th embodiment, parts of the air cushioning material 530 are defined as follows.

Parts of the first module 101 are the same as those in the first embodiment.

H1: A length of the first air cell 111 in the first direction. H1 is of any length.

h1: A length from the bending position BE1 to the end of the first air cell 111 on the bending position side.

h2: A length from the bending position BE1 to the end of the second air cell 112 on the bending position side. h2 is of any length.

H2: A length of the second air cell 112 in the first direction. H2 is of any length.

aw: A length of the air passage 113*a* in the second direction.

L: A length of the first air cell 111 in the second direction. L is of any length.

W: A length of the coupling part 125 in the second direction (from the end of one second air cell 112 to the end of the adjacent second air cell 112). W is of any length (W≥0 (the same applies hereinafter)).

On the other hand, each part of the second module 102 corresponds to each part of the first module 101, and is defined as follows.

H1': A length of the third air cell 121 in the first direction. H1' is of any length.

h1': A length from the bending position BE2 to the end of the third air cell 121 on the bending position side.

h2': A length from the bending position BE2 to the end of the fourth air cell 122 on the bending position side. h2' is of any length.

H2': A length of the fourth air cell 122 in the first direction. H2' is of any length.

aw': A length of the air passage 123*a* in the second direction.

L': A length of the fourth air cell 122 in the second direction. L' is of any length.

W': A length of the coupling part 125 in the second direction (from the end of one fourth air cell 122 to the end of the adjacent fourth air cell 122). W' is of any length (W≥0 (the same applies hereinafter)).

The length of each part of the first module 101 and the length of each part of the second module 102 may be the same or different from each other. The thickness of each part, which is not illustrated, is basically the same as that in the first embodiment. The thickness of each part of the first module 101 and the thickness of each part of the second module 102 may be the same or different from each other.

In the air cushioning material 530 of the 12th embodiment, a length (h1+h2) of the first belt-like part 113 in the first direction is n times longer or more than a length L' of the third air cell 121 in the second module 102 in the second direction.

Further, a length (h1'+h2') of the second belt-like part 123 in the first direction is m times longer or more than the length L of the first air cell 111 in the first module 101 in the second direction.

Such lengths of the parts may be separately set depending on the numbers of m and n.

When m≥n holds, if parts of the second module group 532 and corresponding respective parts of the first module group 531 are the same, the length (h1+h2) of the first belt-like part 113 and the second belt-like part 123 in the first module 101 in the first direction is equal to or longer than a sum of a length that is n times longer than the length L' of the third air cell 121 in the second module 102 in the second direction and a length that is (n−1) times longer than the length W' of the coupling part 125 in the second direction. In the example illustrated in FIG. 31, (h1+h2)=(h1'+h2') and (h1+h2)≥L×n+W×(n−1) hold.

On the other hand, when m<n holds, if parts of the second module group 532 and corresponding respective parts of the first module group 531 are the same, the length (h1+h2) of the first belt-like part 113 and the second belt-like part 123 in the second module 102 in the first direction is equal to or longer than a sum of a length that is m times longer than the length L of the first air cell 111 in the first module 101 in the second direction and a length that is (m−1) times longer than the length W of the coupling part in the second direction.

Other configurations are the same as those in the first or the second embodiment.

Figure 32:
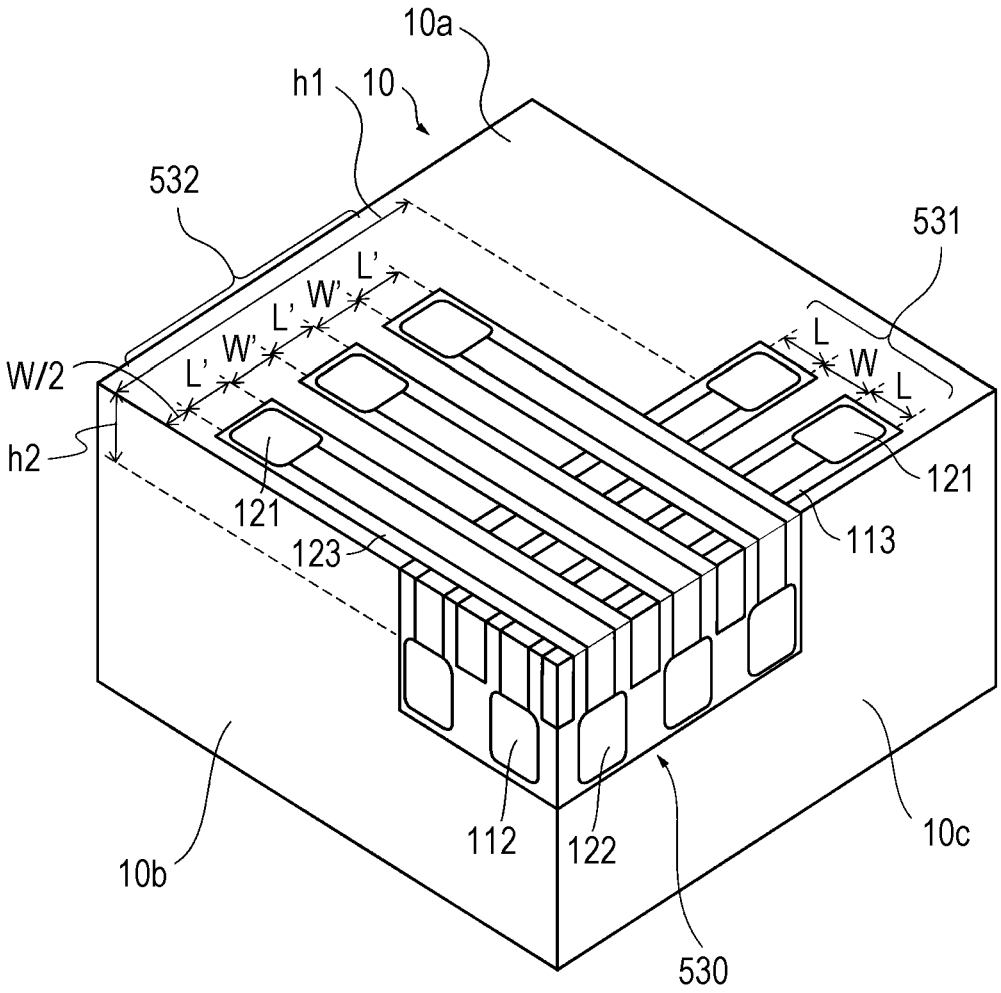
FIG. 32 is a perspective view illustrating an example of an attachment mode of the air cushioning material of the 12th embodiment to the article.

FIG. 32 is a perspective view illustrating an example of an attachment mode of the air cushioning material 530 of the 12th embodiment to the article 10. As illustrated in FIG. 32, the coupling part 125 of the air cushioning material 530 is bent so that a plurality of second air cells 112 and fourth air cells 122 come into contact with two surfaces 10*b* and 10*c* of the article 10. The first belt-like part 113 of the first module group 531 is bent so that a plurality of first air cells 111 and a part of the first belt-like parts 113 are in contact with the surface 10*a* of the article 10. The second belt-like part 123 of the second module group 532 is bent so that a plurality of third air cells 121 and a part of the second belt-like parts 123 are in contact with the surface 10*a* of the article 10 while covering the first belt-like parts 113 of the first module group 531.

When such an attachment mode is used, with the parts set to have the lengths described above, the air cushioning material 530 of the 12th embodiment can protect the three surfaces defining the corner part of the article 10, without easily being lifted as in the first embodiment.

Although not illustrated, the air cushioning material 530 may be taped, for example.

The air cushioning material 530 of the present 12th embodiment provides the following effects.

The air cushioning material 530 of the present 12th embodiment includes a plurality of first modules 101 and a plurality of second modules, and thus can cover a wide range of the article 10. Thus, the air cushioning material 530 of the present 12th embodiment can reduce an impact on the article 10 packed. The air cushioning material 530 of the present 12th embodiment can widely cover the three surfaces of the article 10 at once, and thus is effective for protecting each surface of the article 10.

In addition, the air cushioning material 530 of the present 12th embodiment provides the same effect as that of the first embodiment.

In the air cushioning material 530 of the present 12th embodiment, the numbers m and n are determined in advance. That is, the position of the coupling part 125 that connects the first module group 531 and the second module group 532 to each other is determined in advance.

13th Embodiment

Figure 33:
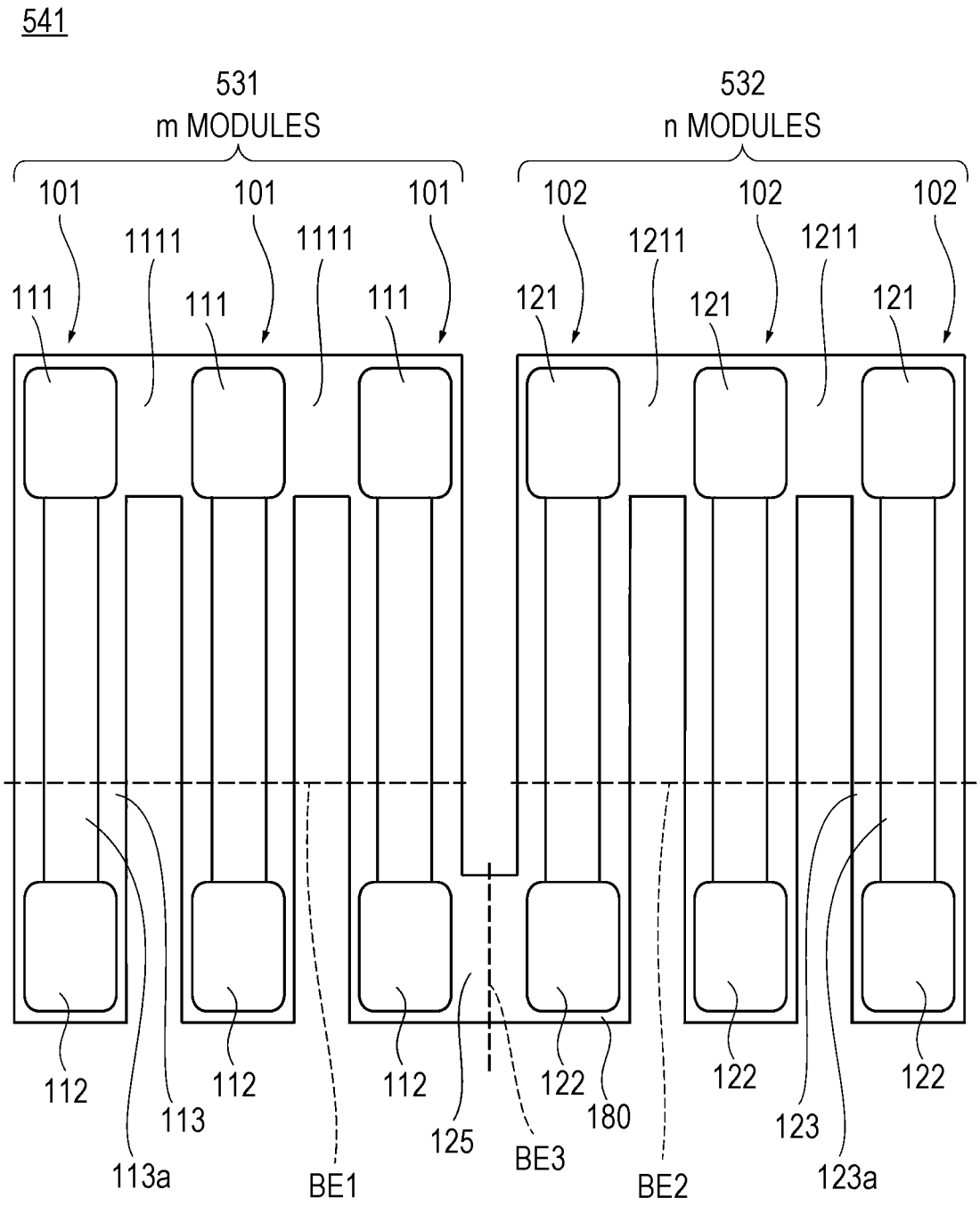
FIG. 33 is a plan view illustrating a configuration of an air cushioning material of a 13th embodiment.

FIG. 33 is a plan view illustrating the configuration of an air cushioning material 541 of a 13th embodiment.

As illustrated in FIG. 33, the air cushioning material 541 of the 13th embodiment includes the first module group 531 and the second module group 532.

The first module group 531 includes m first modules 101 (m is a natural number). In the present 13th embodiment, m=3. Parts of the first air cells 111 of the adjacent first modules 101 are coupled to each other in the second direction by an air cell coupling part 1111.

The second module group 532 includes n second modules 102 (n is a natural number). In the present 13th embodiment, n=3. Parts of the third air cells 121 of the adjacent second modules 102 are coupled to each other in the second direction by an air cell coupling part 1211.

The first module 101 positioned at an end on the second module group 532 side in the first module group 531 and the second module 102 positioned at an end on the first module group 531 side in the second module group 532 are coupled to each other in the second direction by the coupling part 125.

Thus, the present 13th embodiment is different from the 12th embodiment in the parts in the first module group 531 and the second module group 532 coupling the air cells to each other. The configuration of other parts is the same as that in the 12th embodiment. The attachment mode is the same as that in the 12th embodiment.

Thus, the air cushioning material 541 of the present 13th embodiment provides the same effects as the 12th embodiment.

The numbers m and n, that is, the numbers of the first modules 101 and the second modules 102 to be connected may be any number as in the 12th embodiment, and thus are not limited to three. The same applies to the numbers m and n in other embodiments described below.

Also in the air cushioning material 541 of the present 13th embodiment, an air passage may be provided in air cell coupling parts 1111 and 1211 and air cell coupling parts 1122, 1211, and 1222 described later coupling the air cells to each other, as in the air passage 125*a* of the coupling part described in the second embodiment. The same applies to the air passage in other embodiments described below.

14th Embodiment

Figure 34:
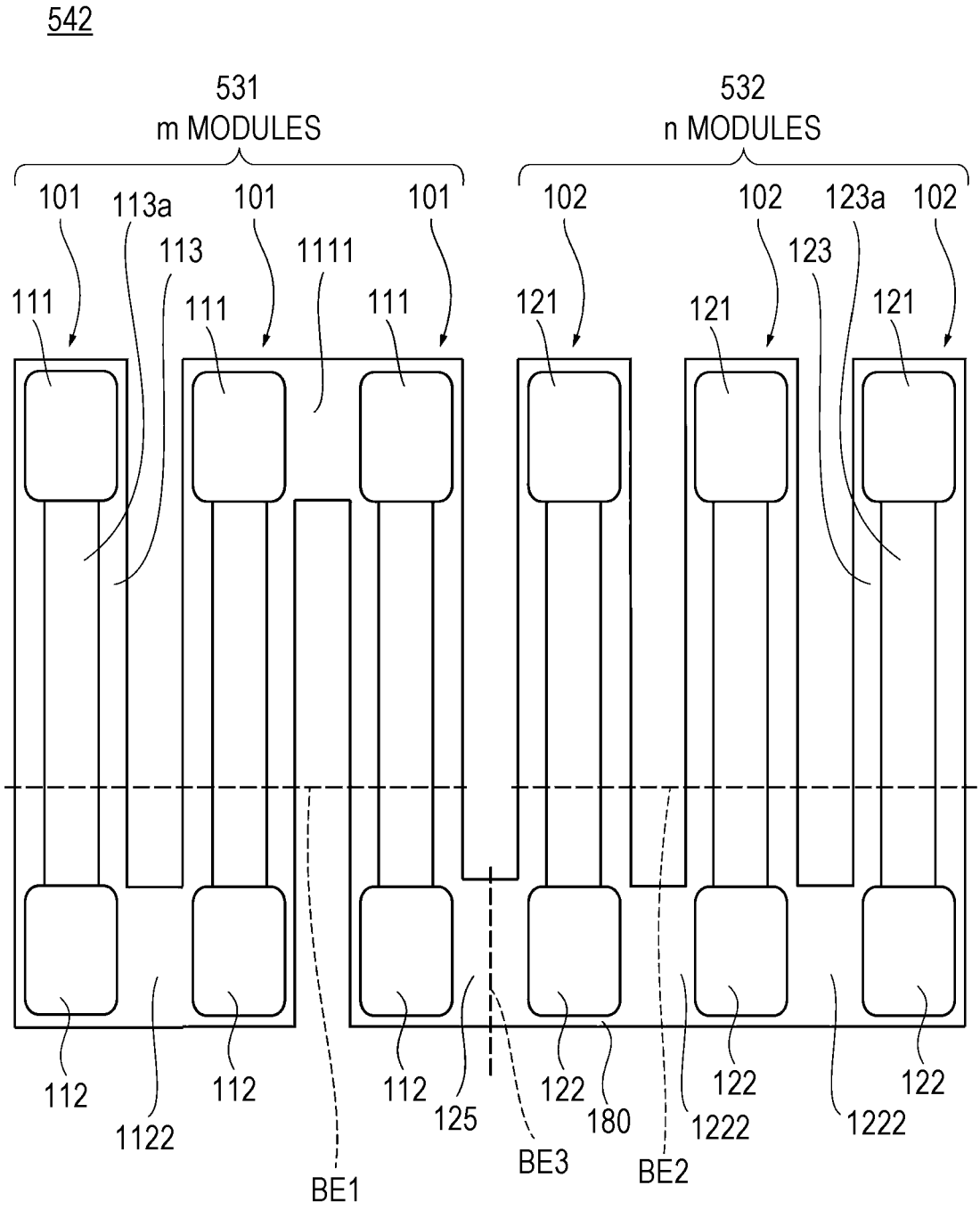
FIG. 34 is a plan view illustrating a configuration of an air cushioning material of a 14th embodiment.

FIG. 34 is a plan view illustrating the configuration of an air cushioning material 542 of a 14th embodiment.

As illustrated in FIG. 34, the air cushioning material 542 of the 14th embodiment includes the first module group 531 and the second module group 532.

The present 14th embodiment is different from the 13th embodiment in the part coupling the air cells to each other in the first module group 531 and the second module group 532.

Specifically, in the first module group 531, the parts of the first air cells 111 of the first module 101 closest to the coupling part 125 and the second closest first module 101 are coupled to each other in the second direction by the air cell coupling part 1111. The parts of the second air cells 112 in the second closest first module 101 and the third closest first module 101 from the coupling part 125 are coupled to each other in the second direction by the air cell coupling part 1122.

In the second module group 532, the parts of the fourth air cells 122 in the adjacent second modules 102 are coupled to each other in the second direction by the air cell coupling part 1222.

The configuration of other parts is the same as that in the 13th embodiment. The attachment mode is the same as that in the 12th embodiment.

Thus, the air cushioning material 542 of the present 14th embodiment provides the same effects as the 12th embodiment.

15th Embodiment

Figure 35:
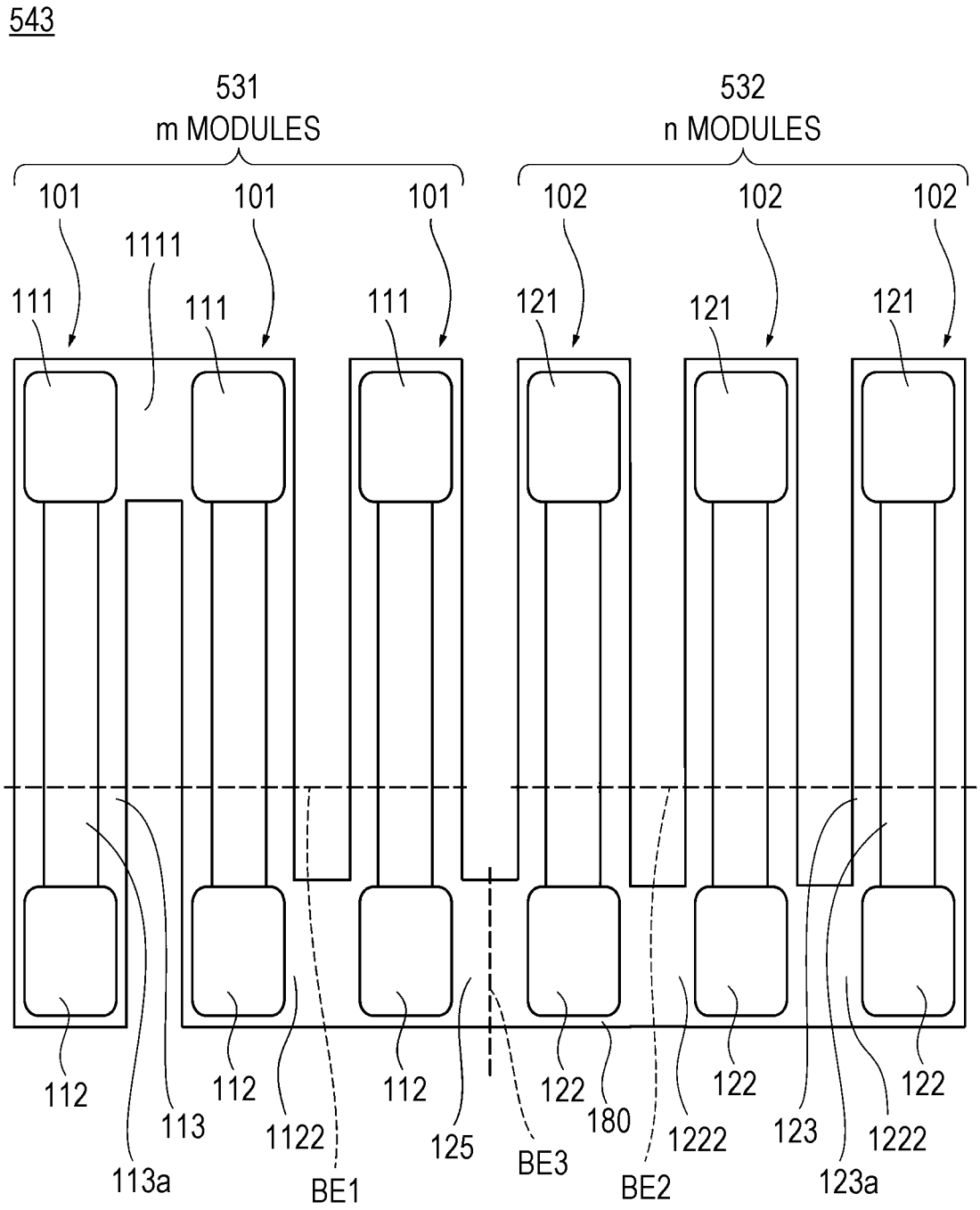
FIG. 35 is a plan view illustrating a configuration of an air cushioning material of a 15th embodiment.

FIG. 35 is a plan view illustrating the configuration of an air cushioning material 543 of a 15th embodiment.

As illustrated in FIG. 35, the air cushioning material 543 of the 15th embodiment includes the first module group 531 and the second module group 532.

The present 15th embodiment is different from the 13th embodiment in the part coupling the air cells to each other in the first module group 531 and the second module group 532.

Specifically, in the first module group 531, the parts of the second air cells 112 of the first module 101 closest to the coupling part 125 and the second closest first module 101 are coupled to each other in the second direction by the air cell coupling part 1122. The parts of the first air cells 111 in the second closest first module 101 and the third closest first module 101 from the coupling part 125 are coupled to each other in the second direction by the air cell coupling part 1111.

In the second module group 532, the parts of the fourth air cells 122 in the adjacent second modules 102 are coupled to each other in the second direction by the air cell coupling part 1222.

The configuration of other parts is the same as that in the 13th embodiment. The attachment mode is the same as that in the 12th embodiment.

Thus, the air cushioning material 543 of the present 15th embodiment provides the same effects as the 12th embodiment.

16th Embodiment

Figure 36:
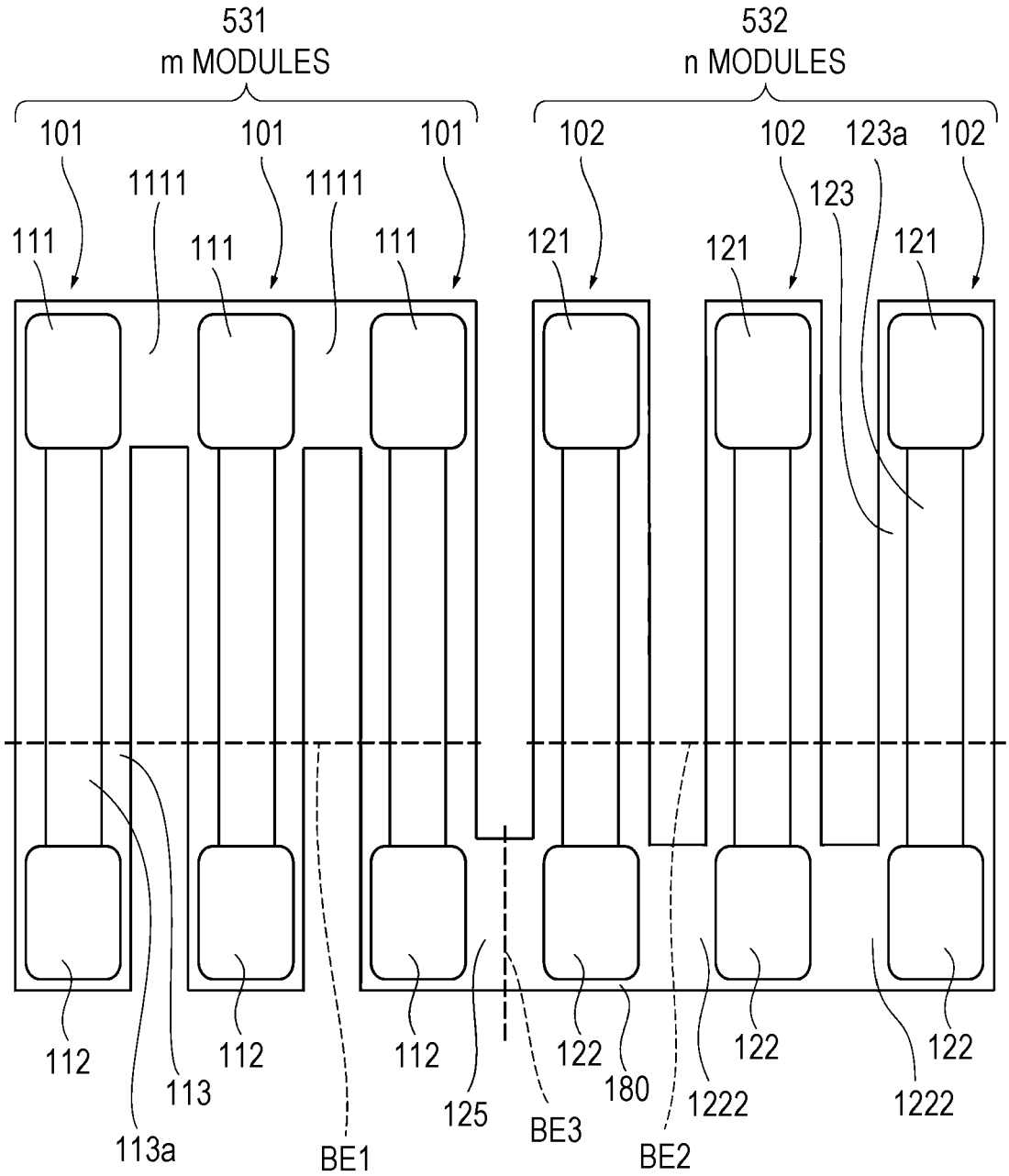
FIG. 36 is a plan view illustrating a configuration of an air cushioning material of a 16th embodiment.

FIG. 36 is a plan view illustrating the configuration of an air cushioning material 544 of a 16th embodiment.

As illustrated in FIG. 36, the air cushioning material 544 of the 16th embodiment includes the first module group 531 and the second module group 532.

The present 16th embodiment is different from the 13th embodiment in the part coupling the air cells to each other in the first module group 531 and the second module group 532.

Specifically, in the first module group 531, parts of the first air cells 111 of the adjacent first modules 101 are coupled to each other in the second direction by the air cell coupling part 1111.

In the second module group 532, the parts of the fourth air cells 122 in the adjacent second modules 102 are coupled to each other in the second direction by the air cell coupling part 1222.

The configuration of other parts is the same as that in the 13th embodiment. The attachment mode is the same as that in the 12th embodiment.

Thus, the air cushioning material 544 of the present 16th embodiment provides the same effects as the 12th embodiment.

17th Embodiment

Figure 37:
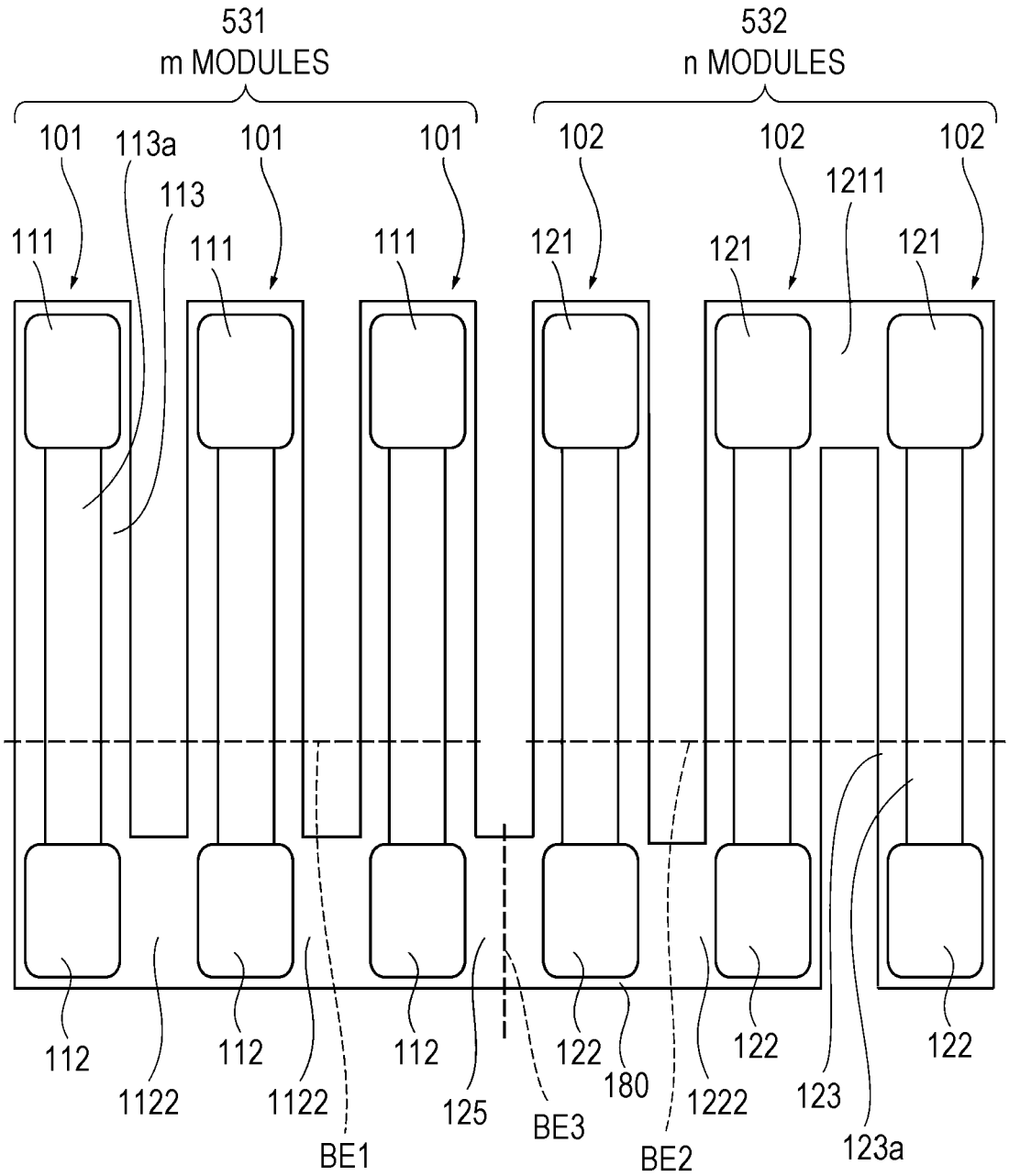
FIG. 37 is a plan view illustrating a configuration of an air cushioning material of a 17th embodiment.

FIG. 37 is a plan view illustrating the configuration of an air cushioning material 545 of a 17th embodiment.

As illustrated in FIG. 37, the air cushioning material 545 of the 17th embodiment includes the first module group 531 and the second module group 532.

The present 17th embodiment is different from the 13th embodiment in the part coupling the air cells to each other in the first module group 531 and the second module group 532.

Specifically, in the first module group 531, parts of the second air cells 112 of the adjacent first modules 101 are coupled to each other in the second direction by the air cell coupling part 1122.

In the second module group 532, the parts of the fourth air cells 122 of the second module 102 closest to the coupling part 125 and the second closest second module 102 are coupled to each other in the second direction by the air cell coupling part 1222. The parts of the third air cells 121 in the second closest second module 102 and the third closest second module 102 from the coupling part 125 are coupled to each other in the second direction by the air cell coupling part 1211.

The configuration of other parts is the same as that in the 13th embodiment. The attachment mode is the same as that in the 12th embodiment.

Thus, the air cushioning material 545 of the present 17th embodiment provides the same effects as the 12th embodiment.

18th Embodiment

Figure 38:
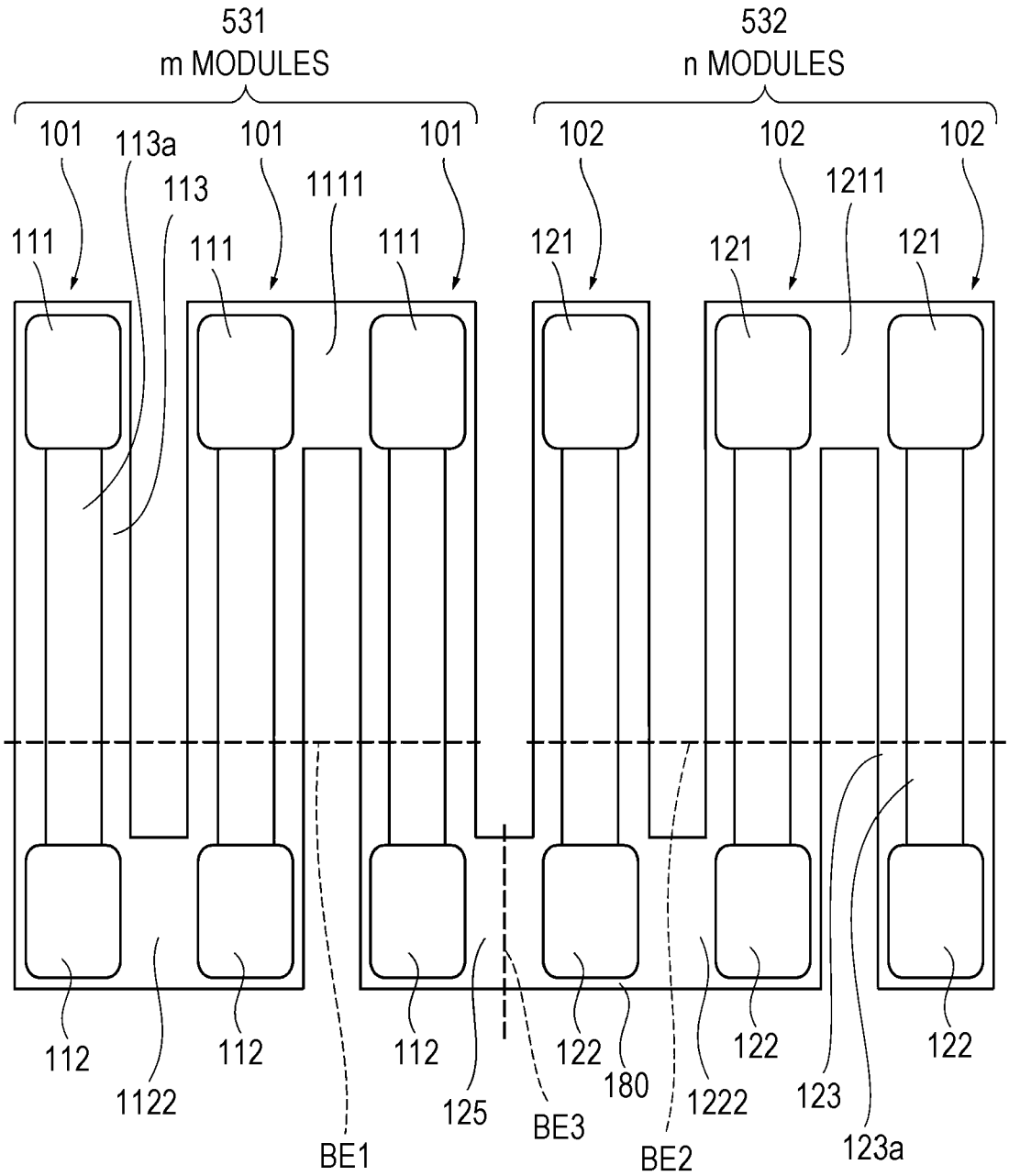
FIG. 38 is a plan view illustrating a configuration of an air cushioning material of an 18th embodiment.

FIG. 38 is a plan view illustrating the configuration of an air cushioning material 546 of an 18th embodiment.

As illustrated in FIG. 38, the air cushioning material 546 of the 18th embodiment includes the first module group 531 and the second module group 532.

The present 18th embodiment is different from the 13th embodiment in the part coupling the air cells to each other in the first module group 531 and the second module group 532.

Specifically, in the first module group 531, the parts of the first air cells 111 of the first module closest to the coupling part 125 and the second closest first module 101 are coupled to each other in the second direction by the air cell coupling part 1111. The parts of the second air cells 112 in the second closest first module and the third closest first module from the coupling part 125 are coupled to each other in the second direction by the air cell coupling part 1122.

In the second module group 532, the parts of the fourth air cells 122 of the second module 102 closest to the coupling part 125 and the second closest second module 102 are coupled to each other in the second direction by the air cell coupling part 1222. The parts of the third air cells 121 in the second closest second module 102 and the third closest second module 102 from the coupling part 125 are coupled to each other in the second direction by the air cell coupling part 1211.

The configuration of other parts is the same as that in the 13th embodiment. The attachment mode is the same as that in the 12th embodiment.

Thus, the air cushioning material 546 of the present 18th embodiment provides the same effects as the 12th embodiment.

19th Embodiment

Figure 39:
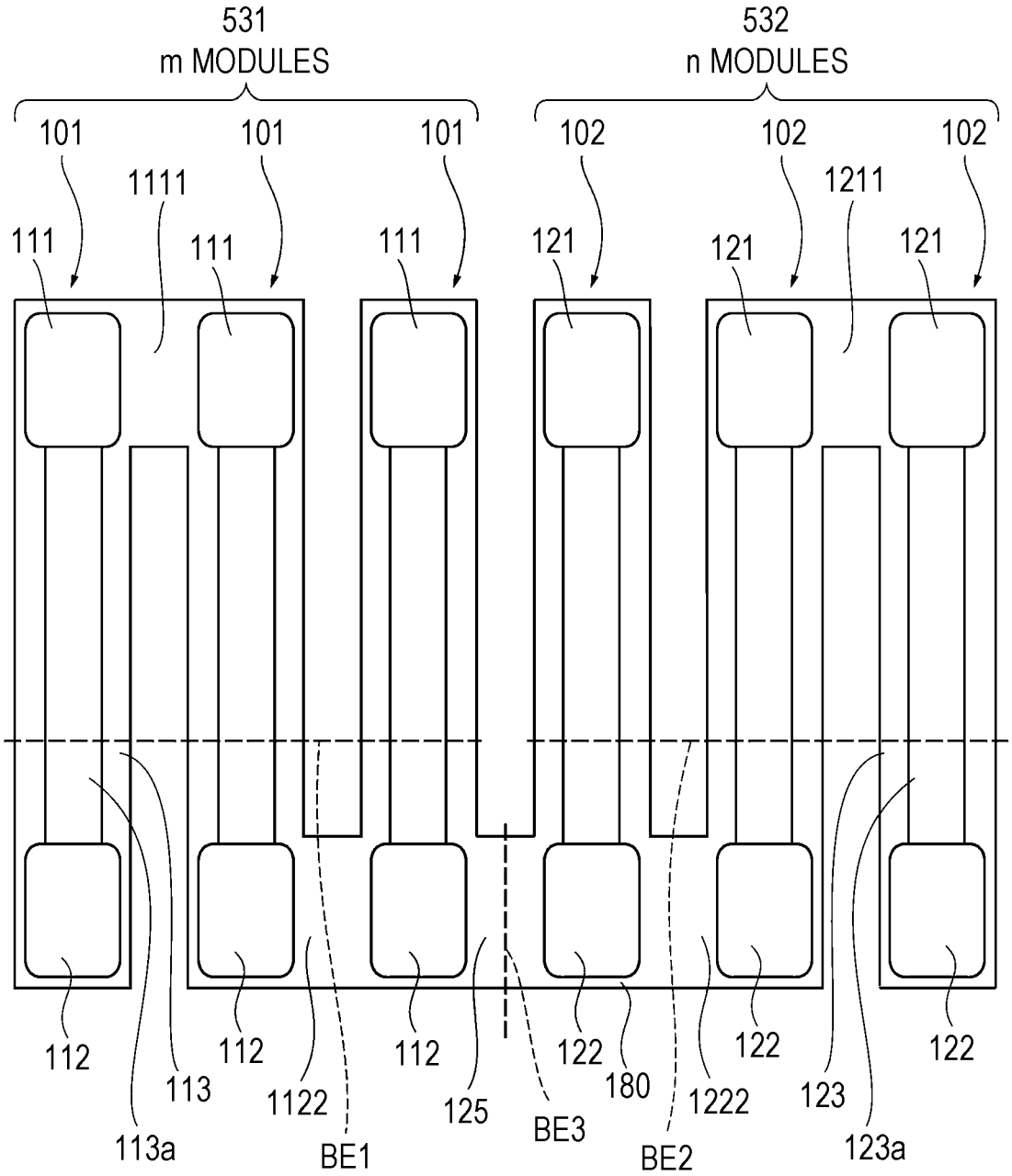
FIG. 39 is a plan view illustrating a configuration of an air cushioning material of a 19th embodiment.

FIG. 39 is a plan view illustrating the configuration of an air cushioning material 547 of a 19th embodiment.

As illustrated in FIG. 39, the air cushioning material 547 of the 19th embodiment includes the first module group 531 and the second module group 532.

The present 19th embodiment is different from the 13th embodiment in the part coupling the air cells to each other in the first module group 531 and the second module group 532.

Specifically, in the first module group 531, the parts of the second air cells 112 of the first module 101 closest to the coupling part 125 and the second closest first module 101 are coupled to each other in the second direction by the air cell coupling part 1122. The parts of the first air cells 111 in the second closest first module 101 and the third closest first module 101 from the coupling part 125 are coupled to each other in the second direction by the air cell coupling part 1111.

In the second module group 532, the parts of the fourth air cells 122 of the second module 102 closest to the coupling part 125 and the second closest second module 102 are coupled to each other in the second direction by the air cell coupling part 1222. The parts of the third air cells 121 in the second closest second module 102 and the third closest second module 102 from the coupling part 125 are coupled to each other in the second direction by the air cell coupling part 1211.

The configuration of other parts is the same as that in the 13th embodiment. The attachment mode is the same as that in the 12th embodiment.

Thus, the air cushioning material 547 of the present 19th embodiment provides the same effects as the 12th embodiment.

20th Embodiment

Figure 40:
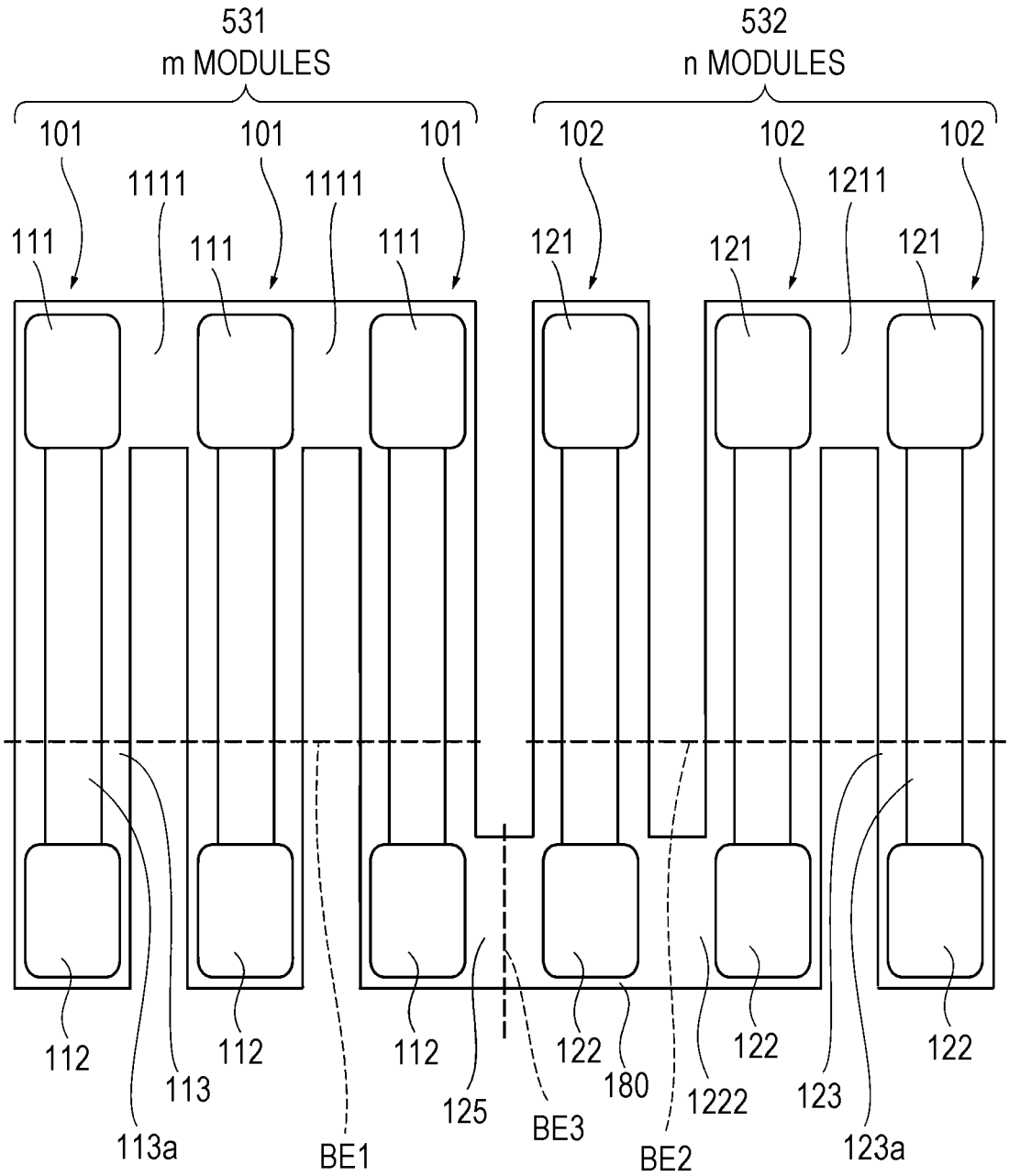
FIG. 40 is a plan view illustrating a configuration of an air cushioning material of a 20th embodiment.

FIG. 40 is a plan view illustrating the configuration of an air cushioning material 548 of a 20th embodiment.

As illustrated in FIG. 40, the air cushioning material 548 of the 20th embodiment includes the first module group 531 and the second module group 532.

The present 20th embodiment is different from the 13th embodiment in the part coupling the air cells to each other in the first module group 531 and the second module group 532.

Specifically, in the first module group 531, parts of the first air cells 111 of the adjacent first modules 101 are coupled to each other in the second direction by the air cell coupling part 1111.

In the second module group 532, the parts of the fourth air cells 122 of the second module 102 closest to the coupling part 125 and the second closest second module 102 are coupled to each other in the second direction by the air cell coupling part 1222. The parts of the third air cells 121 in the second closest second module 102 and the third closest second module 102 from the coupling part 125 are coupled to each other in the second direction by the air cell coupling part 1211.

The configuration of other parts is the same as that in the 13th embodiment. The attachment mode is the same as that in the 12th embodiment.

Thus, the air cushioning material 548 of the present 20th embodiment provides the same effects as the 12th embodiment.

21st Embodiment

Figure 41:
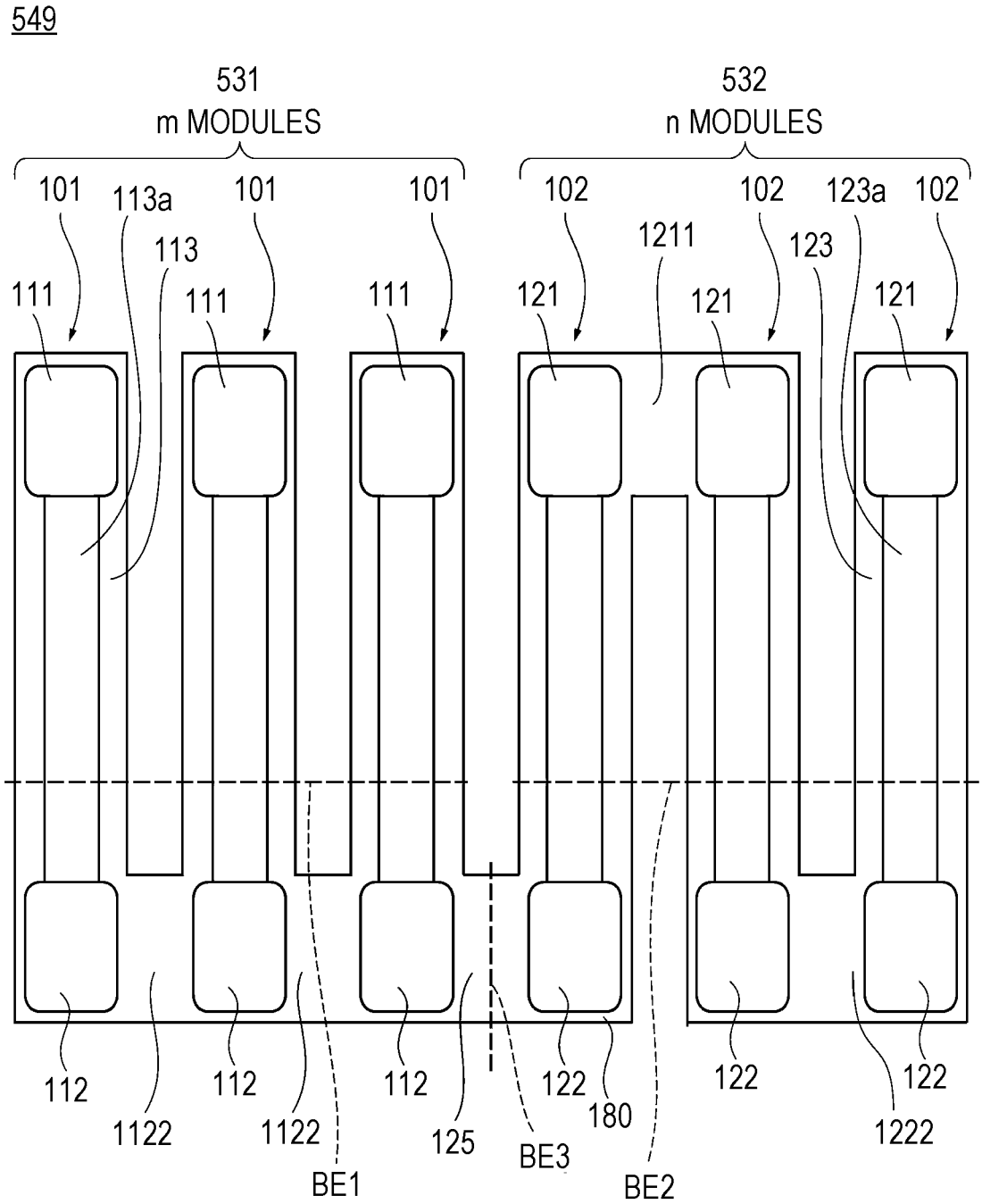
FIG. 41 is a plan view illustrating a configuration of an air cushioning material of a 21st embodiment.

FIG. 41 is a plan view illustrating the configuration of an air cushioning material 549 of a 21st embodiment.

As illustrated in FIG. 41, the air cushioning material 549 of the 21st embodiment includes the first module group 531 and the second module group 532.

The present 21st embodiment is different from the 13th embodiment in the part coupling the air cells to each other in the first module group 531 and the second module group 532.

Specifically, in the first module group 531, parts of the second air cells 112 of the adjacent first modules 101 are coupled to each other in the second direction by the air cell coupling part 1122.

In the second module group 532, the parts of the third air cells 121 of the second module 102 closest to the coupling part 125 and the second closest second module 102 are coupled to each other in the second direction by the air cell coupling part 1211. The parts of the fourth air cells 122 in the second closest second module 102 and the third closest second module 102 from the coupling part 125 are coupled to each other in the second direction by the air cell coupling part 1222.

The configuration of other parts is the same as that in the 13th embodiment. The attachment mode is the same as that in the 12th embodiment.

Thus, the air cushioning material 549 of the present 21st embodiment provides the same effects as the 12th embodiment.

22nd Embodiment

Figure 42:
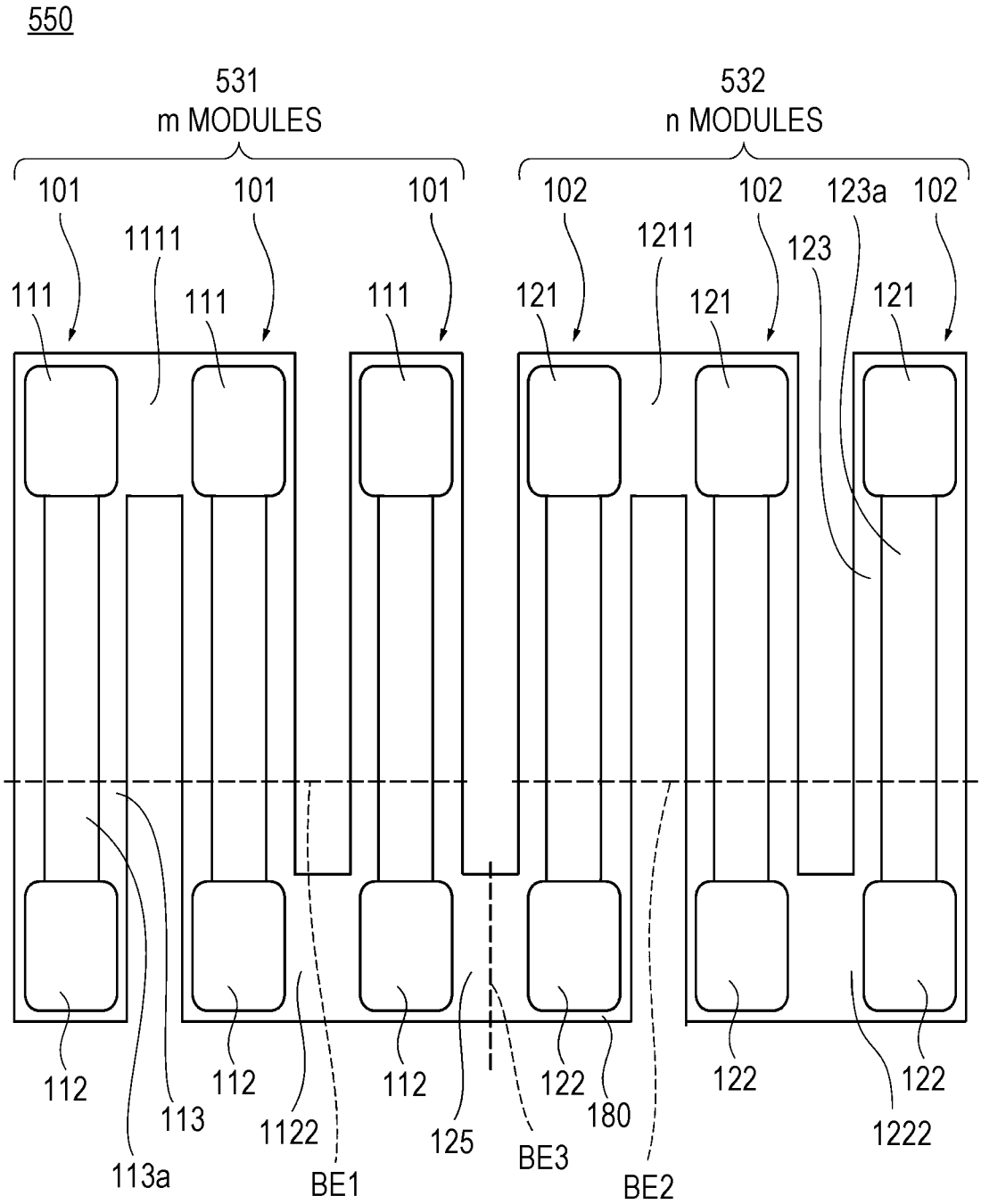
FIG. 42 is a plan view illustrating a configuration of an air cushioning material of a 22nd embodiment.

FIG. 42 is a plan view illustrating the configuration of an air cushioning material 550 of a 22nd embodiment.

As illustrated in FIG. 42, the air cushioning material 550 of the 22nd embodiment includes the first module group 531 and the second module group 532.

The present 22nd embodiment is different from the 13th embodiment in the part coupling the air cells to each other in the first module group 531 and the second module group 532.

Specifically, in the first module group 531, the parts of the second air cells 112 of the first module 101 closest to the coupling part 125 and the second closest first module 101 are coupled to each other in the second direction by the air cell coupling part 1122. The parts of the first air cells 111 in the second closest first module 101 and the third closest first module 101 from the coupling part 125 are coupled to each other in the second direction by the air cell coupling part 1111.

In the second module group 532, the parts of the third air cells 121 of the second module 102 closest to the coupling part 125 and the second closest second module 102 are coupled to each other in the second direction by the air cell coupling part 1211. The parts of the fourth air cells 122 in the second closest second module 102 and the third closest second module 102 from the coupling part 125 are coupled to each other in the second direction by the air cell coupling part 1222.

The configuration of other parts is the same as that in the 13th embodiment. The attachment mode is the same as that in the 12th embodiment.

Thus, the air cushioning material 550 of the present 22nd embodiment provides the same effects as the 12th embodiment.

23rd Embodiment

Figure 43:
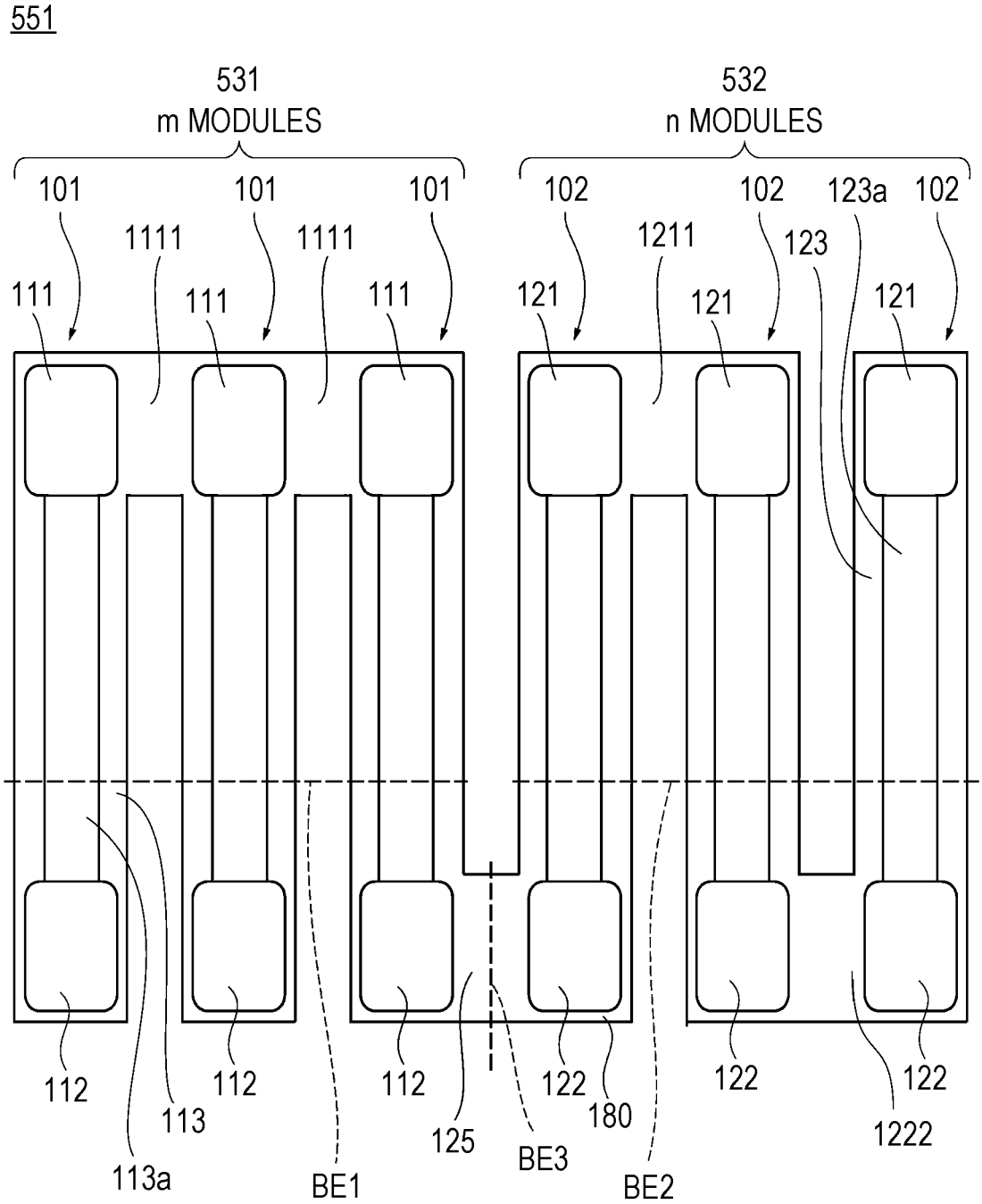
FIG. 43 is a plan view illustrating a configuration of an air cushioning material of a 23rd embodiment.

FIG. 43 is a plan view illustrating the configuration of an air cushioning material 551 of a 23rd embodiment.

As illustrated in FIG. 43, the air cushioning material 551 of the 23rd embodiment includes the first module group 531 and the second module group 532.

The present 23rd embodiment is different from the 13th embodiment in the part coupling the air cells to each other in the first module group 531 and the second module group 532.

Specifically, in the first module group 531, parts of the first air cells 111 of the adjacent first modules 101 are coupled to each other in the second direction by the air cell coupling part 1111.

In the second module group 532, the parts of the third air cells 121 of the second module 102 closest to the coupling part 125 and the second closest second module 102 are coupled to each other in the second direction by the air cell coupling part 1211. The parts of the fourth air cells 122 in the second closest second module 102 and the third closest second module 102 from the coupling part 125 are coupled to each other in the second direction by the air cell coupling part 1222.

The configuration of other parts is the same as that in the 13th embodiment. The attachment mode is the same as that in the 12th embodiment.

Thus, the air cushioning material 551 of the present 23rd embodiment provides the same effects as the 12th embodiment.

24th Embodiment

Figure 44:
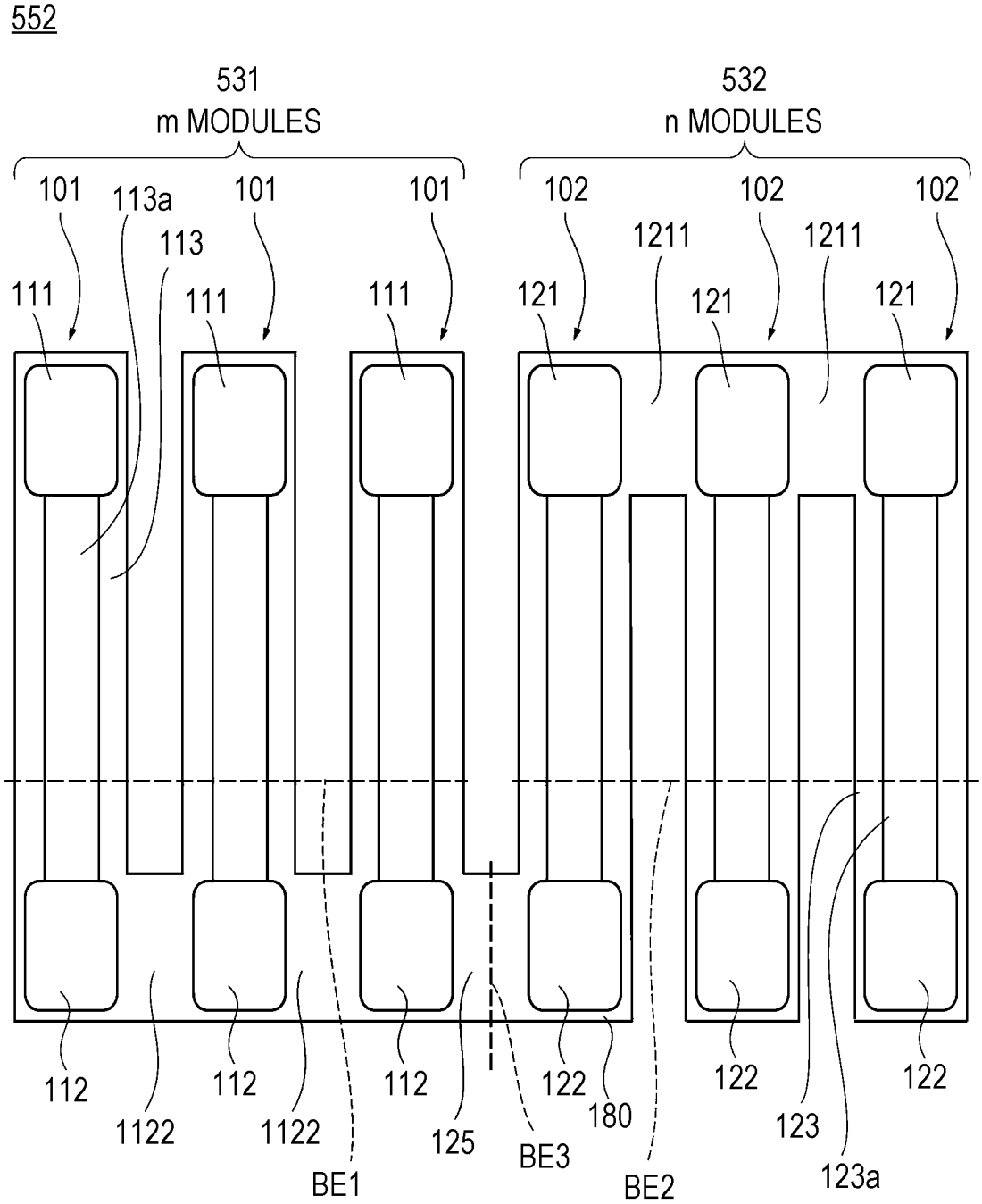
FIG. 44 is a plan view illustrating a configuration of an air cushioning material of a 24th embodiment.

FIG. 44 is a plan view illustrating the configuration of an air cushioning material 552 of a 24th embodiment.

As illustrated in FIG. 44, the air cushioning material 552 of the 24th embodiment includes the first module group 531 and the second module group 532.

The present 24th embodiment is different from the 13th embodiment in the part coupling the air cells to each other in the first module group 531 and the second module group 532.

Specifically, in the first module group 531, parts of the second air cells 112 of the adjacent first modules 101 are coupled to each other in the second direction by the air cell coupling part 1122.

In the second module group 532, the parts of the third air cells 121 in the adjacent second modules 102 are coupled to each other in the second direction by the air cell coupling part 1211.

The configuration of other parts is the same as that in the 13th embodiment. The attachment mode is the same as that in the 12th embodiment.

Thus, the air cushioning material 552 of the present 24th embodiment provides the same effects as the 12th embodiment.

25th Embodiment

Figure 45:
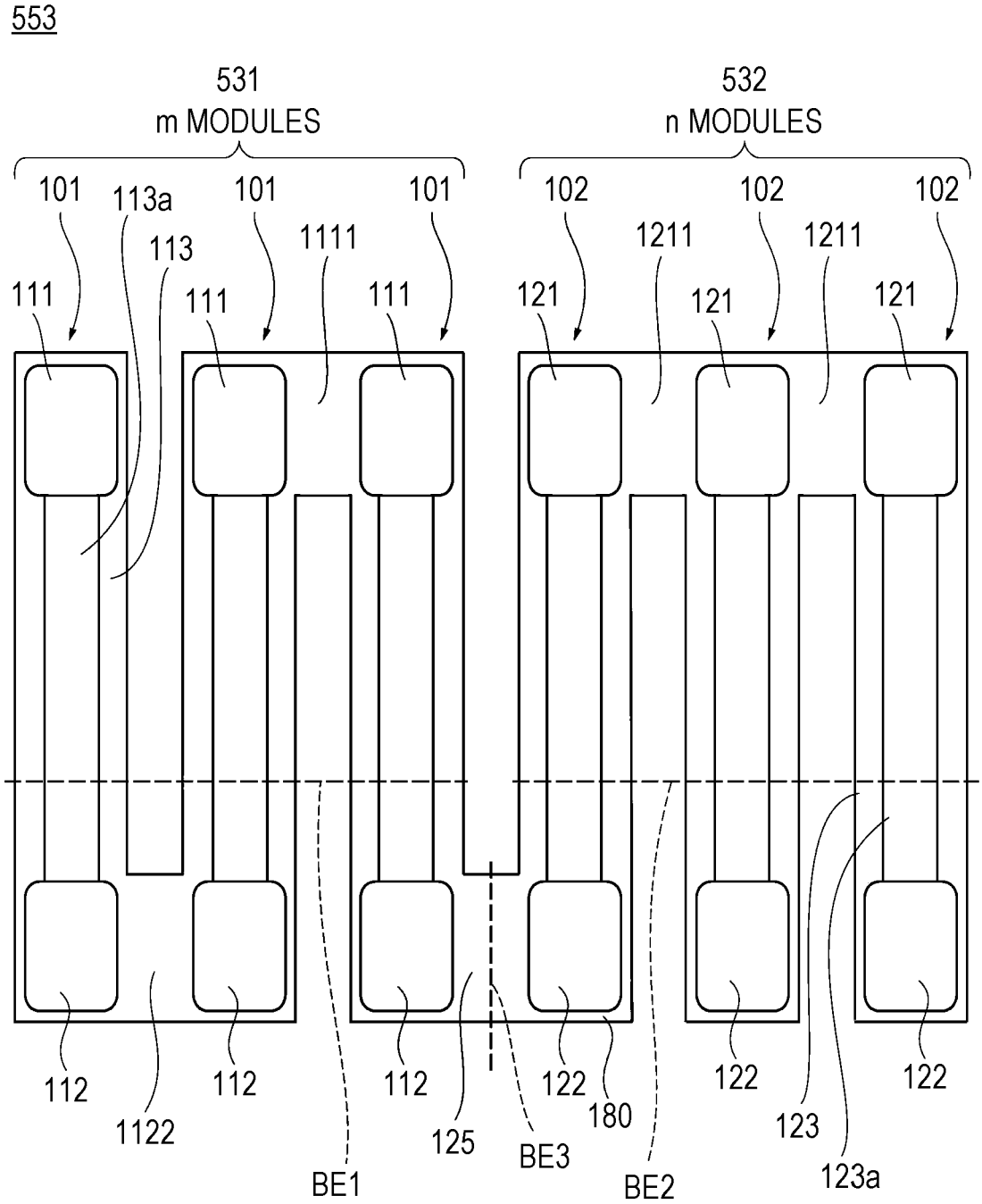
FIG. 45 is a plan view illustrating a configuration of an air cushioning material of a 25th embodiment.

FIG. 45 is a plan view illustrating the configuration of an air cushioning material 553 of a 25th embodiment.

As illustrated in FIG. 45 the air cushioning material 553 of the 25th embodiment includes the first module group 531 and the second module group 532.

The present 25th embodiment is different from the 13th embodiment in the part coupling the air cells to each other in the first module group 531 and the second module group 532.

Specifically, in the first module group 531, the parts of the first air cells 111 of the first module 101 closest to the coupling part 125 and the second closest first module 101 are coupled to each other in the second direction by the air cell coupling part 1111. The parts of the second air cells 112 in the second closest first module 101 and the third closest first module 101 from the coupling part 125 are coupled to each other in the second direction by the air cell coupling part 1122.

In the second module group 532, the parts of the third air cells 121 in the adjacent second modules 102 are coupled to each other in the second direction by the air cell coupling part 1211.

The configuration of other parts is the same as that in the 13th embodiment. The attachment mode is the same as that in the 12th embodiment.

Thus, the air cushioning material 553 of the present 25th embodiment provides the same effects as the 12th embodiment.

26th Embodiment

Figure 46:
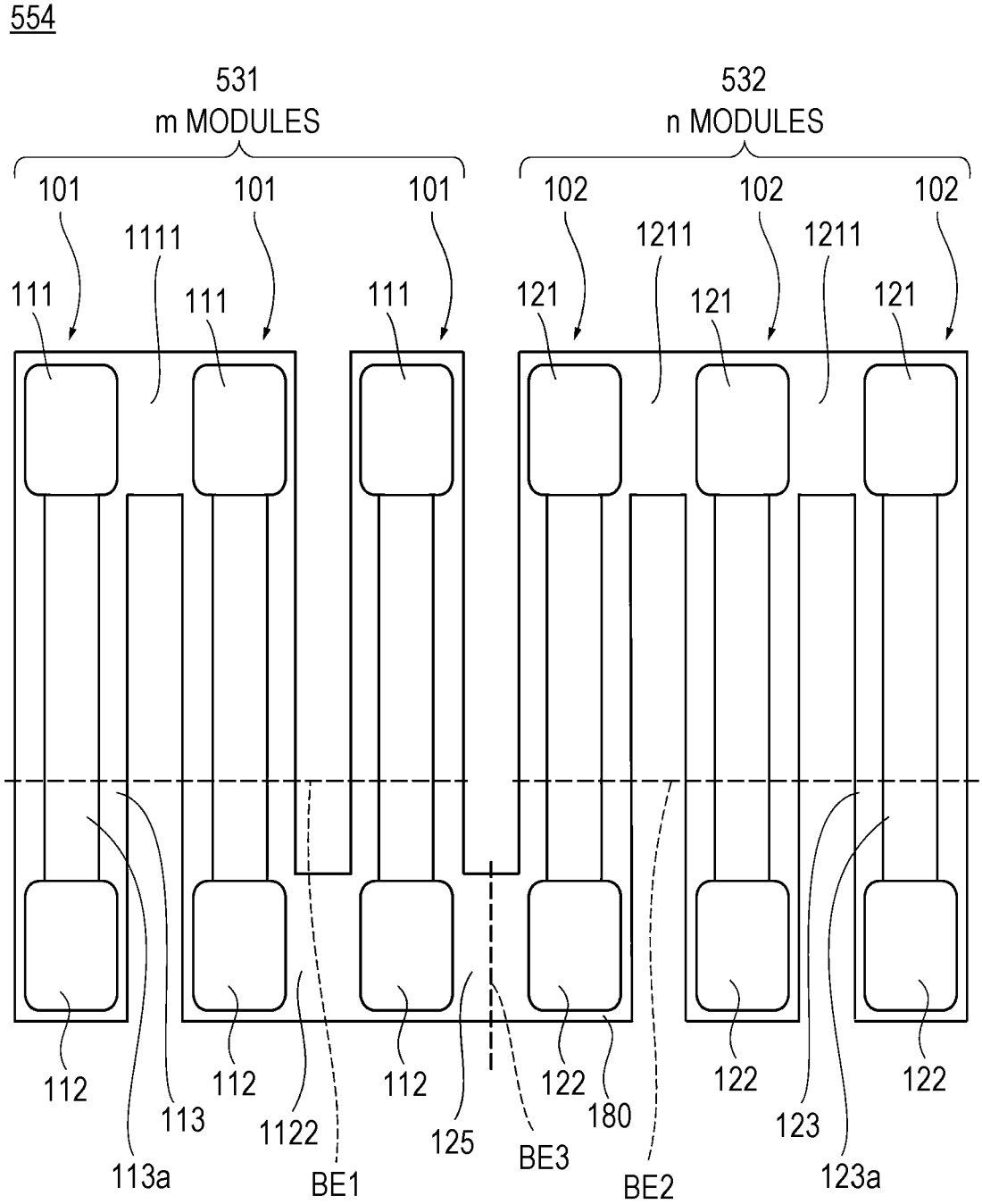
FIG. 46 is a plan view illustrating a configuration of an air cushioning material of a 26th embodiment.

FIG. 46 is a plan view illustrating the configuration of an air cushioning material 554 of a 26th embodiment.

As illustrated in FIG. 46 the air cushioning material 554 of the 26th embodiment includes the first module group 531 and the second module group 532.

The present 26th embodiment is different from the 13th embodiment in the part coupling the air cells to each other in the first module group 531 and the second module group 532.

Specifically, in the first module group 531, the parts of the second air cells 112 of the first module 101 closest to the coupling part 125 and the second closest first module 101 are coupled to each other in the second direction by the air cell coupling part 1122. The parts of the first air cells 111 in the second closest first module 101 and the third closest first module 101 from the coupling part 125 are coupled to each other in the second direction by the air cell coupling part 1111.

In the second module group 532, the parts of the third air cells 121 in the adjacent second modules 102 are coupled to each other in the second direction by the air cell coupling part 1211.

The configuration of other parts is the same as that in the 13th embodiment. The attachment mode is the same as that in the 12th embodiment.

Thus, the air cushioning material 554 of the present 26th embodiment provides the same effects as the 12th embodiment.

27th Embodiment

Figure 47:
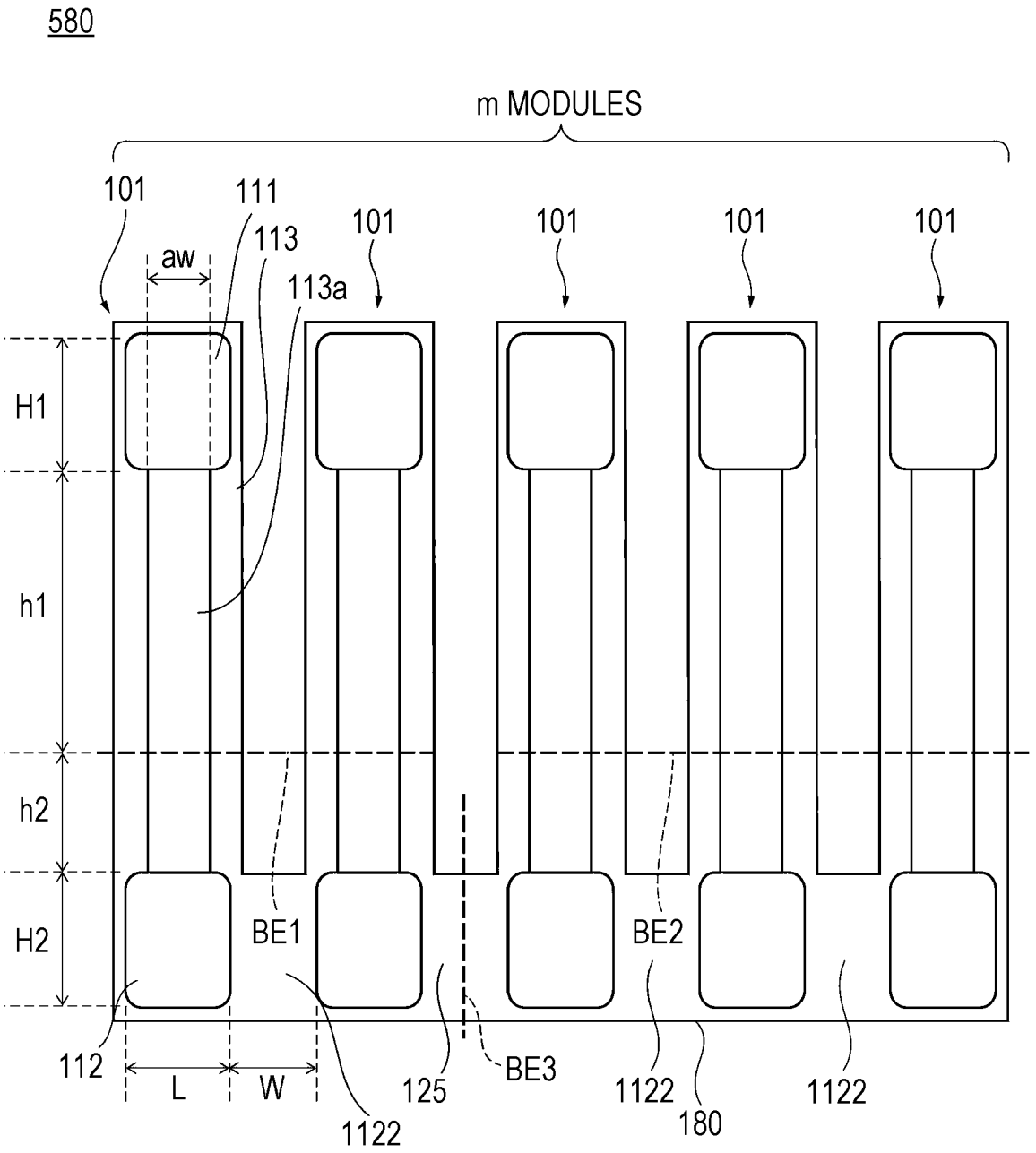
FIG. 47 is a plan view illustrating a configuration of an air cushioning material of a 27th embodiment.

FIG. 47 is a plan view illustrating the configuration of an air cushioning material 580 of a 27th embodiment.

As illustrated in FIG. 47, the air cushioning material 580 of the 27th embodiment has m first modules 101 (m is a natural number that is equal to or larger than two). Parts of the second air cells 112 in the adjacent first modules are coupled to each other in the second direction. Therefore, there are (m−1) coupling parts 125. Any of the (m−1) coupling parts 125 are the same as the coupling part 125 in the first embodiment.

In the 27th embodiment, the parts H1, h1, H2, h2, L, W, and aw of the air cushioning material 580 are defined as in the first embodiment. The thickness of each part, which is not illustrated, is also basically the same as that in the first embodiment.

The length (h1+h2) of each first belt-like part 113 in the first direction is a length that is (m−1) times longer or more than a sum (L+W) of the length L of the first air cell 111 in the second direction and the length W of one coupling part 125 in the second direction. In the example illustrated in FIG. 47, $(h1+h2) \geq (m-1)L+(m-2)W$ holds.

The air cushioning material 580 of the 27th embodiment is used by being bent at any arbitrarily selected coupling part 125.

Other configurations are the same as those in the first or the second embodiment.

Figure 48:
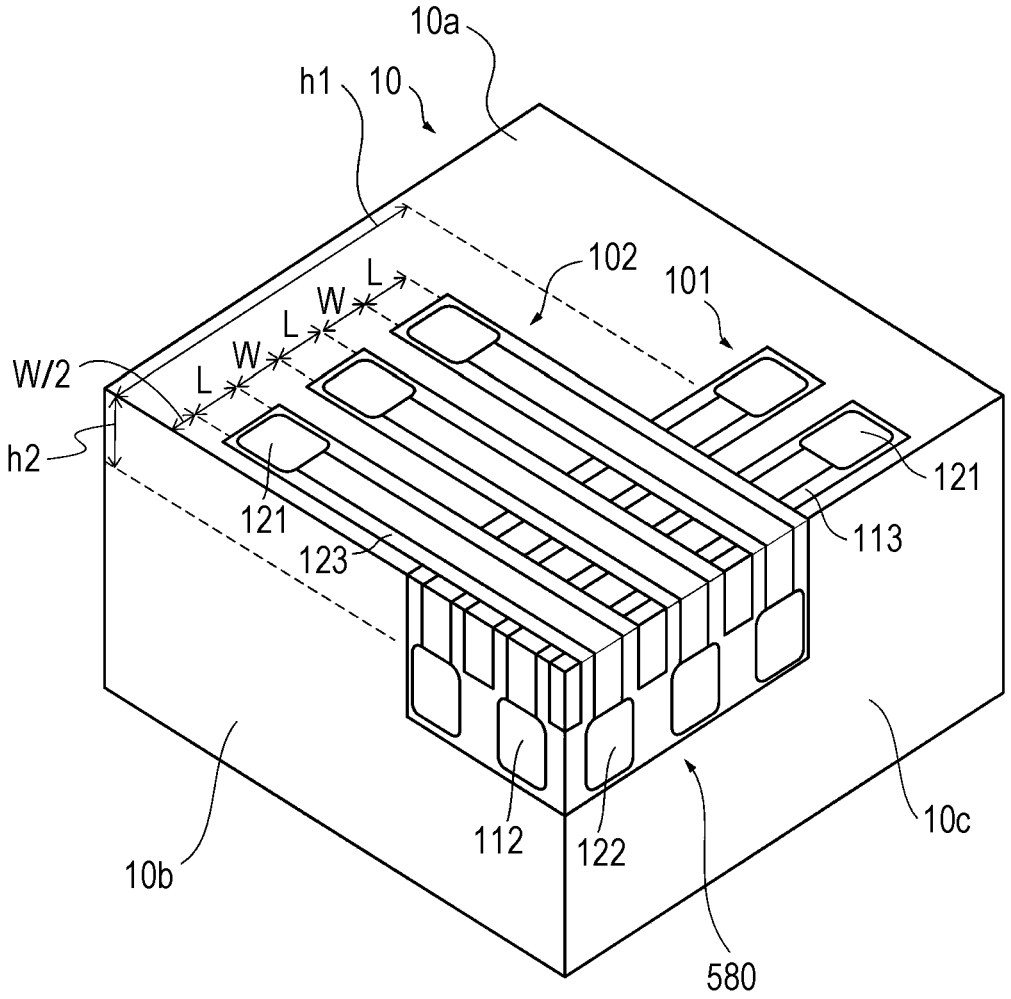
FIG. 48 is a perspective view illustrating ab attachment mode of the air cushioning material of the 27th embodiment to the article.

FIG. 48 is a perspective view illustrating an example of an attachment mode of the air cushioning material 580 of the 27th embodiment to the article 10. As illustrated in FIG. 48, the air cushioning material 580 is bent at the coupling part 125, and the first module 101 on one side of the coupling part 125 bent is used as the second module 102. Thus, the coupling part 125 of the air cushioning material 580 is bent so that a plurality of second air cells 112 and fourth air cells 122 come into contact with two surfaces 10*b* and 10*c* of the article 10. The first belt-like part 113 of the first module 101 is bent so that a plurality of first air cells 111 and a part of the first belt-like parts 113 are in contact with the surface 10*a* of the article 10. The part thus obtained as the second module 102 is bent at the second belt-like part 123, and the plurality of third air cells 121 and a part of the second belt-like part 123 come into contact with the surface 10*a* of the article 10 to cover a part of the first belt-like part 113.

When such an attachment mode is used, with the parts set to have the lengths described above, the air cushioning material 580 of the 27th embodiment can protect the three surfaces defining the corner part of the article 10, without easily being lifted as in the first embodiment.

Although not illustrated, the air cushioning material 580 may be taped, for example.

The air cushioning material 580 of the present 27th embodiment provides the following effects.

The air cushioning material 580 of the present 27th embodiment includes a plurality of first modules 101 which are bent at an arbitrary position, and one side of the bent position functions as the second module. The air cushioning material 580 of the present 27th embodiment can widely cover the three surfaces of the article 10 at once. The parts to be the first module 101 and the second module 102 can be arbitrarily changed, and thus the material can be used in accordance with an area of each surface of the article 10.

28th Embodiment

Figure 49:
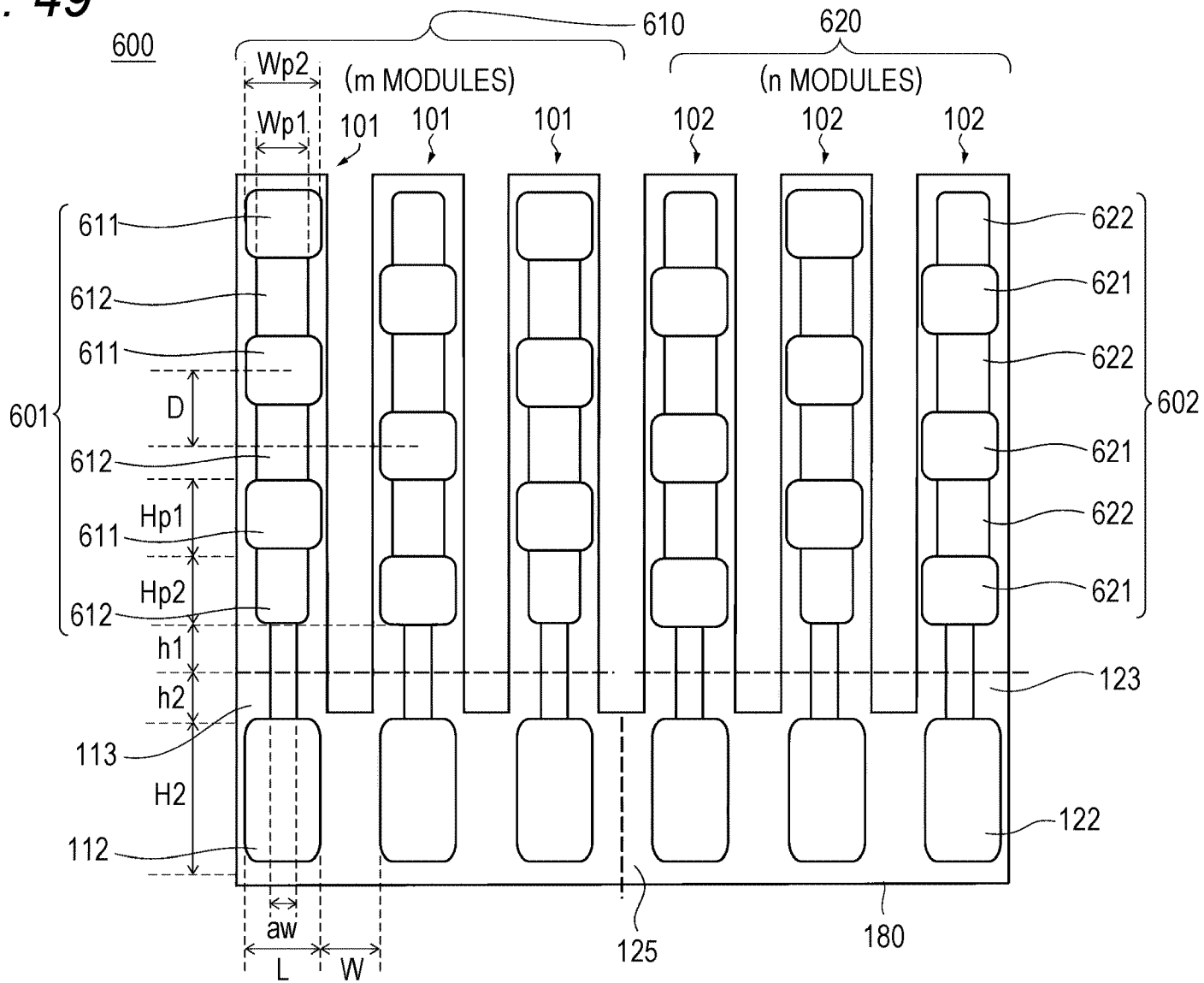
FIG. 49 is a plan view illustrating a configuration of an air cushioning material of a 28th embodiment.
Figure 50:
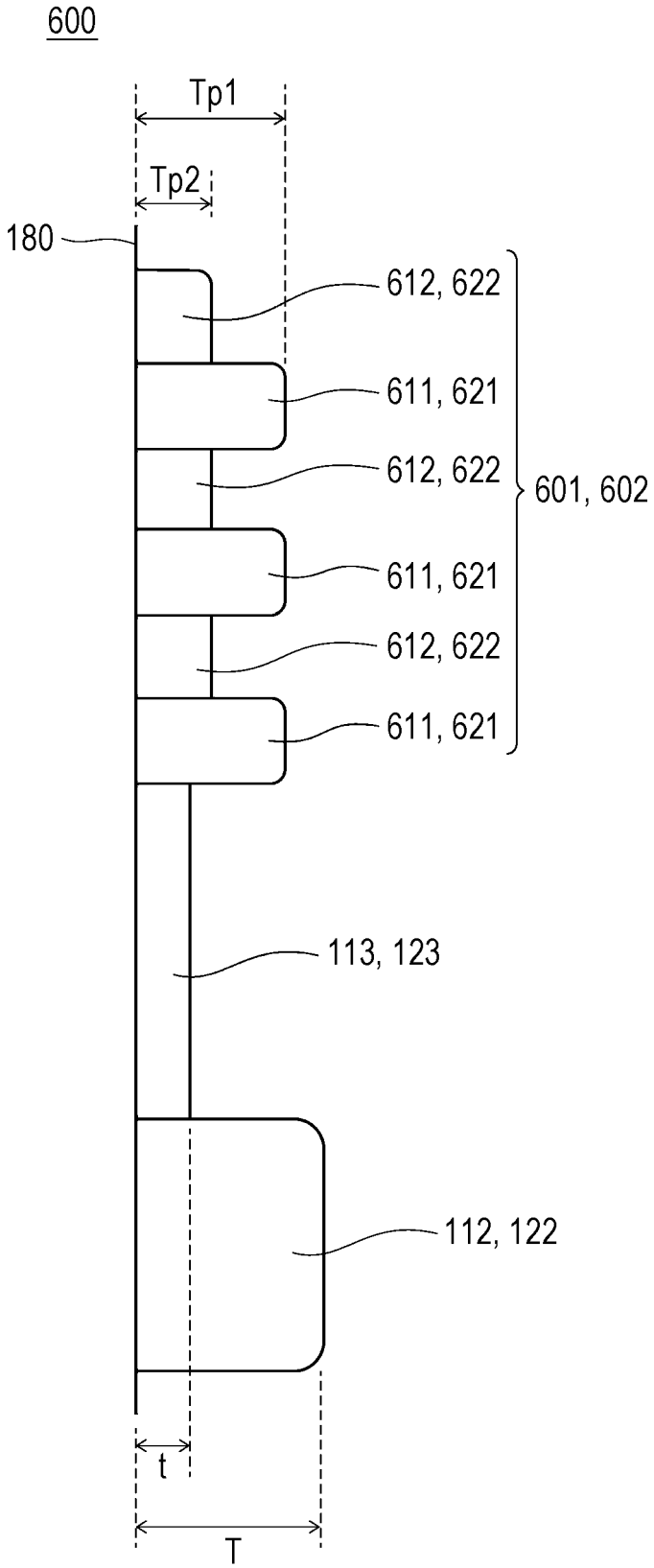
FIG. 50 is a side view illustrating a configuration of the air cushioning material of the 28th embodiment.

FIG. 49 is a plan view illustrating the configuration of an air cushioning material 600 of a 28th embodiment. FIG. 50 is a side view illustrating the configuration of the air cushioning material 600 of the 28th embodiment.

As illustrated in FIGS. 49 and 50, the air cushioning material 600 of the 28th embodiment includes a first module group 610 and a second module group 620.

The first module group 610 includes m first modules 101 (m is a natural number). Parts of the second air cells 112 of the first modules 101 in the first module group 610 are coupled to each other in the second direction.

The second module group 620 includes n second modules 102 (n is a natural number). Parts of the fourth air cells 122 of the second modules 102 in the second module group 620 are coupled to each other in the second direction.

In the present 28th embodiment, m and n are any natural numbers and m=n may hold.

The first module 101 has a first air cell group 601. The first air cell group 601 has a first part 611 and a second part 612. The first part 611 is an air cell. The second part 612 is preferably an air passage that enables air to flow between the first parts. However, the second part 612 may be a member connecting the first parts 611 to each other instead of being the air passage.

The second module 102 has a third air cell group 602. The third air cell group 602 has a first part 621 and a second part 622 as in the first air cell group 601. The first part 621 is an air cell. The second part 622 is preferably an air passage that enables air to flow between the first parts. However, the second part 622 may be a member connecting the first parts 621 to each other instead of being the air passage.

The first module 101 positioned at an end on the second module group 620 side in the first module group 610 and the second module 102 positioned at an end on the first module group 610 side in the second module group 620 are coupled to each other in the second direction by the coupling part 125.

The plurality of first modules 101 are alternately shaped to be the same and the plurality of second modules 102 are alternately shaped to be the same. Other configurations are the same as those in the first embodiment.

In the present 28th embodiment, the parts H1, H2, h1, h2, L, W, t, and T of the air cushioning material 600 are defined as in the first embodiment. Furthermore, in the present 28th embodiment, lengths of parts of the air cushioning material 600 are defined as follows.

Hp1: A length of the first part 611 in the first direction. This is of any length.

Hp2: A length of the second part 612 in the first direction. This is of any length.

D: A length in the first direction from the center of the first part 611 of the first module 101 to the center of the first part 611 of the adjacent second module 102. This will be described later.

Wp1: A length of the first part 611 in the second direction. This is of any length.

Wp2: A length of the second part 612 in the second direction. This is of any length.

Tp1: A thickness of the first part 611. This is of any thickness.

Tp2: A thickness of the second part 612. This will be described later.

The same applies to the first part 621 and the second part 622 in the second module.

The parts of the air cushioning material 600 defined as described above satisfy the conditions of the first embodiment, and also satisfy conditions Wp1≥Wp2, Hp2≥Wp1, Hp1+Hp2=2×(L+W), D=L+W, and Tp1>Tp2. Still, in the present 28th embodiment, the relationship may not be satisfied as long as the first belt-like part 113 can be bent. This is because the air cell part can be prevented from being overlapped over the first belt-like part 113 or below the second belt-like part 123, when the first air cell group 601 and the third air cell group 603 are woven on the article 10.

The air cushioning material 600 with the parts having the lengths described above can be attached to be in contact with the three surfaces of the article 10, with the first air cell group 601 and the third air cell group 603 woven.

Figure 51:
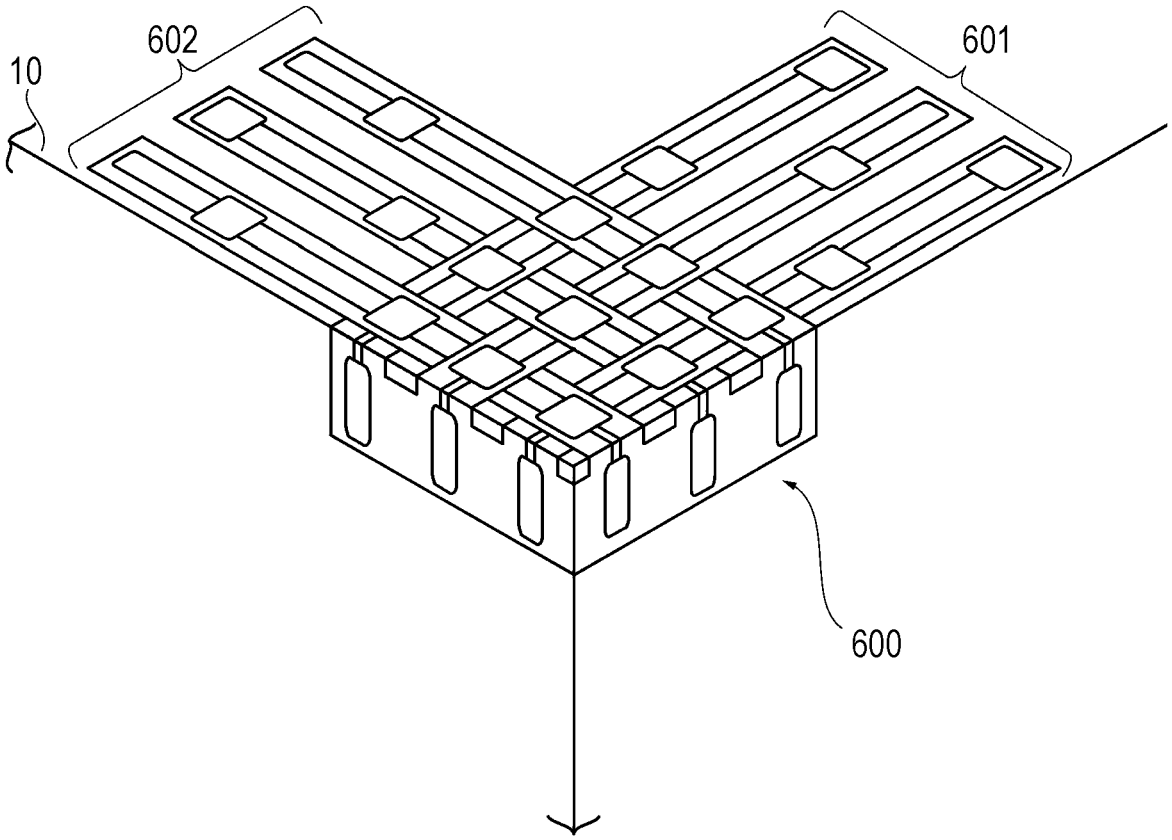
FIG. 51 is a perspective view illustrating an example of an attachment mode of the air cushioning material of the 28th embodiment to the article.

FIG. 51 is a perspective view illustrating an example of an attachment mode of the air cushioning material 600 of the 28th embodiment to the article 10. As illustrated in FIG. 51, the coupling part 125 of the air cushioning material 600 is bent so that the second air cell 112 and the fourth air cell 122 come into contact with two surfaces 10*b* and 10*c* of the article 10. The first part 611 and the second part 612 of the first module 101 and the second module 102 are woven on the surface 10*a* of the article 10.

The air cushioning material 600 of the present 28th embodiment provides the following effects.

The air cushioning material 600 of the 28th embodiment can be arranged with a plurality of first parts 611 and a plurality of second parts 612 woven on the article 10. Thus, the air cushioning material 600 of the 28th embodiment can cover three surfaces defining the corner part of the article 10 with the plurality of first modules 101 and the plurality of second modules 102 tightly joined to each other, without using a tape for attachment.

In addition, the air cushioning material 600 of the present 28th embodiment provides the same effect as that of the first embodiment.

29th Embodiment

Figure 52:
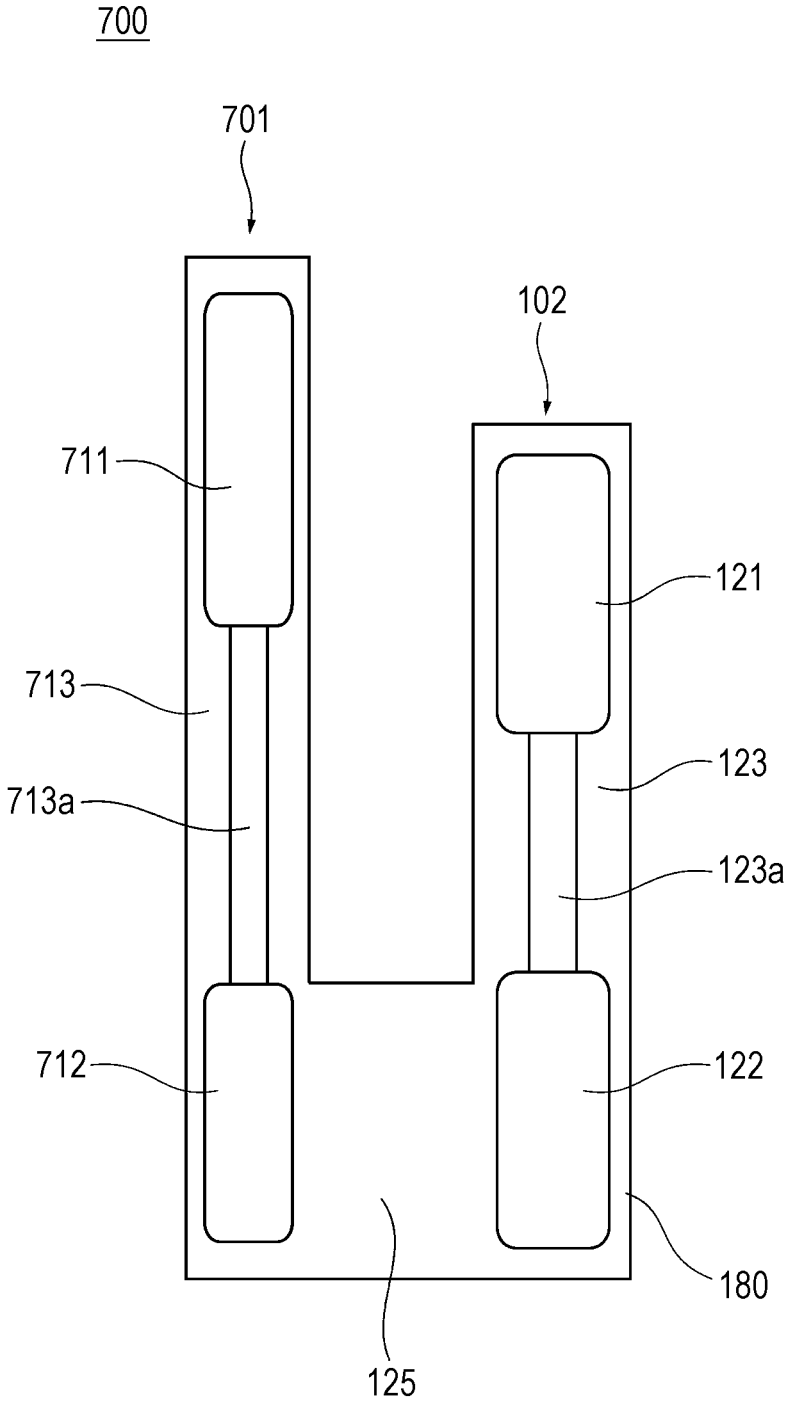
FIG. 52 is a plan view illustrating a configuration of an air cushioning material of a 29th embodiment.

FIG. 52 is a plan view illustrating the configuration of an air cushioning material 700 of a 29th embodiment.

As illustrated in FIG. 52, the air cushioning material 700 of the 29th embodiment includes the first module 101 and the second module 102.

The first module 101 includes a first air cell 711, a second air cell 712, and a first belt-like part 713. The second module 102 has the configuration that is the same as that in the first embodiment. A part of the second air cell 712 and a part of the fourth air cell 122 are coupled to each other by the coupling part 125.

The first module 701 of the air cushioning material 700 of the 29th embodiment is longer than the second module 102 in the first direction and is shorter than the second module 102 in the second direction. Thus, in the air cushioning material 700 of the 29th embodiment, the first module 101 and the second module 102 have different sizes.

The air cushioning material 700 of the 29th embodiment can provide the same effects as the first embodiment, despite the difference in size between the first module 101 and the second module 102.

30th Embodiment

Figure 53:
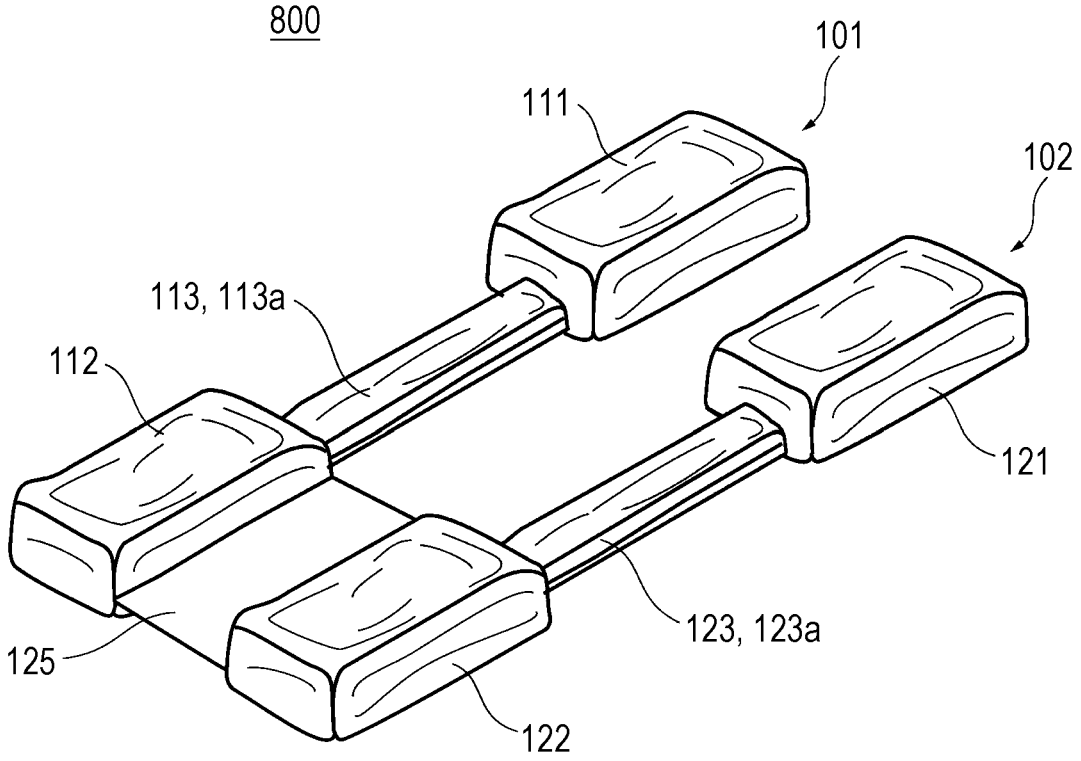
FIG. 53 is a perspective view illustrating a configuration of the air cushioning material of the 30th embodiment.

FIG. 53 is a perspective view illustrating the configuration of the air cushioning material 800 according to the 30th embodiment.

As illustrated in FIG. 53, the air cushioning material 800 of the 30th embodiment has a configuration not include a base film (margin part). Thus, the first module 101, the second module 102, and the coupling part 125 have configurations that are the same as those in the first embodiment. The first belt-like part 113 connecting the first air cell 111 and the second air cell 112 are directly used as the air passage. Similarly, the second belt-like part 123 connecting the third air cell 121 and the fourth air cell 122 are directly used as the air passage.

The air cushioning material 800 of the 30th embodiment provides the same effects as the first embodiment, despite the lack of the base film (margin) holding the air cell.

Similarly, the other embodiments may be in a form without the base film (margin), and still provide their effects.

Various embodiments can be made to the embodiments of the present invention have been described above. Specifically, elements of the configurations of the embodiments may be combined.

In the embodiments, the shape of the first to the fourth air cells is a substantially rectangular parallelepiped shape. Alternatively, the air cell may have a shape other than such a shape, with an elliptical or circular shape in plan view, such as a football shape, an egg shape, or a spherical shape for example. The first to the fourth air cells may have various other shapes. In the case of such shapes, lengths of the part of the air cell in the first direction and the second direction are the lengths of the longest parts of the air cell with each of such shapes in the first direction and the second direction.

The first to the fourth air cells may have sizes and/or shapes different from each other.

Furthermore, the conditions and numerical values used in the description of the embodiments are merely for description, and thus the present invention is not limited to these conditions and numerical values.

The present invention can be modified in various ways based on the configurations described in claims, and the modifications are within the range of the present invention.

Although embodiments of the present invention have been described and illustrated in detail, the disclosed embodiments are made for purposes of illustration and example only and not limitation. The scope of the present invention should be interpreted by terms of the appended claims

What is claimed is:

1. An air cushioning material comprising:

a first module including a first air cell containing air, a second air cell containing air, and a first belt-like part connecting the first air cell and the second air cell to each other, wherein the first belt-like part comprises an air passage;

a second module including a third air cell containing air, a fourth air cell containing air, and a second belt-like part connecting the third air cell and the fourth air cell to each other;

a coupling part that couples a part of the second air cell and a part of the fourth air cell in a second direction, where a direction from the second air cell toward the first air cell and a direction from the fourth air cell toward the third air cell are defined as a first direction, and a direction intersecting the first direction is defined as the second direction, wherein a length of the first belt-like part in the first direction is equal to or longer than a length of the third air cell in the second direction, a length of the second belt-like part in the first direction is equal to or longer than a length of the first air cell in the second direction, and the first, second, third, and fourth air cells are disposed on one flat base film, and the flat base film forms a part of the first, second, third, and fourth air cells.

2. The air cushioning material according to claim 1, further comprising:

a first module group including at least one first module and a second module group including at least one second module, wherein any one first module in the first module group and any one second module in the second module group are coupled to each other by the coupling part, and following formulae (1) and (2) are satisfied:

$$H_p \geq \frac{\sqrt{W_p^2 + W_q^2 + \delta H^2 - 2W_pW_q\cos\varphi}}{\cos\theta_p + \frac{\cos\theta_q}{\sin\theta_q}\cdot\sin\theta_p} \quad (1)$$

$$H_q \geq \frac{\sqrt{W_p^2 + W_q^2 + \delta H^2 - 2W_pW_q\cos\varphi}}{\cos\theta_q + \frac{\cos\theta_p}{\sin\theta_p}\cdot\sin\theta_q}, \quad (2)$$

where

φ represents a maximum bendable angle of the coupling part,

θp represents a maximum bendable angle of the first belt-like part,

θq represents a maximum bendable angle of the second belt-like part,

Hp represents a length from an arbitrary position on the first belt-like part to a distal end of the first module group in the first direction, Hq represents a length from an arbitrary position on the second belt-like part to a distal end of the second module group in the first direction, δH represents the length from the arbitrary position on the first belt-like part to the arbitrary position on the second belt-like part in the first direction, Wp represents a length from an arbitrary position on the coupling part to a center of the first air cell in the second direction, and Wq represents a length from the arbitrary position on the coupling part to a center of the third air cell in the second direction.

3. The air cushioning material according to claim 1, wherein a part of the first air cell and a part of the third air cell are coupled to each other by a separable coupling part comprising a perforated line.

4. The air cushioning material according to claim 1, further comprising:

a first module group including m first modules having parts of the second air cells coupled to each other in the second direction and a second module group including n second modules having parts of the fourth air cells coupled to each other in the second direction, m and n being natural numbers; and the coupling part that couples, in the second direction, one of the first modules in the first module group positioned at an end on side of the second module group and one of the second modules in the second module group positioned at an end on side of the first module group, wherein a length of the first belt-like part in the first direction is n times longer or more than a length of the third air cell in the second module in the second direction, and a length of the second belt-like part in the first direction is m times longer or more than a length of the first air cell in the first module in the second direction.

5. The air cushioning material according to claim 1, further comprising:

m first modules, m being a natural number that is equal to or larger than two; and m−1 coupling parts of the second air cells of the m first modules to each other in the second direction, wherein a length of the first belt-like part in the m first modules in the first direction is m−1 times longer or more than a length of the first air cell in the second direction, and the first module one side of one of the coupling parts arbitrarily selected in the second direction is used as the second module.

6. The air cushioning material according to claim 1, wherein in the first air cell in the first module, a first part and a second part are provided, at least one of the first part and the second part being an air cell, a sum of a length of the first part in the first direction and a length of the second part in the first direction is two times larger than a sum of a length of the second air cell in the second direction and a length of the first belt-like part in the second direction, a length of the second part in the second direction is equal to or longer than a length of the first part in the second direction, at least one or more first part and at least one or more second part are alternately arranged with the first part positioned at a distal end, in the third air cell in the second module, the first part and the second part are provided, at least one of the first part and the second part being an air cell, a sum of a length of the first part in the first direction and a length of the second part in the first direction is two times larger than a sum of a length of the second air cell in the second direction and a length of the second belt-like part in the second direction, a length of the second part in the first direction is equal to or longer than a length of the first part in the second direction, at least one or more first part and at least one or more second part are alternately arranged, and m first modules and n second modules are coupled to each other by the coupling part, m and n being natural numbers.

7. The air cushioning material according to claim 1, wherein the second belt-like part of the second module includes a plurality of belt parts in a direction connecting the third air cell and the fourth air cell to each other, and the first air cell is capable of passing between the plurality of belt parts.

8. The air cushioning material according to claim 1, wherein the first belt-like part of the first module includes a claw part, and the second belt-like part of the second module includes a claw reception part that engages with the claw part.

9. The air cushioning material according to claim 1, wherein a thickness of the first belt-like part is no more than half of a maximum thickness of a thinner air cell of the third air cell and the fourth air cell, and a thickness of the second belt-like part is no more than half of a maximum thickness of a thinner air cell of the first air cell and the second air cell.

10. The air cushioning material according to claim 1, wherein the air cushioning material is U-shaped.

11. The air cushioning material according to claim 1, wherein a length of the coupling part in the first direction is longer than a length of the first belt-like part in the second direction.

12. The air cushioning material according to claim 1, wherein an entire structure of the air cushioning material is U-shaped.

13. The air cushioning material according to claim 1, wherein the first, second, third, and fourth air cells are configured to protect three surfaces of an article.

* * * * *